US006002373A

United States Patent [19]

Taniguchi et al.

[11] Patent Number: 6,002,373

[45] Date of Patent: Dec. 14, 1999

[54] GLASS WINDOW ANTENNA

[75] Inventors: Tatsuaki Taniguchi; Kazuo Shigeta; Kenji Kubota, all of Hiroshima-ken, Japan

[73] Assignee: Mazda Motor Corporation, Hiroshima, Japan

[21] Appl. No.: 08/879,598

[22] Filed: Jun. 20, 1997

[30] Foreign Application Priority Data

Jun. 20, 1996 [JP] Japan ..... 8-160306

[51] Int. Cl.[6] ..... H01Q 1/32

[52] U.S. Cl. ..... 343/713; 343/704

[58] Field of Search ..... 343/713, 704, 343/711, 712; H01Q 1/32

[56] References Cited

U.S. PATENT DOCUMENTS

| | | | |
|---|---|---|---|
| 4,155,090 | 5/1979 | Kuroyanagi et al. | 343/713 |
| 5,029,308 | 7/1991 | Lindenmeier et al. | 343/704 |
| 5,119,106 | 6/1992 | Murakami | 343/713 |
| 5,581,264 | 12/1996 | Tabata et al. | 343/713 |

FOREIGN PATENT DOCUMENTS

| | | |
|---|---|---|
| 0 411 963 A2 | 2/1991 | European Pat. Off. . |
| 0 506 334 A1 | 9/1992 | European Pat. Off. . |
| 0 562 607 A2 | 9/1993 | European Pat. Off. . |
| 0 588 514 A1 | 3/1994 | European Pat. Off. . |
| 55-60304 | 5/1980 | Japan . |
| 61-73403 | 4/1986 | Japan . |
| 62-131606 | 6/1987 | Japan . |
| 63-92409 | 6/1988 | Japan . |
| 4-59606 | 5/1992 | Japan . |
| 5-14028 | 1/1993 | Japan . |
| 0 808 401 1A | 3/1996 | Japan . |

OTHER PUBLICATIONS

Development of Capacitance–Loaded Window Antenna for AM/FM Car Radios, International Congress and Exposition Detroit, Michigan, Feb. 27–Mar. 2, 1995, pp. 1–8.

Development of Dual Radio and TV Window Antenna without Antenna Boosters, Mazda Technical Review 1996, No. 14, Kazuo Shigeta, et al. all pages (partial translation).

*Primary Examiner*—Hoanganh Le
*Assistant Examiner*—Hoang Nguyen

[57] ABSTRACT

A glass antenna has a rectangular loop antenna element which is extended on the upper region of a windshield glass where no heating wires of a defogger are arranged, and is capacitively coupled to the uppermost heating wire of the defogger at a predetermined capacitance, and a T-shaped second antenna element which is arranged on a region where the defogger is arranged, and is capacitively coupled to the uppermost heating wire of the defogger.

48 Claims, 70 Drawing Sheets

| COUPLING CAPACITANCE | SHORTENING RATIO |
|---|---|
| 5pF | 0.5 |
| 8pF | 0.68 |
| 10pF | 0.75 |
| 15pF | 0.84 |
| 25pF | 0.95 |
| 40pF | 1.0 |

AVERAGE VALUE (dB) WITHIN EVALUATION FREQUENCY RANGE

| | | Pw – AV |
|---|---|---|
| I | CENTER, SINGLE | −13.1 |
| II | DEF#1 DIRECTLY COUPLED TO VERTICAL WIRE (36cm) | −13.9 |
| III | DEF#1 CAPACITIVELY COUPLED TO VERTICAL WIRE | −13.3 |
| IV | CENTER : 20pF BETWEEN DEF#1 AND DEF#2 | −13.7 |
| | | |

AVERAGE VALUE (dB) WITHIN EVALUATION FREQUENCY RANGE

| | | Pw – AV |
|---|---|---|
| I | CENTER, SINGLE | –13.3 |
| II | LEFT 25cm (SINGLE) | –14.5 |
| III | RIGHT 25cm (SINGLE) | –15.9 |
| IV | LEFT 25cm (DIVERSITY) | –14.5 |
| V | RIGHT 25cm (DIVERSITY) | –15.5 |
| | | |

AVERAGE VALUE (dB) WITHIN EVALUATION FREQUENCY RANGE

| | | Pw – AV |
|---|---|---|
| I | CENTER, SINGLE | −13.1 |
| II | LEFT 25cm (SINGLE) | −13.3 |
| III | RIGHT 25cm (SINGLE) | −15.2 |
| IV | LEFT 25cm (DIVERSITY) | −13.5 |
| V | RIGHT 25cm (DIVERSITY) | −14.7 |
| | | |

AVERAGE VALUE (dB) WITHIN EVALUATION FREQUENCY RANGE

| | | Pw – AV |
|---|---|---|
| I | CENTER, SINGLE | −13.9 |
| II | LEFT 25cm (SINGLE) | −14.4 |
| III | RIGHT 25cm (SINGLE) | −16.1 |
| IV | LEFT 25cm (DIVERSITY) | −14.4 |
| V | RIGHT 25cm (DIVERSITY) | −15.9 |
| | | |

AVERAGE VALUE (dB) WITHIN EVALUATION FREQUENCY RANGE

| | | Pw – AV |
|---|---|---|
| I | HORIZONTAL WIRE = 80cm | −12.8 |
| II | HORIZONTAL WIRE = 70cm | −12.5 |
| III | HORIZONTAL WIRE = 60cm | −13.0 |
| IV | HORIZONTAL WIRE = 50cm | −12.9 |
| V | HORIZONTAL WIRE = 40cm | −12.7 |
| | | |

AVERAGE VALUE (dB) WITHIN EVALUATION FREQUENCY RANGE

| | | Pw – AV |
|---|---|---|
| I | HORIZONTAL WIRE = 30cm | −12.8 |
| II | HORIZONTAL WIRE = 20cm | −12.7 |
| III | HORIZONTAL WIRE = 10cm | −12.8 |
| IV | HORIZONTAL WIRE = 5cm | −13.1 |
| V | HORIZONTAL WIRE = 2cm | −15.0 |
| VI | HORIZONTAL WIRE = 0cm | −16.7 |
| | | |

AVERAGE VALUE (dB) WITHIN EVALUATION FREQUENCY RANGE

| | | Pw − AV |
|---|---|---|
| I | HORIZONTAL WIRE = 80cm | −13.1 |
| II | HORIZONTAL WIRE = 70cm | −11.5 |
| III | HORIZONTAL WIRE = 60cm | −12.2 |
| IV | HORIZONTAL WIRE = 50cm | −12.0 |
| V | HORIZONTAL WIRE = 40cm | −12.1 |
| | | |

AVERAGE VALUE (dB) WITHIN EVALUATION FREQUENCY RANGE

| | | Pw – AV |
|---|---|---|
| I | HORIZONTAL WIRE = 30cm | −12.3 |
| II | HORIZONTAL WIRE = 20cm | −12.3 |
| III | HORIZONTAL WIRE = 10cm | −12.7 |
| IV | HORIZONTAL WIRE = 5cm | −13.3 |
| V | HORIZONTAL WIRE = 2cm | −15.3 |
| VI | HORIZONTAL WIRE = 0cm | −19.7 |
| | | |

AVERAGE VALUE (dB) WITHIN EVALUATION FREQUENCY RANGE

| | | Pw – AV |
|---|---|---|
| I | HORIZONTAL WIRE = 80cm | −12.5 |
| II | HORIZONTAL WIRE = 60cm | −12.4 |
| III | HORIZONTAL WIRE = 40cm | −12.3 |
| IV | HORIZONTAL WIRE = 30cm | −12.2 |
| | | |

AVERAGE VALUE (dB) WITHIN EVALUATION FREQUENCY RANGE

| | | Pw – AV |
|---|---|---|
| I | HORIZONTAL WIRE = 20cm | −12.2 |
| II | HORIZONTAL WIRE = 15cm | −12.6 |
| III | HORIZONTAL WIRE = 10cm | −13.6 |
| IV | HORIZONTAL WIRE = 8cm | −14.3 |
| | | |

AVERAGE VALUE (dB) WITHIN EVALUATION FREQUENCY RANGE

| | | Pw – AV |
|---|---|---|
| I | HORIZONTAL WIRE = 6cm | −15.1 |
| II | HORIZONTAL WIRE = 4cm | −15.9 |
| III | HORIZONTAL WIRE = 2cm | −16.3 |
| IV | HORIZONTAL WIRE = 0cm | −16.4 |
| | | |

AVERAGE VALUE (dB) WITHIN EVALUATION FREQUENCY RANGE

| | | Pw – AV |
|---|---|---|
| I | HORIZONTAL WIRE = 80cm | −13.1 |
| II | HORIZONTAL WIRE = 60cm | −13.0 |
| III | HORIZONTAL WIRE = 40cm | −12.8 |
| IV | HORIZONTAL WIRE = 30cm | −12.9 |
| | | |

AVERAGE VALUE (dB) WITHIN EVALUATION FREQUENCY RANGE

| | | Pw – AV |
|---|---|---|
| I | HORIZONTAL WIRE = 20cm | −13.4 |
| II | HORIZONTAL WIRE = 15cm | −13.7 |
| III | HORIZONTAL WIRE = 10cm | −14.7 |
| IV | HORIZONTAL WIRE = 8cm | −15.5 |
| | | |

AVERAGE VALUE (dB) WITHIN EVALUATION FREQUENCY RANGE

| | | Pw – AV |
|---|---|---|
| I | HORIZONTAL WIRE = 6cm | −16.4 |
| II | HORIZONTAL WIRE = 4cm | −17.5 |
| III | HORIZONTAL WIRE = 2cm | −18.8 |
| IV | HORIZONTAL WIRE = 0cm | −19.8 |
| | | |

AVERAGE VALUE (dB) WITHIN EVALUATION FREQUENCY RANGE

| | | Pw – AV |
|---|---|---|
| I | HORIZONTAL WIRE = 40cm | −13.1 |
| II | HORIZONTAL WIRE = 30cm | −12.9 |
| III | HORIZONTAL WIRE = 20cm | −12.9 |
| IV | HORIZONTAL WIRE = 18cm | −12.9 |
| | | |

AVERAGE VALUE (dB) WITHIN EVALUATION FREQUENCY RANGE

| | | Pw – AV |
|---|---|---|
| I | HORIZONTAL WIRE = 18cm | −12.9 |
| II | HORIZONTAL WIRE = 5cm | −15.6 |
| III | HORIZONTAL WIRE = 0cm | −17.1 |
| | | |

AVERAGE VALUE (dB) WITHIN EVALUATION FREQUENCY RANGE

| | | Pw – AV |
|---|---|---|
| I | HORIZONTAL WIRE = 40cm | −12.5 |
| II | HORIZONTAL WIRE = 30cm | −12.5 |
| III | HORIZONTAL WIRE = 20cm | −12.6 |
| IV | HORIZONTAL WIRE = 18cm | −12.6 |
| | | |

AVERAGE VALUE (dB) WITHIN EVALUATION FREQUENCY RANGE

| | | Pw – AV |
|---|---|---|
| I | HORIZONTAL WIRE = 18cm | −12.6 |
| II | HORIZONTAL WIRE = 5cm | −15.2 |
| III | HORIZONTAL WIRE = 0cm | −18.3 |
| | | |

AVERAGE VALUE (dB) WITHIN EVALUATION FREQUENCY RANGE

| | Pw – AV |
|---|---|
| TV1 | –13.4 |
| TV2 | –17.2 |
| TV3 | –28.6 |
| DIVERSITY SIMULATION | –13.2 |
| | |

AVERAGE VALUE (dB) WITHIN EVALUATION FREQUENCY RANGE

| | Pw – AV |
|---|---|
| TV1 | –14.0 |
| TV2 | –16.3 |
| TV3 | –16.9 |
| DIVERSITY SIMULATION | –12.3 |
| | |

AVERAGE VALUE (dB) WITHIN EVALUATION FREQUENCY RANGE

| | Pw – AV |
|---|---|
| TV1 | –18.2 |
| TV2 | –17.7 |
| TV3 | –19.2 |
| DIVERSITY SIMULATION | –15.1 |
| | |

AVERAGE VALUE (dB) WITHIN EVALUATION FREQUENCY RANGE

| | Pw – AV |
|---|---|
| VICS (FM MULTIPLEXED) | –13.2 |
| | |

GLASS WINDOW ANTENNA

BACKGROUND OF THE INVENTION

The present invention relates to a glass antenna which is arranged on a glass such as a rear windshield glass with a defogger, a method of setting the glass antenna on the glass, and parts of the glass antenna.

In a glass antenna with a defogger, how to remove the influence of the defogger is a major subject.

For example, in glass antennas disclosed in Japanese Patent Laid-Open No. 61-73403 and Japanese Utility Model Laid-Open No. 4-59606, an antenna wire which has a shape similar to a pole antenna, is electrically insulated from a defogger, and extends in a direction perpendicular to a defogger heating wire, is proposed. However, the performance of the antenna wire arranged in such conventional glass antennas is far from that of a pole antenna although its shape is similar to the pole antenna, since the mechanism of the influence of the defogger on the antenna performance has remained unsolved.

In view of this problem, the inventors of the present application have proposed a glass antenna, which has, in a region where a defogger is extended, a first conductor line which perpendicularly crosses heating wires of the defogger extending in the widthwise direction of a vehicle and are electrically connected thereto in DC term, and a loop-shaped second conductor wire which is connected to none of the heating wires of the defogger, as Japanese Patent Application No. 6-205767 (U.S. application Ser. No. 08/362,788), and the like. In particular, the objective of this glass antenna is to eliminate the influence of the defogger by capacitively coupling a piece of conductor portion, which is closest to the defogger and extends in the widthwise direction of the vehicle, of the second conductor wire at a capacity of about 4 pF or more to the uppermost (or top) heating wire of the defogger extending in the widthwise direction of the vehicle.

However, the glass antenna in the above application can obtain reception characteristics as high as those of the pole antenna, but the antenna conductors must be buried in or deposited on the glass (especially, since the second antenna conductor must be connected to the defogger heating wires in DC term). Accordingly, it is impossible for the end user to set a new glass antenna on the windshield glass of his or her vehicle.

SUMMARY OF THE INVENTION

The present invention has been made in consideration of the above situation, and has as its object to provide a glass antenna, which can be easily set by a user, and is expected to have characteristics as high as those of a pole antenna.

It is another object of the present invention to provide a method of setting a glass antenna, which allows a user to easily set a glass antenna having characteristics as high as those of a pole antenna.

It is still another object of the present invention to provide glass antenna parts, with which even an end user can set a glass antenna with high performance.

In order to achieve the above objects, according to the present invention, a glass antenna which is set on a surface of a glass (1000) on which a defogger (3000) is arranged, comprises:

a first antenna element (100) which has a feeding point, is extended on a blank region on the glass surface where no heating wire of the defogger is arranged, and is capacitively coupled to a heating wire of the defogger at a predetermined capacitance; and a second antenna element (200) which has a first conductor (200*v*) extending in a first direction perpendicular to the heating wire of the defogger on a region where the defogger is extended, and is capacitively coupled to a heating wire of the defogger which is close to the first antenna element.

Also, in order to achieve the above object, according to the present invention, a method of setting an antenna on a surface of a glass (1000) on which a defogger (3000) is arranged, comprises:

the first fixing step of fixing a first antenna element (100) having a feeding point on the glass surface so as to capacitively couple the first antenna element to a heating wire of the defogger at a predetermined capacitance, on a blank region of the glass surface where no heating wire of the defogger is arranged; and the second fixing step of fixing a second antenna element having an elongated first conductor (200*v*) on the glass surface, so as to arrange the first conductor extending in a first direction perpendicular to a heating wire of the defogger on a region where the defogger is arranged, and to capacitively couple the second antenna element to a heating wire of the defogger present on a region close to the first antenna element.

The glass antenna with the above arrangement, and a glass antenna set by the above-mentioned method can realize functions equivalent or substantially equivalent to those of a directly-connected capacitive connection type antenna disclosed in the above-mentioned application of the present applicant and, hence, performance as high as that of a rear pole antenna can be expected. Since the second antenna element need not be connected to any defogger heating wire in DC term, the end user can easily set this glass antenna.

According to one preferred mode of the present invention, the heating wire of the defogger has a plurality of heating wires substantially parallel to a widthwise direction of the defogger, and the first conductor extends in a longitudinal direction of the defogger, and the second antenna element has a second conductor (200*h*) which is connected to the first conductor in DC term and extends in the widthwise direction, the second conductor being capacitively coupled to the heating wire.

According to one preferred mode of the present invention, the blank region is assured on an upper region of the glass surface, the first conductor extends in a longitudinal direction of the defogger, and the defogger has a plurality of heating wires substantially parallel to a widthwise direction of the defogger, the first antenna element is capacitively coupled to an uppermost heating wire (3000*h*) of the defogger, and the second antenna element is capacitively coupled to the uppermost heating wire.

According to one preferred mode of the present invention, a lowermost portion of the first antenna element is capacitively coupled to the uppermost heating wire by setting the lowermost portion at a position in the vicinity of the uppermost heating wire, and an uppermost end of the second antenna element is set at a position between the uppermost heating wire and the lowermost portion of the first antenna element.

According to one preferred mode of the present invention, a lowermost portion of the first antenna element is capacitively coupled to the uppermost heating wire by setting the lowermost portion at a position in the vicinity of the uppermost heating wire, and an uppermost end of the second antenna element is set at a position between the uppermost heating wire and a second uppermost heating wire.

According to one preferred mode of the present invention, a lowermost portion of the first antenna element is capacitively coupled to the uppermost heating wire by setting the lowermost portion at a position in the vicinity of the uppermost heating wire, and the first conductor of the second antenna element extends in the longitudinal direction of the defogger, and an uppermost end of the second antenna element is set to overlap the uppermost heating wire.

According to one preferred mode of the present invention, the first antenna element has a rectangular loop shape, and a bottom conductor piece of the rectangle is capacitively coupled to the heating wire of the defogger.

According to one preferred mode of the present invention, the first conductor (200*v*) and the second conductor (200*h*) of the second antenna element form a T shape, and a length of the second conductor is set at not less than 5 cm.

According to one preferred mode of the present invention, a length of the first conductor (200*v*) of the second antenna element is set in correspondence with a frequency of a radio wave to be received.

According to one preferred mode of the present invention, the first antenna element is capacitively coupled to a closest heating wire of the defogger, and the second antenna element is capacitively coupled to the closest heating wire.

According to one preferred mode of the present invention, the length of the second conductor is set at not less than 20 cm.

According to one preferred mode of the present invention, the second antenna element is capacitively coupled to the heating wire of the defogger at not less than 10 pF.

According to one preferred mode of the present invention, the heating wire of the defogger has a plurality of heating wires substantially parallel to a widthwise direction of the defogger, and the second antenna element is capacitively coupled to the heating wire of the defogger when the second conductor is coupled to the heating wire via a capacitor having the predetermined capacity.

According to one preferred mode of the present invention, the conductor of the second antenna is set on the glass surface via an insulating layer on the region where the defogger is arranged.

According to one preferred mode of the present invention, the second antenna element is adhered onto the glass surface by an adhesive.

According to one preferred mode of the present invention, the first conductor of the second antenna element is arranged at a substantially central position in a widthwise direction of the defogger.

According to one preferred mode of the present invention, a plurality of first antenna elements equivalent to the first antenna element are arranged on the blank region to constitute a diversity antenna system.

According to one preferred mode of the present invention, the heating wire to which the first antenna element is capacitively coupled, and the heating wire to which the second antenna element is capacitively coupled are an arbitrary, identical heating wire of the defogger.

According to one preferred mode of the present invention, the heating wire to which the second antenna element is capacitively coupled is an arbitrary heating wire of the defogger, which is present at a position in the vicinity of the first antenna element.

According to one preferred mode of the present invention, the second antenna element has at least one branch conductor wire extending in a widthwise direction of the defogger, and the at least one branch conductor wire is capacitively coupled to at least one heating wire of the defogger.

Furthermore, in order to achieve the above objects, according to the present invention, in a glass antenna having a first conductor (200*v*) extending in a first direction, and a second conductor (200*h*) which is connected to the first conductor in DC term and extends in a second direction perpendicular to the first direction, a glass antenna part is characterized by being applied with an adhesive which can arrange the first and second conductors on a glass surface.

According to one preferred mode of the present invention, the adhesive is applied onto substantially entire rear surfaces of the first and second conductors.

According to one preferred mode of the present invention, an adhesive transparent seal (200S) which covers surfaces of the first and second conductors to have a size larger than the surfaces is adhered on the surfaces of the first and second conductors, and an adhesive layer is formed on a rear surface of the seal, thereby adhering the seal onto the glass surface.

A glass antenna part of the present invention comprises:

a first antenna element (100) which has a feeding point and is made up of a loop-shaped conductor having at least one straight portion to serve as an antenna element, and is applied with an adhesive to adhere the first antenna element onto a glass surface;

a ground assembly (50) which has a ground line to be connected to the feeding point of the first antenna element, and attachment means which allows attachment of a main body to a vehicle body or the like; and a second antenna element which has a first conductor portion (200*v*) extending in a first direction, and a second conductor portion (200*h*) which is connected to the first conductor portion in DC term and extends in a second direction perpendicular to the first direction, and is applied with an adhesive to adhere the first and second conductor portions onto the glass surface.

Other features and advantages of the present invention will be apparent from the following description taken in conjunction with the accompanying drawings, in which like reference characters designate the same or similar parts throughout the figures thereof.

DETAILED DESCRIPTION OF THE INVENTION

A glass antenna according to the present invention will be explained hereinafter with reference to the accompanying drawings. In the following embodiments, the present invention is applied to a vehicle glass antenna and, in particular, a rear glass antenna (although the present invention is not limited to such specific antenna alone).

Principle of Capacitive Connection Type Antenna

The glass antenna of the present invention is based on a capacitive connection type glass antenna disclosed in, e.g., Japanese Patent Publication No. 6-205767 (U.S. patent application Ser. No. 08/362,788) by the present applicant. The capacitive connection type glass antenna disclosed in, e.g., Japanese Patent Publication No. 6-205767 eliminates the influence of a defogger on an antenna by using a loop antenna arrangement which is capacitively connected to the uppermost heating wire of the defogger. For this reason, the glass antenna previously proposed by the present applicant will be referred to as a "directly-connected capacitive connection type antenna" hereinafter so as to distinguish it from the glass antenna of this embodiment. The principle of the directly-connected capacitive connection type antenna will be described below with reference to FIGS. 1 to 10.

Note that the contents of U.S. patent application Ser. No. 08/362,788 are incorporated herewith by reference to the present specification.

Figure 1:
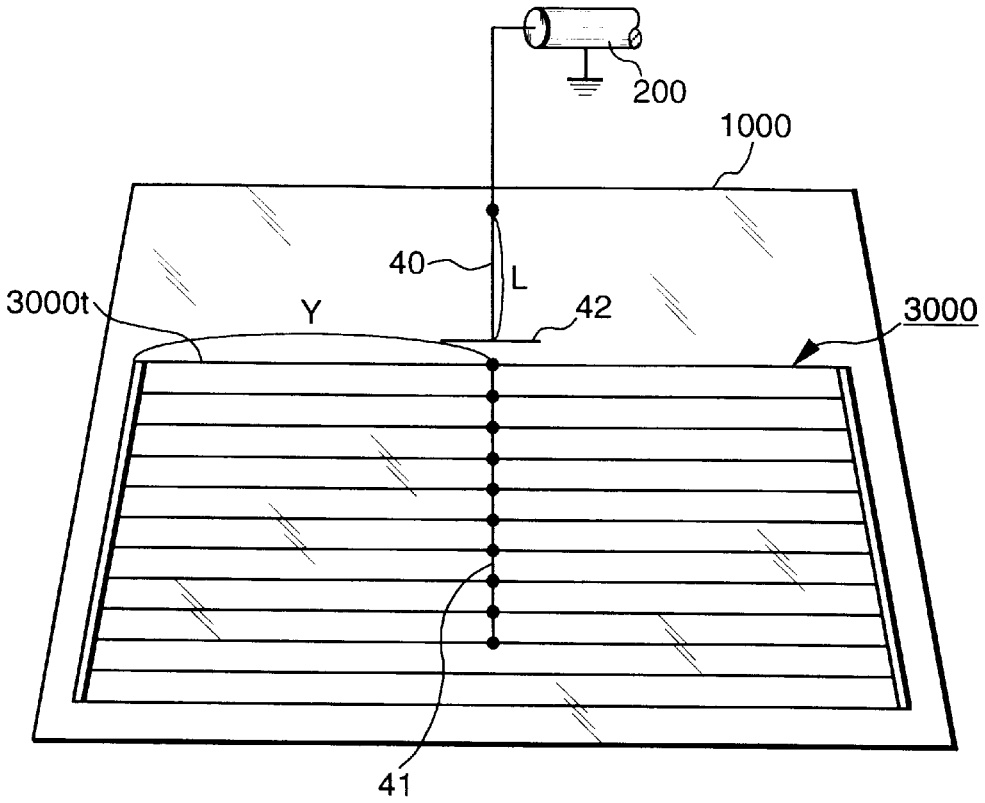
FIG. 1 is a view for explaining the principle of minimizing the influence of a defogger in a directly-connected capacitive connection type antenna disclosed in the application (Japanese Patent Publication No. 6-205767) previously proposed by the applicant of the present invention.
Figure 2:
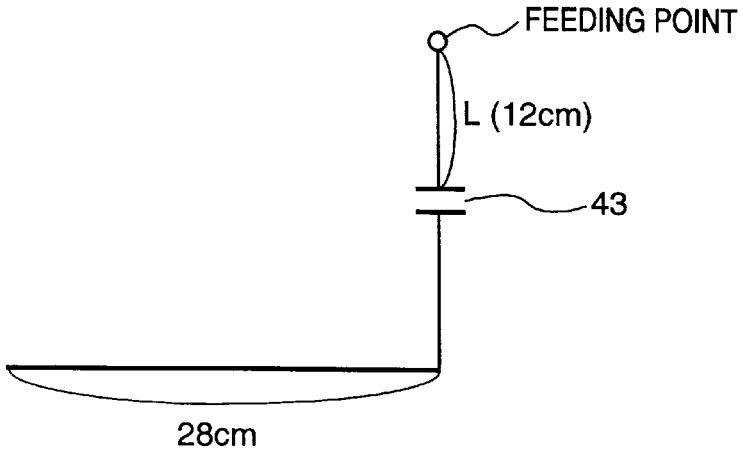
FIG. 2 shows the model of the antenna arrangement to explain the principle according to which the influence of the defogger is minimized in the antenna shown in FIG. 1.
Figure 3:
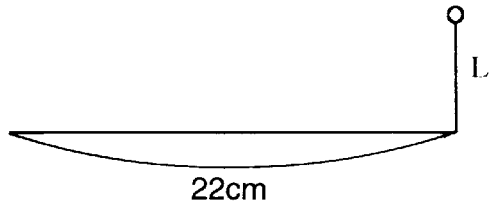
FIG. 3 shows the model of the antenna arrangement to explain the principle according to which the influence of the defogger is minimized in the antenna shown in FIG. 1.

FIG. 1 shows an example of the arrangement of the "directly-connected capacitive connection type antenna". This example has a first antenna conductor 41 which extends vertically to cross heating wires 3000 in a region where the heating wires of a defogger are arranged. A second antenna conductor 42 extends horizontally, i.e., in a direction parallel to an uppermost heating wire 3000*t* of the defogger, and a conductor 40 extends perpendicular to the conductor 42. Let L be the length of the conductor 40 from the feeding point, and 2Y be the length of each heating wire (the uppermost heating wire 3000*t*) of the defogger. In order to clarify the relationship between the conductor 40 and the heating wires 3000, an equivalent circuit diagram like FIG. 2 will be examined. In FIG. 2, a capacitor 43 corresponds to a coupling capacitance formed upon connecting the conductor 42 and the heating wire 3000*t*. The antenna shortening ratio by the capacitor 43 is given by α. If the coupling capacitance C=11 pF (at 84 MHz), L=12 cm, and Y=28 cm, the antenna shown in FIG. 2 is equivalent that shown in FIG. 3 by the shortening effect of the capacitor 43. In this example, since the length of the antenna conductor after the capacitor 43 is shortened from 28 cm to 22 cm, the capacitor shortening ratio α is:

$$\alpha = \frac{22}{28}$$

Figure 4:
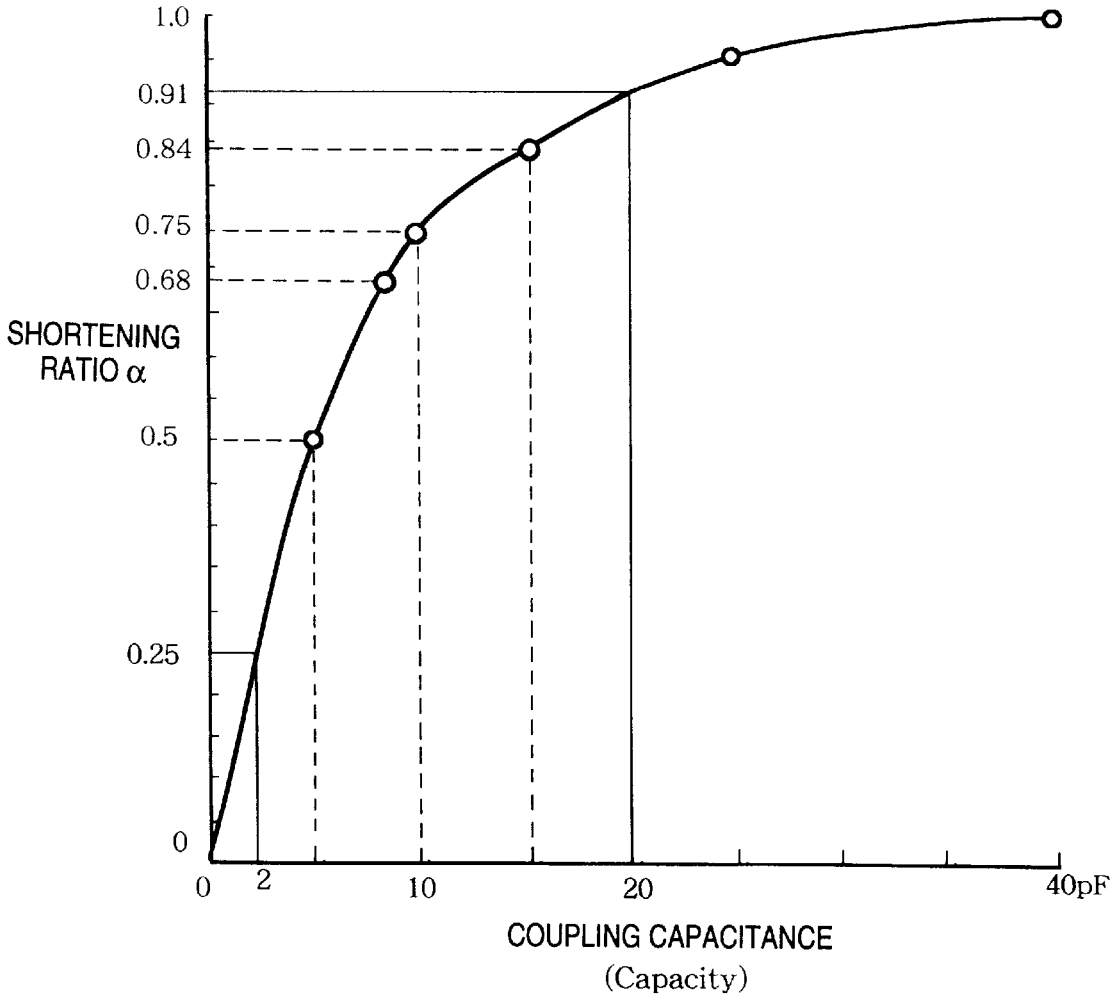
FIG. 4 is a graph showing the relationship between the shortening ratio $\alpha$ and the coupling capacitance C.

FIG. 4 shows the relationship between the shortening ratio α and the coupling capacitance obtained by experiments. As shown in the graph in FIG. 4, the shortening ratio α increases as the coupling capacitance C becomes larger. However, the value of the shortening ratio α does not exceed unity even if C increases, when the coupling capacitance C has exceeded 40 pF. This means that it is nonsense to increase the capacity beyond 40 pF.

In order to avoid the large influence of the heating wire 3000*t* with the length 2Y on the antenna, the impedance of the heating wire need only be made very large. In order to increase the impedance of the heating wire 3000*t* very much, the present inventors found by experiments that the relationship among the length L of the conductor (a portion of the antenna), the length Y of the heating wire (the uppermost heating wire), and the shortening ratio α by capacitive coupling can be set to satisfy:

$$\beta \cdot \frac{\lambda}{4} = L + \alpha \cdot Y \tag{1}$$

where λ is the wavelength of the radio waves to be received, and β is the antenna shortening ratio by glass. It is known that glass for a vehicle normally has β=0.6.

Equation (1) above can be rewritten:

$$\alpha = \frac{\beta \cdot \frac{\lambda}{4} - L}{Y} \tag{2}$$

A case will be examined below using equation (2) wherein the directly-connected capacitive connection type antenna is applied to various types of vehicles.

As can be understood from equation (2), in a vehicle having a large L, α is small. In order to eliminate the influence of the defogger in such case, the coupling capacitance C is decreased according to the graph in FIG. 4. On the other hand, as can be understood from equation (2), in a vehicle having a small length Y, α is large. For this reason, the coupling capacitance C must be increased in this case.

When the defogger determined by the above-mentioned scheme is set to have almost no influence on the antenna characteristics, the wavelength in the FM frequency band must satisfy:

$$70\ \text{cm} \leqq \lambda/4 \leqq 100\ \text{cm}$$

When the antenna is mounted on a vehicle, both sides of the above relation must be multiplied with the glass shortening ratio (β=0.6):

$$42\ \text{cm} \leqq \beta \cdot \lambda/4 \leqq 60\ \text{cm}$$

That is, the glass antenna must be set to satisfy:

$$42\ \text{cm} \leqq L + \alpha \cdot Y \leqq 60\ \text{cm}$$

Note that equation (1) holds in an ideal state wherein the end portion of a bus bar of the defogger is short-circuited to the vehicle body. In an actual vehicle, since the bus bar and the body can be considered to be connected via a certain coupling capacitance, it is obtained by experiments that L+α·Y above for FM radio waves preferably falls within the range:

$$20\ \text{cm} \leqq L + \alpha \cdot Y \leqq 70\ \text{cm} \tag{3}$$

Also, an antenna particularly suitably used in North America in which the frequency band of FM radio waves ranges from 88 MHz to 108 MHz exhibits preferred performance when it is set to satisfy:

$$40\ \text{cm} \leqq L + \alpha \cdot Y \leqq 50\ \text{cm}$$

On the other hand, a glass antenna for the FM radio wave frequency band from 76 MHz to 90 MHz in Japan exhibits preferred performance when it is set to satisfy:

$$50\ \text{cm} \leqq L + \alpha \cdot Y \leqq 60\ \text{cm}$$

In order to assure high reception performance over the entire frequency band so as to receive radio waves in the frequency band which has a certain range like FM radio waves, L+α·Y preferably has a length matching nearly the central frequency of the frequency band to be received, as a matter of course.

Figures 5, 6:
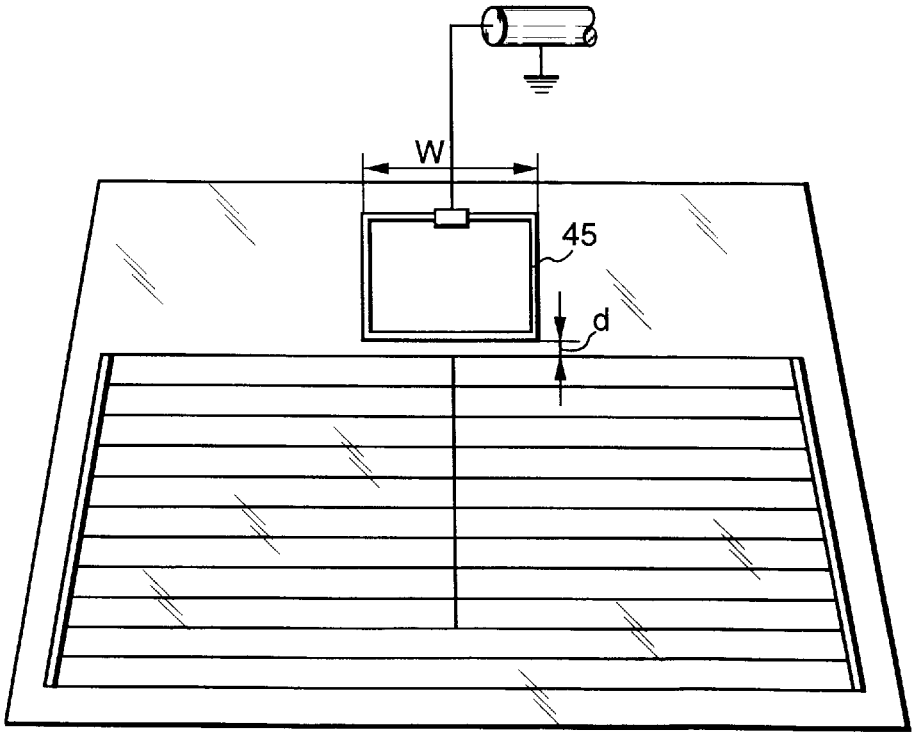
FIG. 5 is a table showing the relationship between the shortening ratio $\alpha$ and the coupling capacitance C.
FIG. 6 is a view showing an embodiment of the arrangement of the glass antenna shown in FIG. 1.
Figure 7:
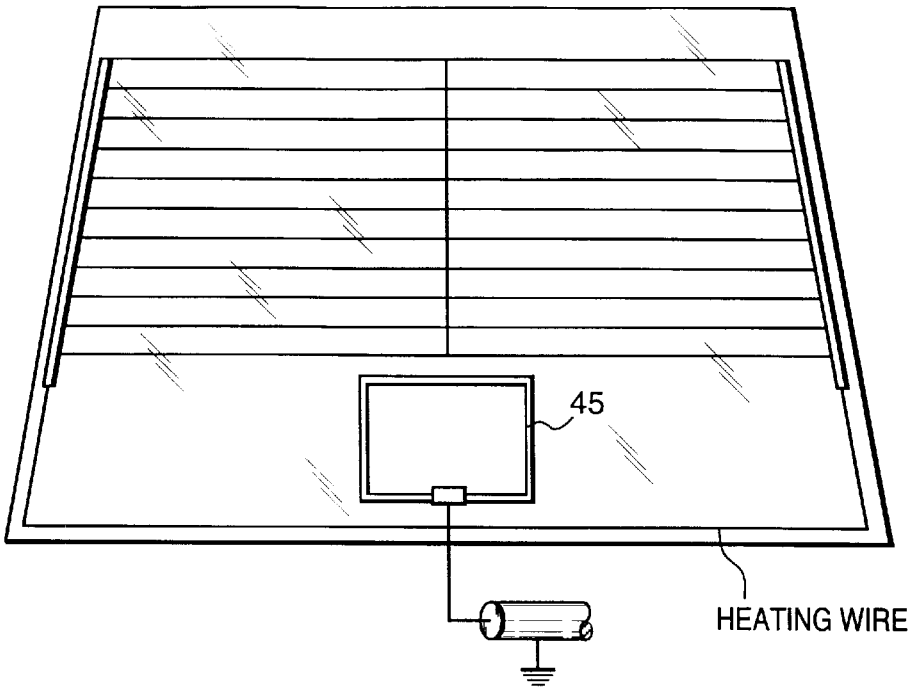
FIG. 7 is a view showing another arrangement of the glass antenna shown in FIG. 6.
Figure 8:
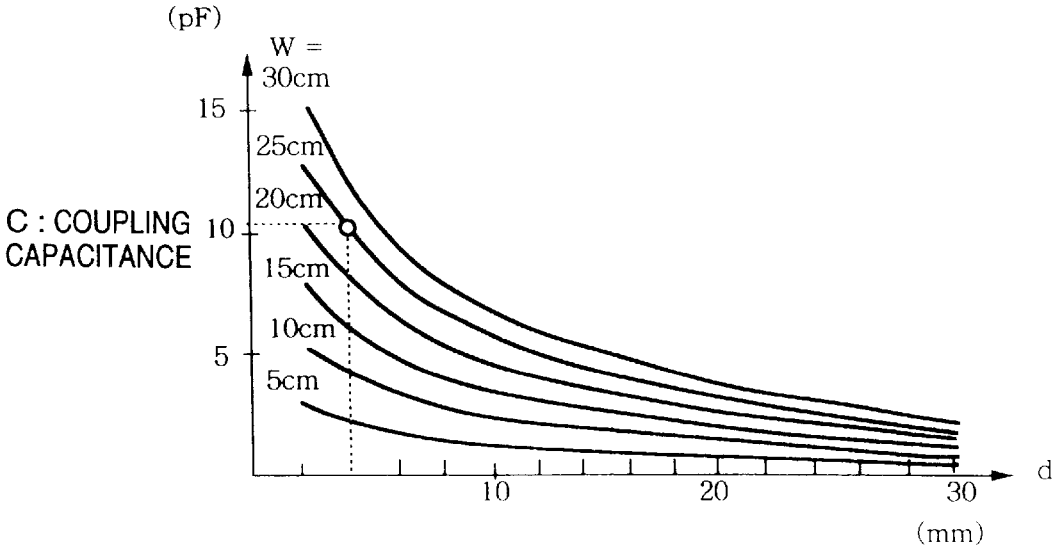
FIG. 8 is a graph showing the relationship between the coupling capacitance C and the distance d in the antenna shown in FIG. 6.

FIGS. 6 and 7 show an antenna when the first conductor 40 portion in the antenna shown in FIG. 1 is replaced by a loop conductor 45. The feature of the loop conductor lies in that it has a width W in the widthwise direction of a vehicle. When such loop conductor is used, the coupling capacitance can be easily set by changing W. FIG. 8 shows changes in coupling capacitance when the width W of the loop conductor 45 as the first antenna conductor is variously changed, and when the distance, d, between the loop conductor 45 and the defogger heating wire 3000*t* is variously changed.

Figure 9:
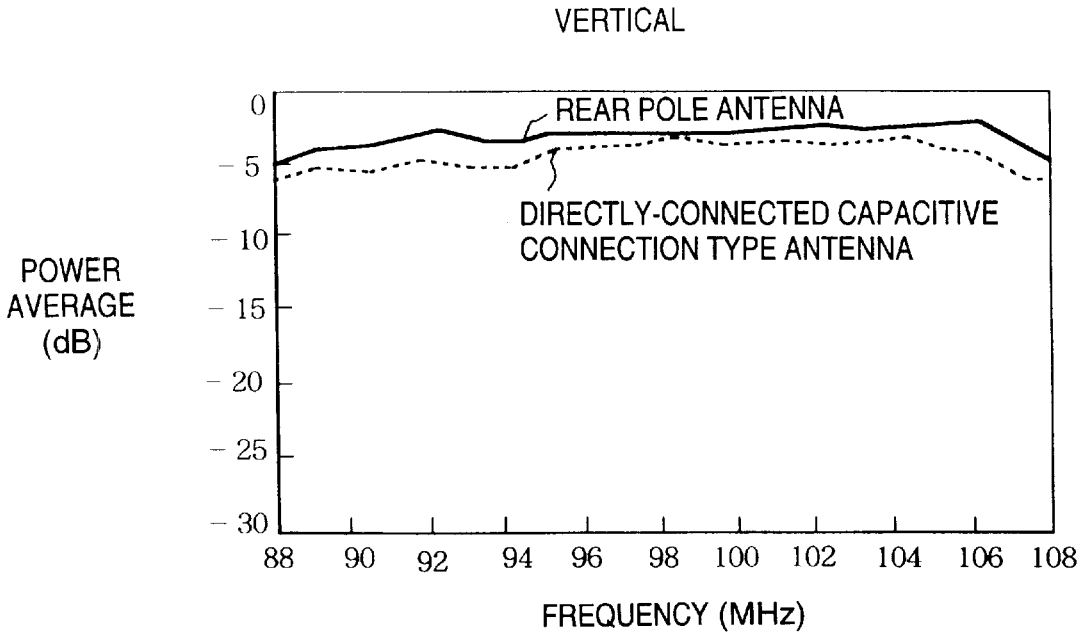
FIG. 9 is a graph showing the comparison results of performance (vertically polarized waves) between a rear pole antenna and a directly-connected capacitive connection type antenna.
Figure 10:
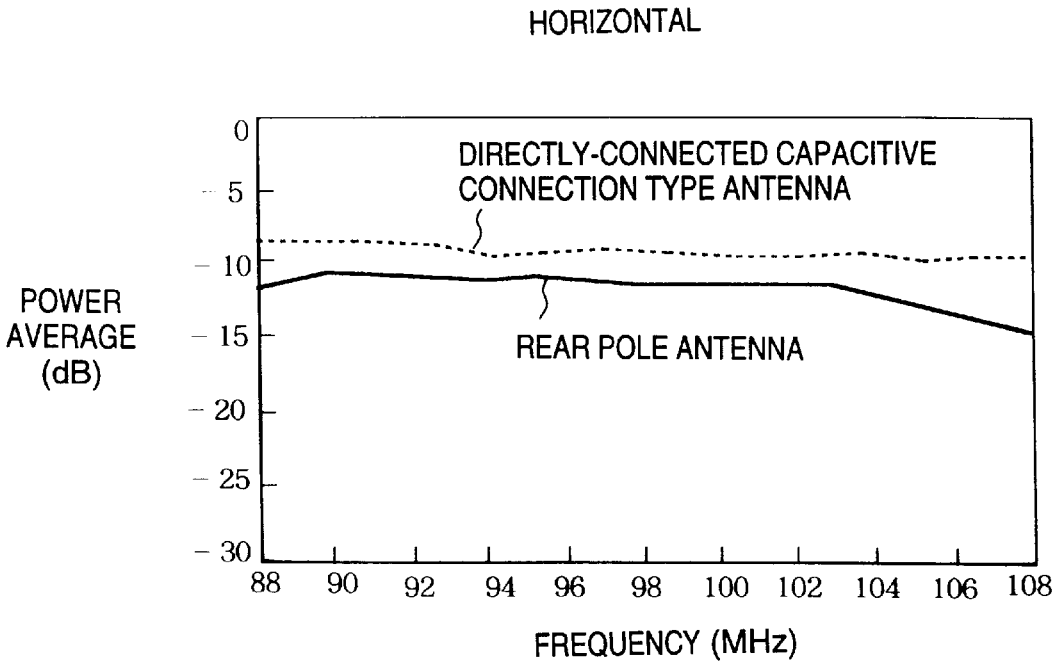
FIG. 10 is a graph showing the comparison results of performance (horizontally polarized waves) between a rear pole antenna and a directly-connected capacitive connection type antenna.

FIG. 9 (when the plane of polarization is vertical) and FIG. 10 (when the plane of polarization is horizontal) show the comparison results of performance between the glass antenna with the shape shown in FIG. 6 and a conventional rear pole antenna (90-cm long rod antenna). In FIGS. 9 and 10, the solid curve represents the characteristics of the rear pole antenna, and the broken curve represents the characteristics of the glass antenna in FIG. 6. Also, POWER AVERAGE represents the average reception strength at each frequency. As can be seen from comparison between the broken curve (directly-connected capacitive connection type antenna) and the solid curve (prior art), the directly-connected capacitive connection type antenna exhibits performance as high as that of the rear pole antenna. In particular, since the glass antenna is much superior to the rear pole antenna in terms of easy maintenance, low wind noise, and the like, such antenna with sufficiently high performance is of great practical value.

As can be seen from FIG. 7, in an example wherein the loop conductor 45 (W=20 cm) is arranged below the defogger, and the antenna is coupled at the central position of the defogger, the loop conductor portion may be arranged underneath the defogger.

The basic arrangement and the operation principle of the directly-connected capacitive connection type glass antenna found by the present inventors have been explained.

Sticker Type Capacitively Coupled Glass Antenna

The glass antenna of the present invention can be categorized as a directly-connected type glass antenna in that it is a capacitive connection type antenna, but it is far from the latter in terms of its principle and arrangement. More specifically, in the directly-connected capacitive connection type antenna, since an antenna conductor arranged in the defogger region must be connected to the defogger in DC term, the end user can hardly add a vertical antenna conductor on the windshield glass of a vehicle on which the defogger has already been embedded, while assuring DC connection with the defogger. For this reason, this sticker type capacitively coupled glass antenna can realize a glass antenna which can be additionally set on the glass window on which the defogger has already been arranged, and has performance as high as a pole type glass antenna.

Since a glass antenna as an embodiment can be additionally stuck by the end user, it will be referred to as a "sticker type capacitively coupled antenna" hereinafter for the sake of convenience.

Principle

Figure 11A:
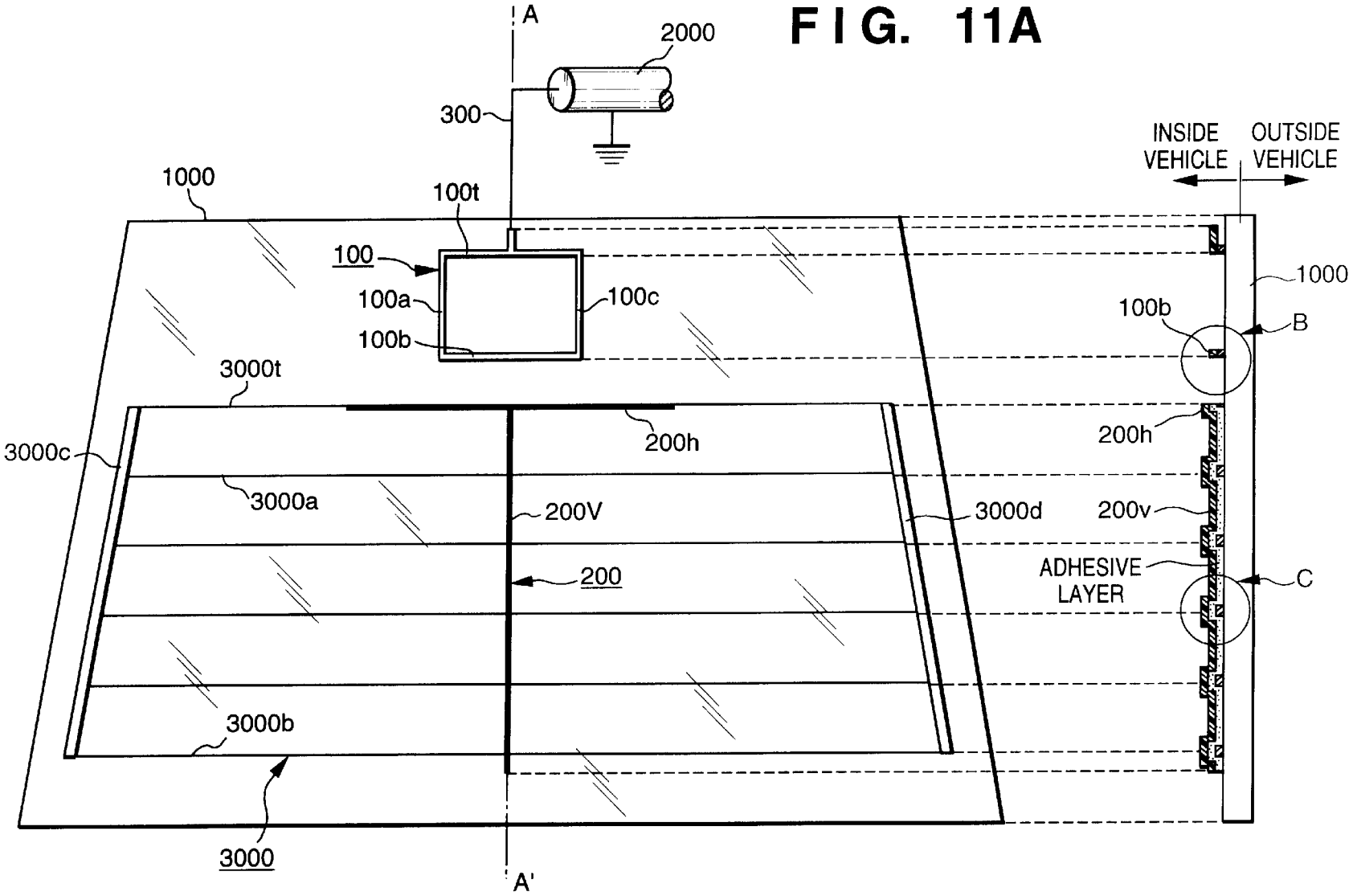
FIG. 11A is a view showing the basic arrangement of a glass antenna according to the first embodiment of the present invention.

The arrangement of a "sticker type capacitively coupled antenna" according to the first embodiment will be described below with reference to FIGS. 11A, 11B, and 11C. FIG. 11A shows the basic arrangement of that glass antenna.

Referring to FIG. 11A, reference numeral 1000 denotes a rear windshield glass of a vehicle. A defogger 3000 is extended on the windshield glass 1000. The defogger 3000 has bus bars 3000*c* and 3000*d* which are extended along the right and left vertical sides of the glass 1000. One of these bus bars is connected to ground and the other is connected to +B (+power supply terminal of a battery). A plurality of heating wires are extended between the bus bars 3000*c* and 3000*d* in the horizontal direction. For the sake of convenience, the uppermost heating wire will be referred to as a wire 3000*t* hereinafter; and the lowermost (or bottom) heating wire will be referred to as a wire 3000*b* hereinafter. The two bus bars and the plurality of heating wires are permanently arranged on the glass 1000 by, e.g., deposition.

Since the defogger 3000 is set on the lower portion side of the windshield glass 1000, a blank portion is assured on the upper portion of the glass 1000. If the defogger is set on the upper side (or either the right or left side) of the windshield glass 1000, the blank portion is assured on the lower side (or either the left or right side).

An antenna conductor wire 100 serving as a first antenna element is set on this blank portion. This conductor wire 100 is connected to a core 300 of a coaxial cable 2000. The antenna conductor wire 100 has, for example, a rectangular loop shape, and has top and bottom sides 100*t* and 100*b*, and right and left sides 100*c* and 100*a*. The individual sides of the antenna 100 are stuck on the glass 1000 via an adhesion layer. FIG. 11B is a partial sectional view of the conductor wire 100.

On the defogger region on the glass 1000, a conductor 200 serving as a second antenna element is stuck. This antenna element 200 has a conductor piece 200*h* extending in the horizontal direction, and a conductor piece 200*v* extending in the vertical direction. The conductor piece 200*v* is arranged at the center of the defogger 3000 in the vertical direction, and is connected to the central position of the conductor piece 200*h*. Hence, the antenna element 200 has a T shape.

The antenna element 200 is stuck on the glass 1000 via an adhesive layer. The conductor piece 200*h* of the antenna element 200 is arranged on the defogger heating wire 3000*t* (i.e., immediately above the defogger heating wire 3000*t*). FIGS. 11A and 11C show sectional views of the antenna element 200 in the direction A—A'.

The bottom conductor piece 100*b* of the antenna element is set to be parallel to the defogger heating wire 3000*t* at a very small distance. The distance between the conductor piece 100*b* and the defogger heating wire 3000*t* in the direction of the glass surface is a distance d within the range in which capacitive coupling with the defogger heating wire can be attained, as in the directly-connected capacitive connection type antenna described above with reference to FIGS. 1 to 10. More specifically, as for the vertical position of the antenna element 200 on the windshield glass 1000 (i.e., the position of the conductor piece 200*h* with respect to the antenna piece 100*b*), the distance between the heating wire 3000*t* and the conductor piece 200*h* is set so that the antenna element 200 is insulated from the defogger heating wire 3000*t* in DC term and they are set in a low-resistance state in AC term (such state will be simply expressed as a "capacitively coupled state" hereinafter), since the defogger heating wire 3000*t* to which the antenna element 100 is capacitively coupled is capacitively coupled to the conductor piece 200*h*.

When the antenna elements 100 and 200 are set as described above, they function as a capacitively coupled antenna, as will be described later. In particular, since both the antenna elements 100 and 200 can be set on the glass using an adhesive, even an end user can easily set a high-performance glass antenna. The antenna element 100 need only be set so that the bottom conductor piece 100*b* extends parallel to the uppermost heating wire 3000*t* at a position in the vicinity thereof. Also, the antenna element 200 need only be set so that the horizontal piece 200*h* overlaps the heating wire 3000*t* (or extends parallel to the heating wire 3000*t* at a position slightly thereabove or therebelow, as will be described later). In other words, since the user is allowed to set the antenna elements 100 and 200 using the heating wire 3000*t* as an index, the end user experiences no difficulty upon setting.

Detailed Arrangement of First Embodiment

Figure 11B:
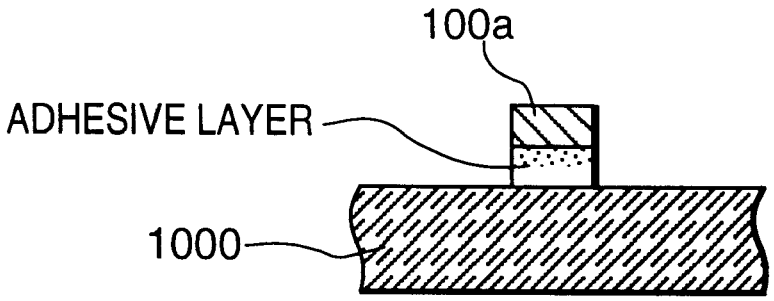
FIG. 11B is an enlarged view of a portion B of the glass antenna shown in FIG. 11A.
Figure 11C:
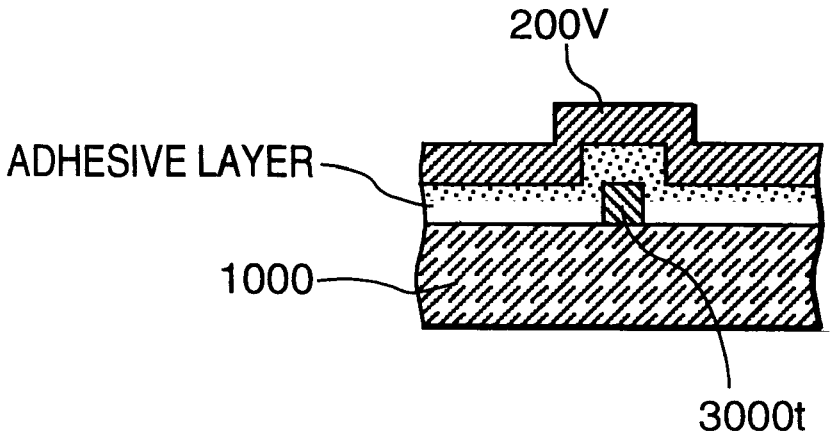
FIG. 11C is an enlarged view of a portion C of the glass antenna shown in FIG. 11A.

FIGS. 11A to 11C show the basic arrangement of the first embodiment.

Figure 12:
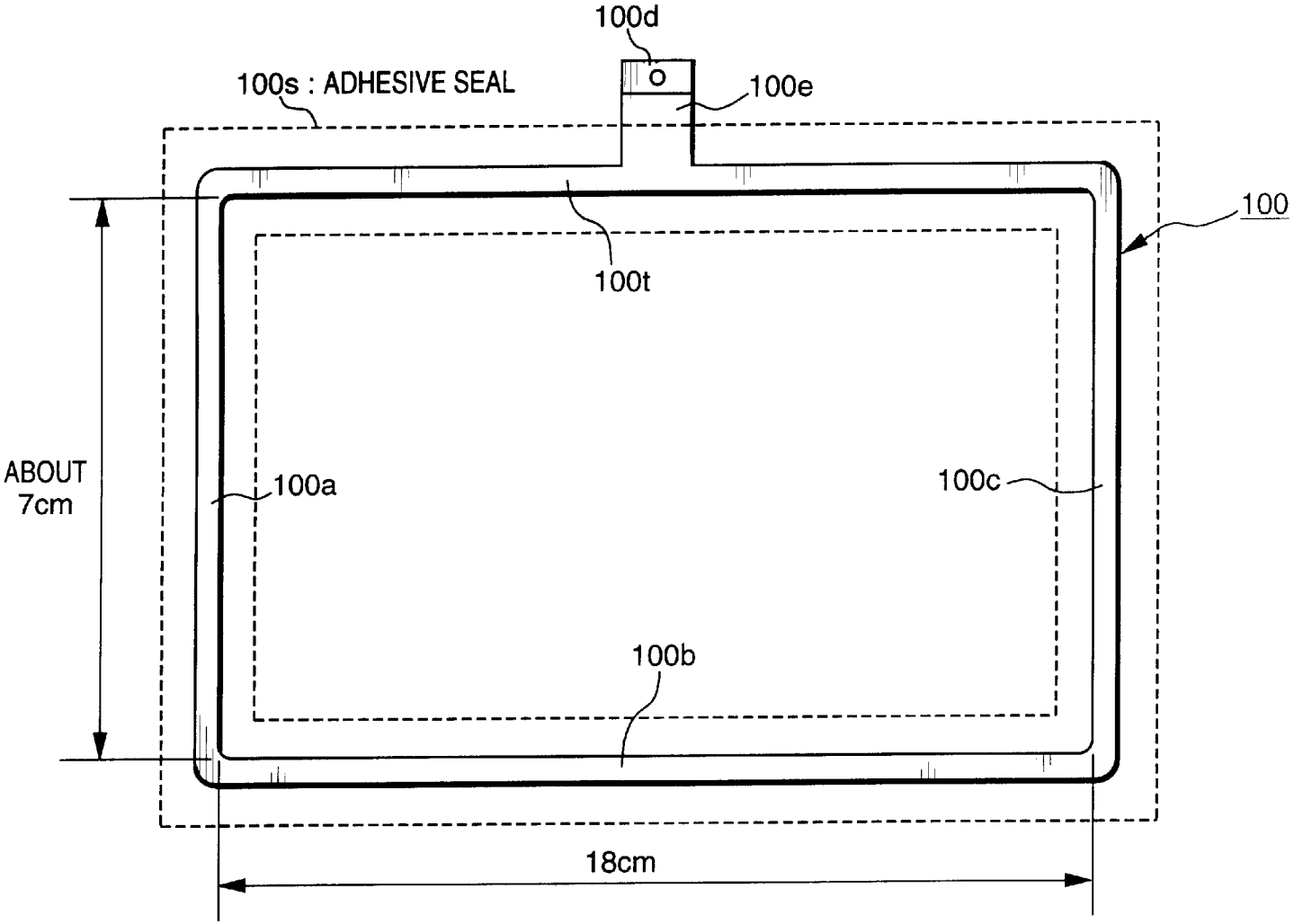
FIG. 12 is a view for explaining the shape of a first antenna element 100 commonly used in glass antennas of the first to third embodiments.
Figure 13:
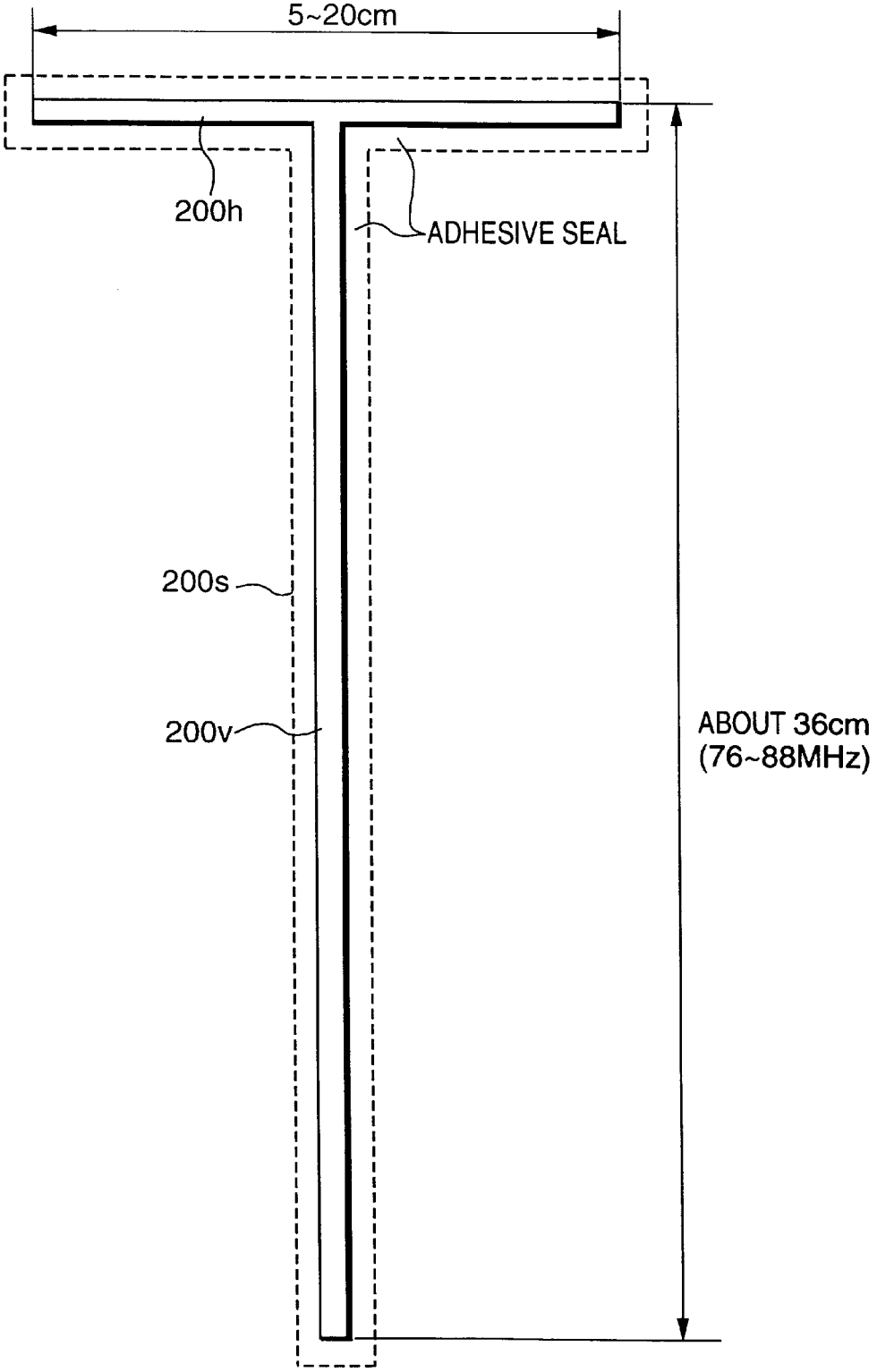
FIG. 13 is a view for explaining the shape of a second antenna element 200 commonly used in glass antennas of the first to third embodiments.

FIG. 12 shows the shape of the antenna element 100 actually used in the first embodiment, and FIG. 13 similarly shows the shape of the antenna element 200. The antenna element 100 forms a rectangular loop, and has a width of about 7 cm and a length of about 18 cm. A connection piece 100*d* is connected to the core 300 of the coaxial cable 2000. The conductor pieces of the antenna element 100 have an insulating protection coat, except for the connection piece 100*d*.

In the antenna element 200 shown in FIG. 13, the length of the conductor piece 200*v* is determined in correspondence with the reception frequency. In order to receive radio waves in the frequency band from 76 to 90 MHz, the conductor piece 200*v* preferably has a length of about 36 cm. On the other hand, the conductor piece 200*h* has a length of 5 cm or more and, preferably, 20 cm or more, so as to attain a capacity of 10 pF or more and, preferably, 20 pF or more, between itself and the defogger heating wire 3000*t*. Since the antenna element 200 need only be adhered on the glass, it can have a protection coat entirely.

In FIG. 12, the dotted line that entirely surrounds the antenna element 100 indicates an adhesive transparent seal 100S. Also, the dotted line that surrounds the antenna element 200 indicates a seal 200S. These adhesive transparent seals have a function of reinforcing adhesion of the antenna elements onto the glass and protecting the antenna elements.

Figure 14A:
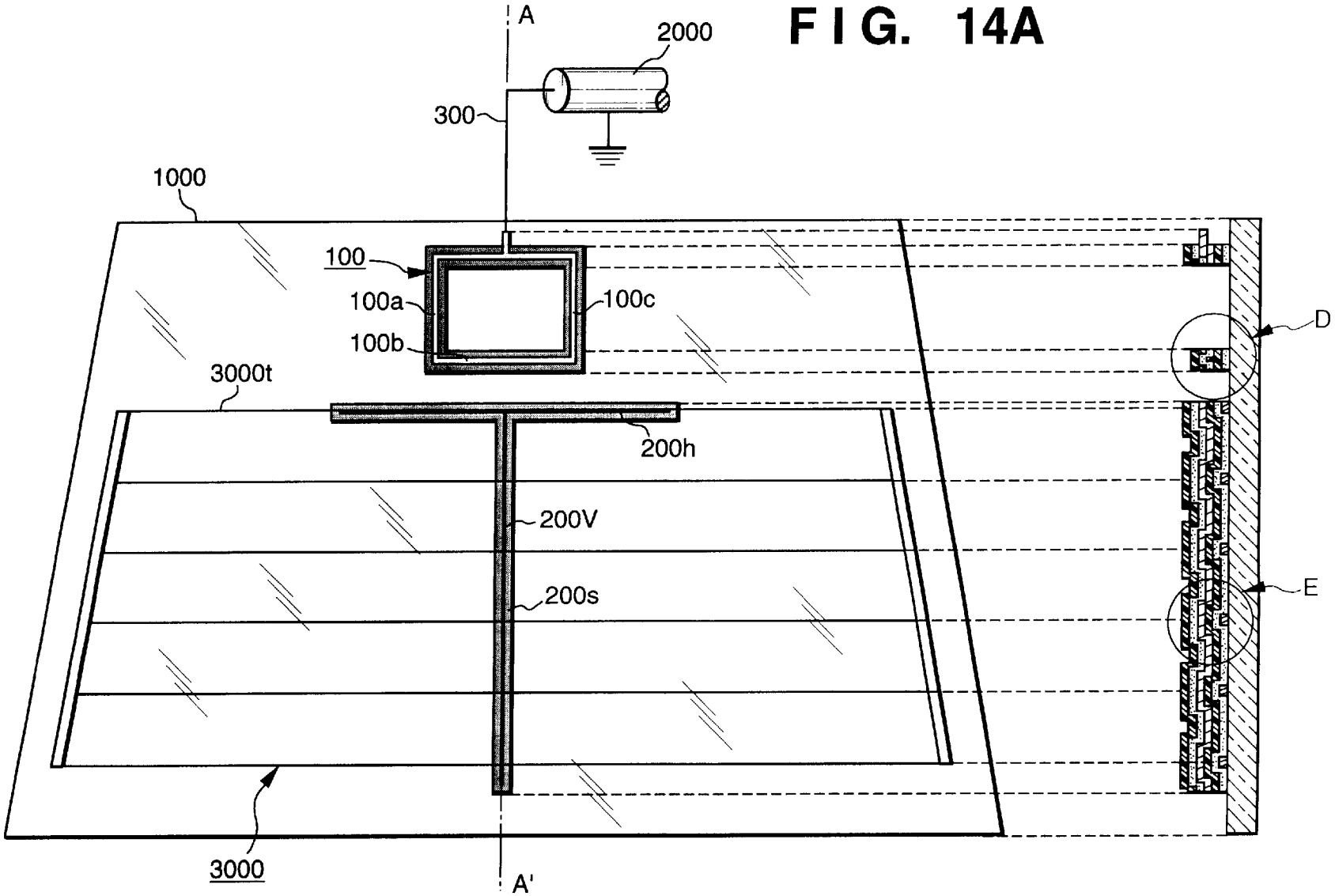
FIG. 14A is a view showing the arrangement of the glass antenna according to the first embodiment of the present invention in more detail.

FIG. 14A shows an example of the first embodiment. More specifically, in order to further reinforce adhesion of the antenna elements to the glass 1000 as compared to the glass antenna shown in FIG. 11A, the antenna elements 100 and 200 are respectively stuck onto the glass by the transparent seals 100S and 200S. Note that FIGS. 14B and 14C are enlarged views of portions D and E in FIG. 14A.

Figure 14B:
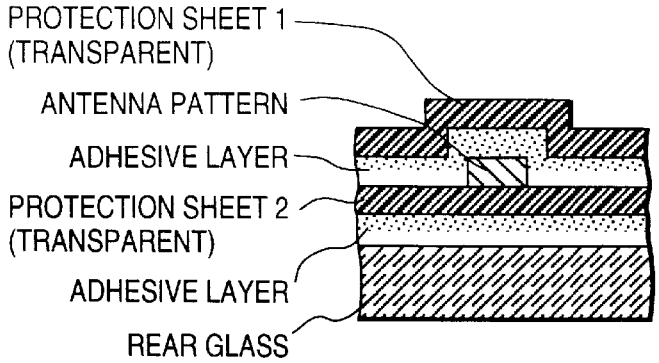
FIG. 14B is an enlarged view of a portion D of the glass antenna shown in FIG. 14A.
Figure 14C:
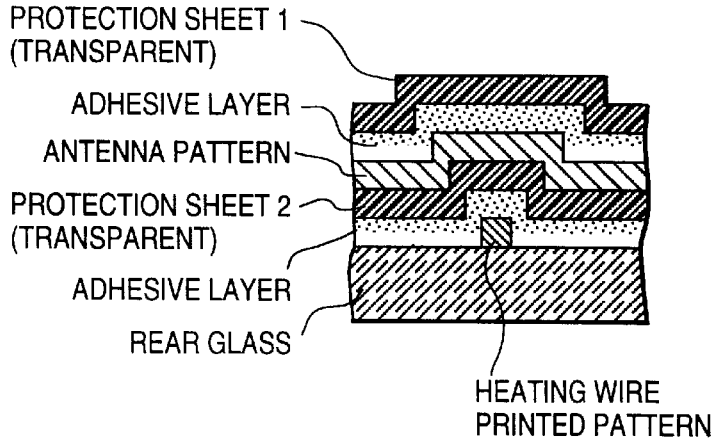
FIG. 14C is an enlarged view of a portion E of the glass antenna shown in FIG. 14A.

Note that the antenna pattern in FIGS. 14B and 14C is protected by a structure in which the uppermost transparent protection sheet is adhered to the antenna pattern by an adhesive. Alternatively, as shown in FIG. 14D, an antenna element printed on a transparent sheet may be coated with an adhesive transparent protection sheet.

Figure 14D:
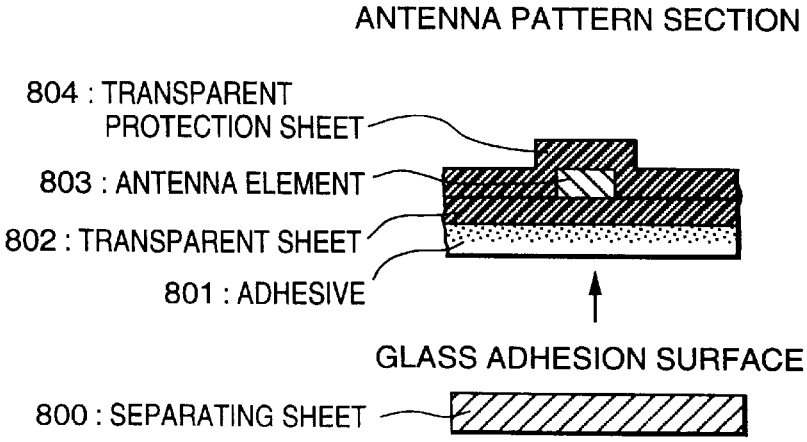
FIG. 14D is a view showing another arrangement for protecting an antenna element.

More specifically, in FIG. 14D, a transparent sheet 802 is adhered on a separating sheet 800 by an adhesive 801, and an antenna element (conductor pattern) 803 is printed on the transparent sheet 802. The transparent sheet 802 is coated with a transparent protection sheet 804, thereby protecting the antenna element 803 by the protection sheet 804.

When the antenna is used, the separating sheet 800 is removed from the transparent sheet 802.

Grounding

The grounding method of the glass antenna of the first embodiment will be explained below with reference to FIGS. 15 to 19A.

When the end user sets a rectangular antenna, grounding poses a problem. Normally, an iron plate that constitutes the vehicle body is protected by a non-conductive paint. In particular, since the glass antenna according to the embodiment of the present invention aims at allowing the end user to easily and additionally set a high-performance glass antenna, easy grounding even for the end user is required.

Figure 15:
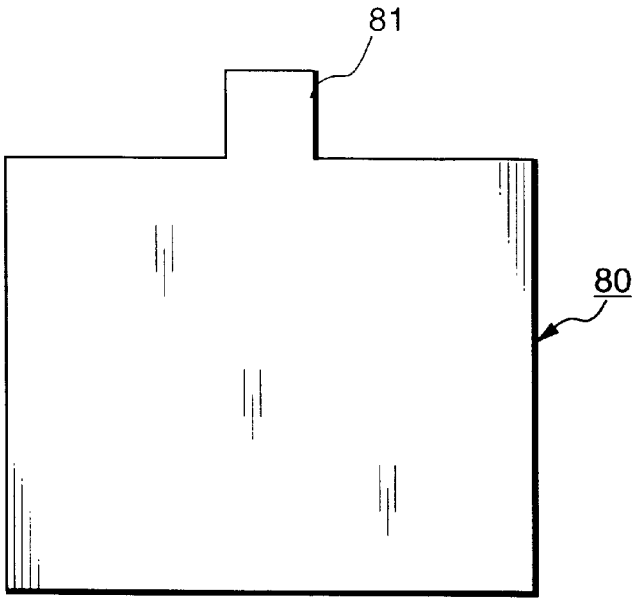
FIG. 15 is a view showing the arrangement of a ground plate commonly used in the first to third embodiments.

In order to achieve such easy grounding, the present invention proposes insertion of a ground plate 80 into a small gap present between the iron plate and the ceiling cushion member of the roof of the vehicle, as shown in FIG. 15, as a grounding structure used in the glass antenna of this embodiment. This ground plate 80 is inserted between the iron plate and the ceiling cushion member of the roof of the vehicle.

Figure 16:
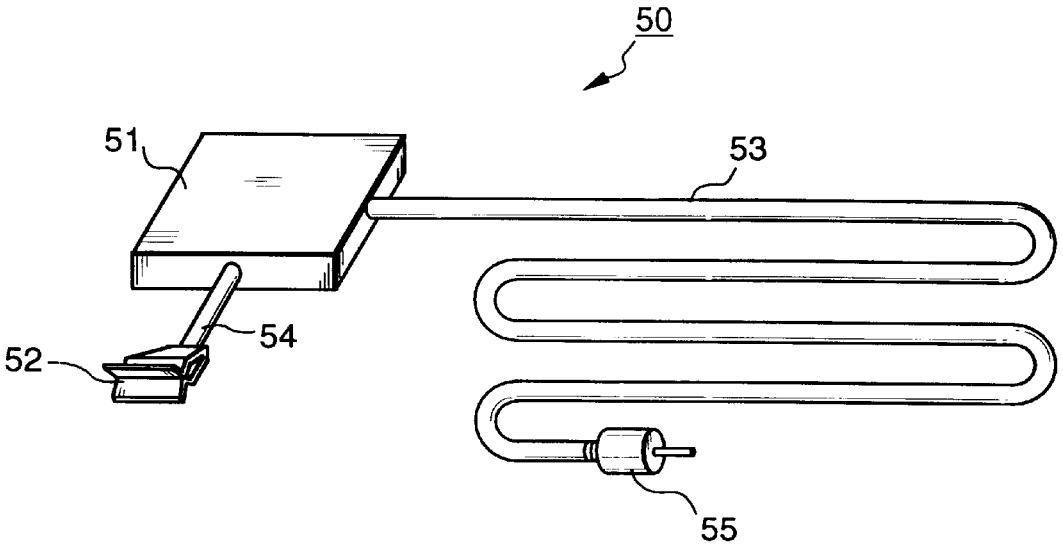
FIG. 16 is a view showing the arrangement of an adapter used for connecting a rectangular frame-shaped antenna to the ground plate.

FIG. 16 shows the arrangement of an adapter 50 used upon setting the antenna. The adapter 50 comprises a case 51, a low-impedance wire 54, a conductive clip 52 arranged at the distal end of this wire 54, a shield wire 53, and a coaxial connector 55. The connection piece 100*d* of the antenna is connected to the adapter 50. The core wire of the connector 55 is connected to a tuner or the like. The shield line of the shield wire 53, the wire 54, and the clip 52 are electrically connected to each other (in DC term). The clip 52 is connected to a tongue 81 of the ground plate 80.

Figure 17:
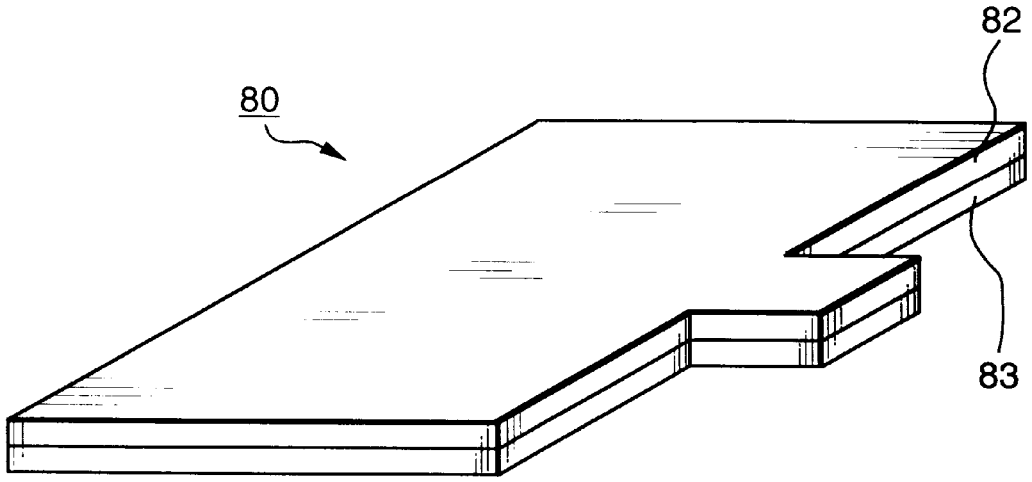
FIG. 17 is a view showing the arrangement of the ground plate.
Figure 18:
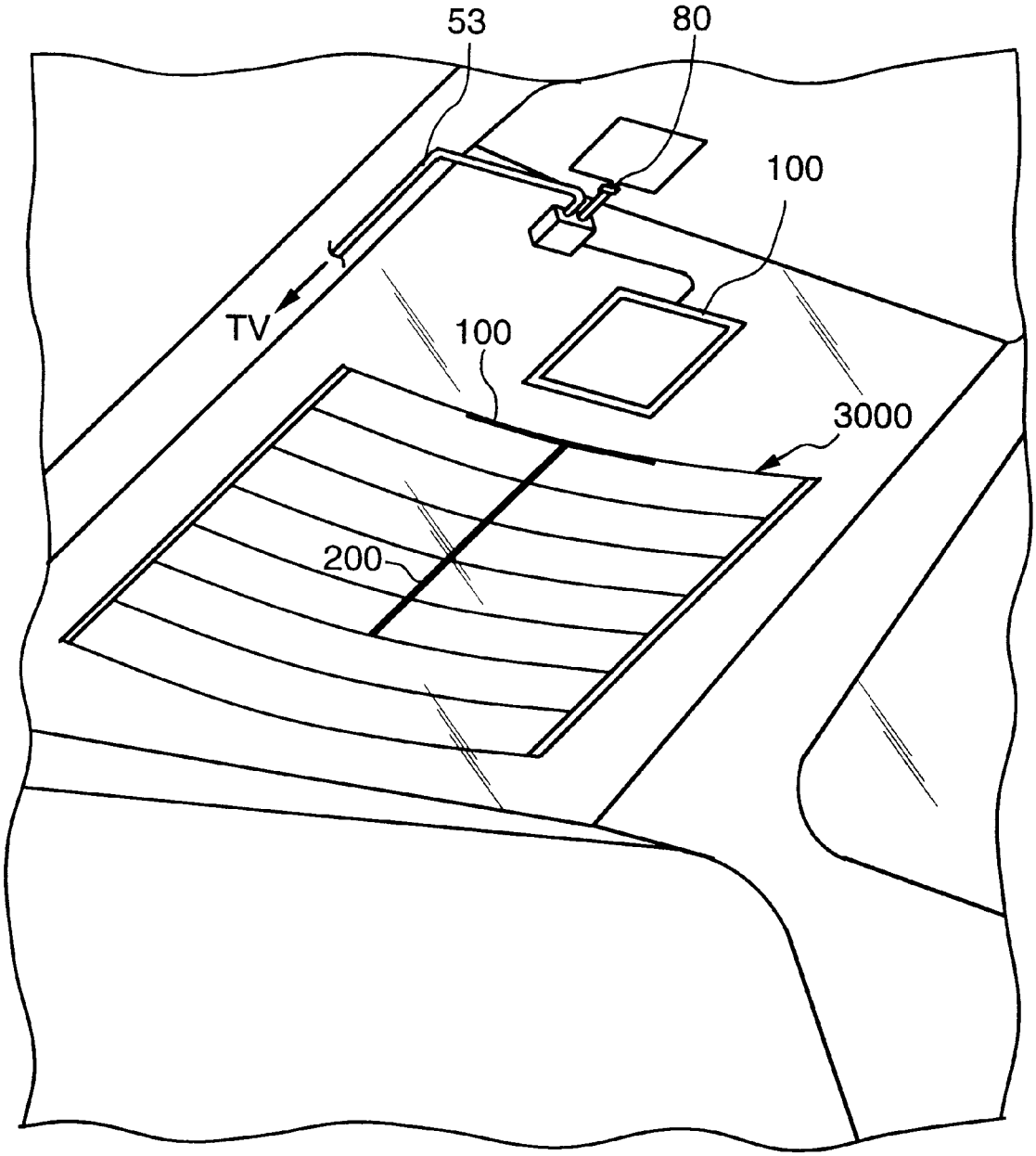
FIG. 18 is a view showing how to set the antenna of the first embodiment in the passenger's room of a vehicle.
Figure 19A:
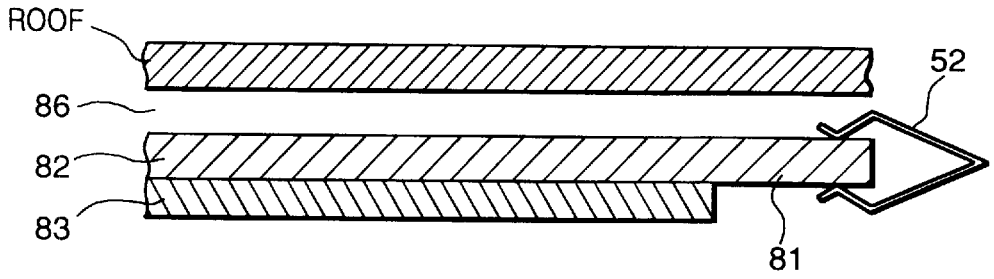
FIG. 19A is a view for explaining the capacitive connection state between the ground plate and the vehicle body.

FIG. 17 shows the arrangement of the ground plate 80. More specifically, the ground plate 80 consists of a magnet layer 83 and a conductive metal layer 82. When the ground plate 80 is inserted between the roof trim and the roof panel, as shown in FIG. 19A, and the clip 52 is connected to the tongue 81, the ground plate 80 contacts the metal of the roof. Since a gap 86 (air layer or paint layer) is present between the metal layer 82 of the ground plate 80 and the metal of the roof, the ground plate 80 and the vehicle body are capacitively coupled to each other. In this embodiment, the area of the ground plate 80 is set to have a coupling capacitance of 10 pF. This is because the capacitance of 10 pF allows the antenna elements 100 and 200 to exhibit practical sensitivity in the FM radio wave frequency band.

Figure 19B:
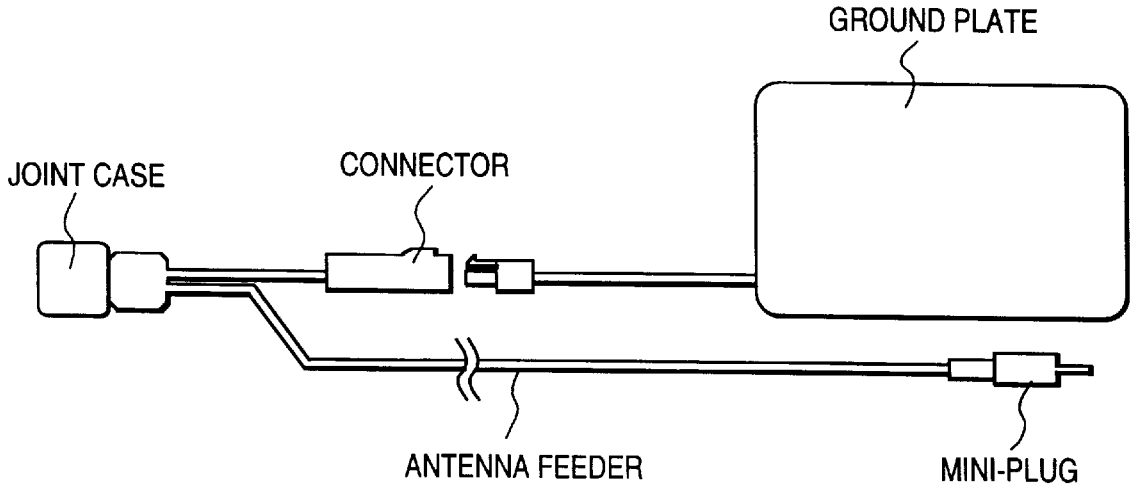
FIG. 19B is a view showing another example of a method of grounding the antenna.

FIG. 19B shows another arrangement of a grounding adapter.

More specifically, as shown in FIG. 19B, the ground plate is connected to a joint via a connector. This adapter allows easy and reliable attachment/detachment as compared to the adapter assembly shown in FIG. 16.

Operation of Glass Antenna of First Embodiment

It will be explained below with reference to FIG. 11A and FIGS. 20A to 20C that the glass antenna of the first embodiment (FIG. 11A or 14A) has characteristics as high as those of the directly-connected capacitive connection type antenna.

Figure 20A:
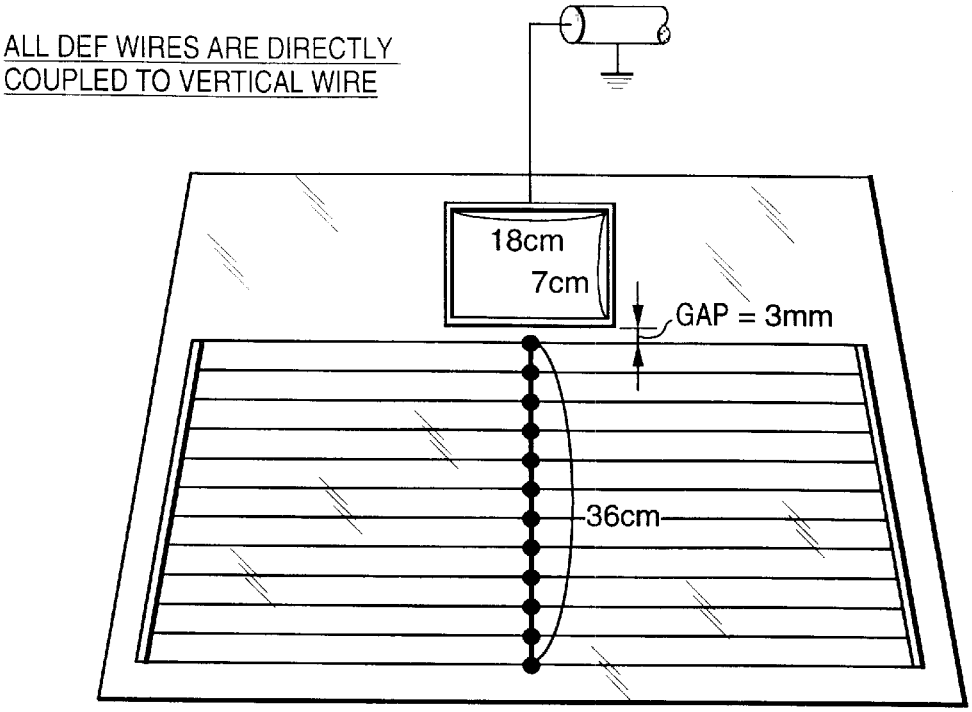
FIG. 20A is a view showing the arrangement of a directly-connected capacitive connection type antenna as a prototype of the glass antenna of the first embodiment.
Figure 20B:
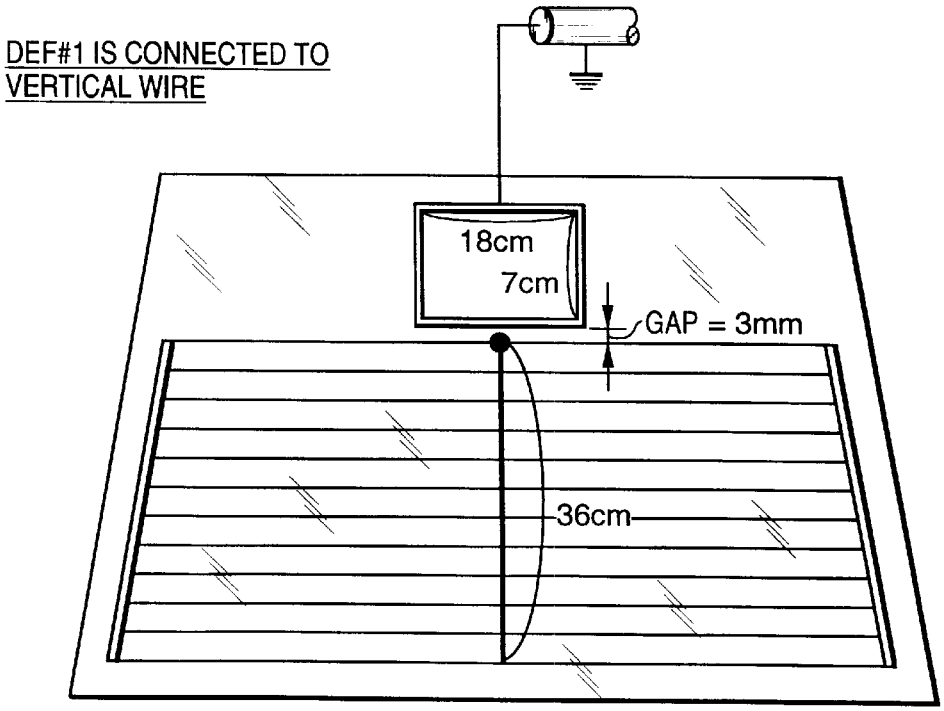
FIG. 20B is a view showing the arrangement of a directly-connected capacitive connection type antenna substantially equivalent to the capacitive connection type antenna shown in FIG. 20A.
Figure 20C:
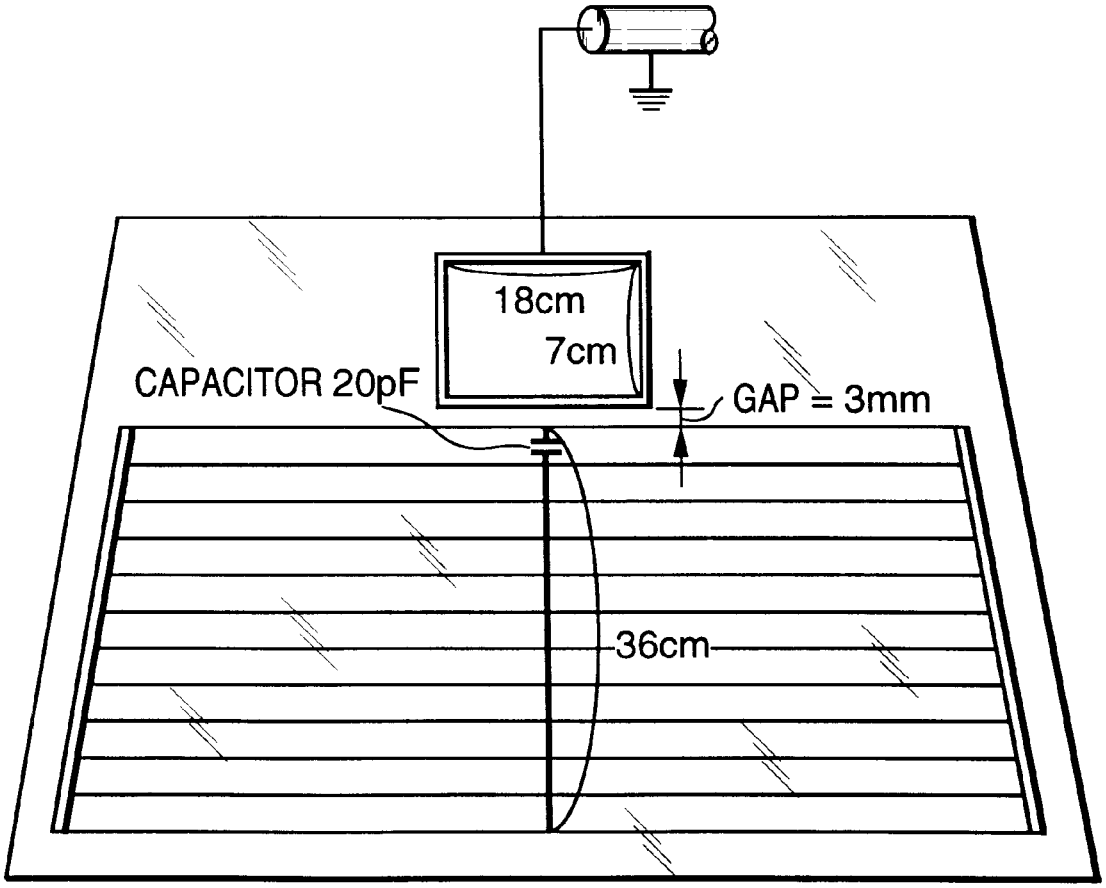
FIG. 20C is a view showing the arrangement of a glass antenna when a capacitor is used in place of a horizontal wire of the second antenna element of the glass antenna of the first embodiment.

A glass antenna shown in each of FIGS. 20A to 20C has a rectangular first antenna element and a rod-shaped second antenna element. In the glass antenna shown in each of FIGS. 20A to 20C, the first antenna element has a 18 cm×7 cm rectangular shape, and the second antenna element has a length of 36 cm for the purpose of comparison with the sticker type capacitively coupled antenna shown in FIG. 11A.

The first antenna element (rectangular loop antenna element) of the glass antenna in each of FIGS. 20A to 20C is not connected to the defogger heating wire in DC term. However, since the bottom conductor of the first antenna element extends parallel to the uppermost heating wire of the defogger, they are AC-coupled. In particular, since the second antenna element shown in FIG. 20A is connected to the heating wires in DC term at intersections with the defogger heating wires, the glass antenna shown in FIG. 20A is a typical example of the directly-connected capacitive connection type antenna. On the other hand, the glass antenna shown in FIG. 20B serves as a directly-connected capacitive connection type antenna in terms of its nature since a portion of the second antenna element is connected in DC term to the uppermost defogger heating wire.

The second antenna element of the glass antenna in FIG. 20C is connected to none of the defogger heating wires in DC term. However, the second antenna element and the defogger heating wires are connected via an additional capacitor (about 20 pF). More specifically, the second antenna element in FIG. 20C is AC-coupled to the defogger heating wires at about 20 pF.

If the conductor 200*h* of the antenna element 200 is coupled to the defogger heating wire 3000*t* in AC term in the glass antenna of the first embodiment shown in FIG. 11A, the glass antenna of the first embodiment is equivalent to that shown in FIG. 20C. On the other hand, since the glass antenna shown in FIG. 20B is nearly equivalent to that shown in FIG. 20C, and is also approximately equivalent to that shown in FIG. 20A (directly-connected capacitive connection type antenna), the sticker type capacitively coupled antenna shown in FIG. 11A is approximately equivalent to the directly-connected capacitive connection type antenna shown in FIG. 20A.

Figures 21A, 21B:
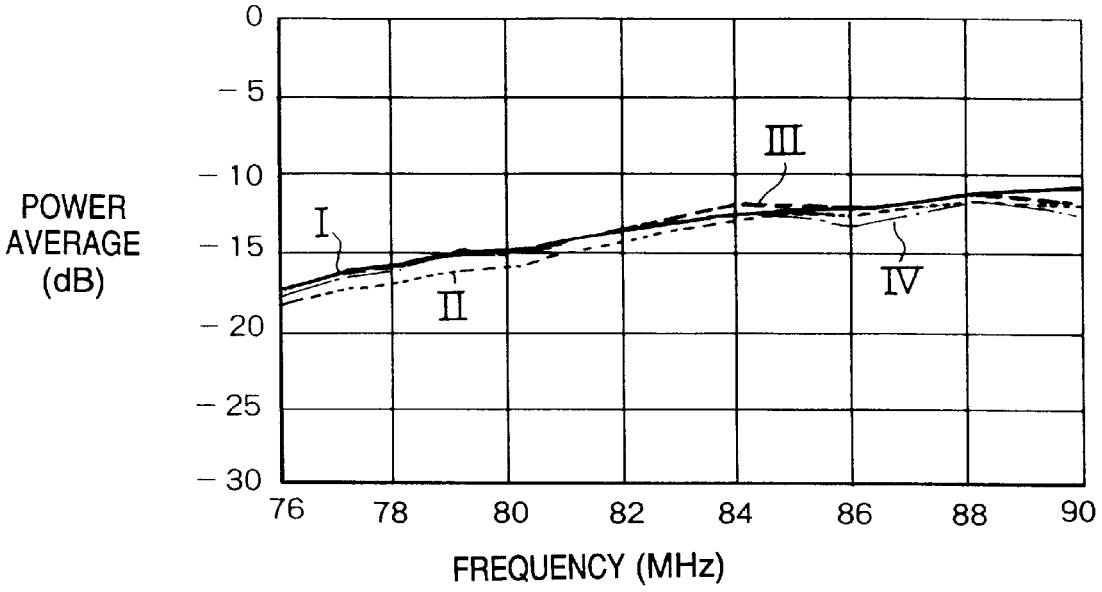
FIG. 21A is a graph that compares the reception characteristics of the glass antenna of the first embodiment, and the glass antennas shown in FIGS. 20A, 20B, and 20C.
FIG. 21B is a table that compares the reception characteristics of the glass antenna of the first embodiment, and the glass antennas shown in FIGS. 20A, 20B, and 20C.

FIGS. 21A and 21B show the comparison results of the performance (reception sensitivity) of the glass antennas shown in FIG. 11A and FIGS. 20A to 20C within the range from 76 MHz to 90 MHz. FIG. 21B shows the average reception sensitivity values within the above-mentioned range. More specifically, in FIG. 21A, bold solid curve I represents the reception sensitivity characteristics of the directly-connected capacitive connection type antenna shown in FIG. 20A within the range from 76 MHz to 90 MHz, and this antenna has reception sensitivity of −13.1 dB within this range. Broken curve II represents the reception sensitivity characteristics of the glass antenna shown in FIG. 20B, in which the second antenna element is DC-coupled to the uppermost heating wire alone of the defogger, and the average reception sensitivity within this range is −13.9 dB. Broken curve III represents the reception sensitivity characteristics of the glass antenna shown in FIG. 11A, in which both the first and second antenna elements are adhered to the glass by an adhesive and are AC-coupled to the defogger heating wire, and the average reception sensitivity within the above range in FIG. 21B is −13.3 dB. Furthermore, chain curve IV represents the reception sensitivity characteristics of the glass antenna shown in FIG. 20C, in which the second antenna element is coupled to the uppermost heating wire of the defogger via the capacitor (20 pF), and the average reception sensitivity within this range is −13.7 dB.

As can be seen from FIGS. 21A and 21B, the sticker type capacitively coupled antenna shown in FIG. 11A has the same characteristics as those of the capacitive connection type antennas shown in FIGS. 20A to 20C within the range from 76 MHz to 90 MHz. More specifically, the sticker type capacitively coupled antenna of the first embodiment allows the user to additionally set it, i.e., easy handling, while exhibiting performance as high as that of the directly-connected capacitive connection type antenna.

The capacity of the capacitor is set at 10 pF or more and, preferably, 20 pF or more.

The influence of the attachment position of the first antenna element on the antenna performance will be examined.

Diversity System

The influence of the attachment position of the first antenna element 100 of the first embodiment on the antenna performance will be explained below.

Figure 22:
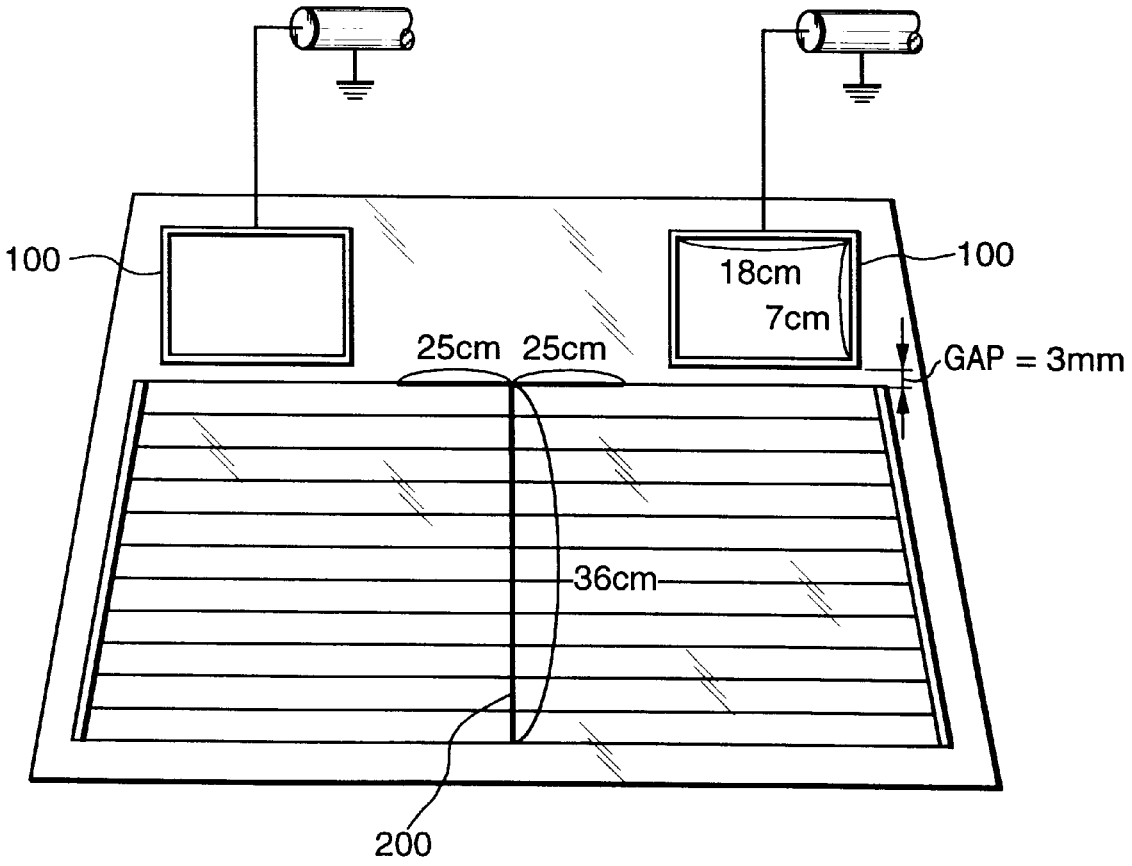
FIG. 22 is a view showing the case wherein the position of the first antenna element of the glass antenna of the first embodiment is changed.

In FIG. 22, the first antenna element 100 can be set at a position offset to the right or left by 25 cm from the central position of the defogger. Alternatively, two antenna elements 100 may be set on both sides. In the latter case, they constitute a diversity system.

Figures 23A, 23B:
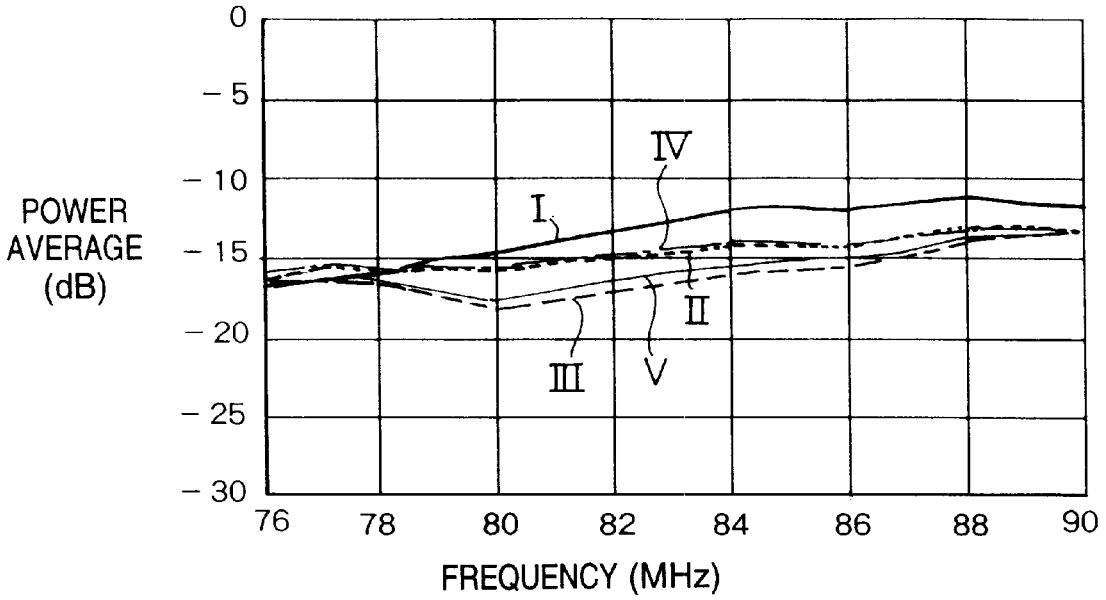
FIG. 23A is a graph showing the reception characteristics obtained when the position of the first antenna element 100 of the glass antenna of the first embodiment is changed variously.
FIG. 23B is a table showing the reception characteristics obtained when the position of the first antenna element 100 of the glass antenna of the first embodiment is changed variously.
Figure 23C:
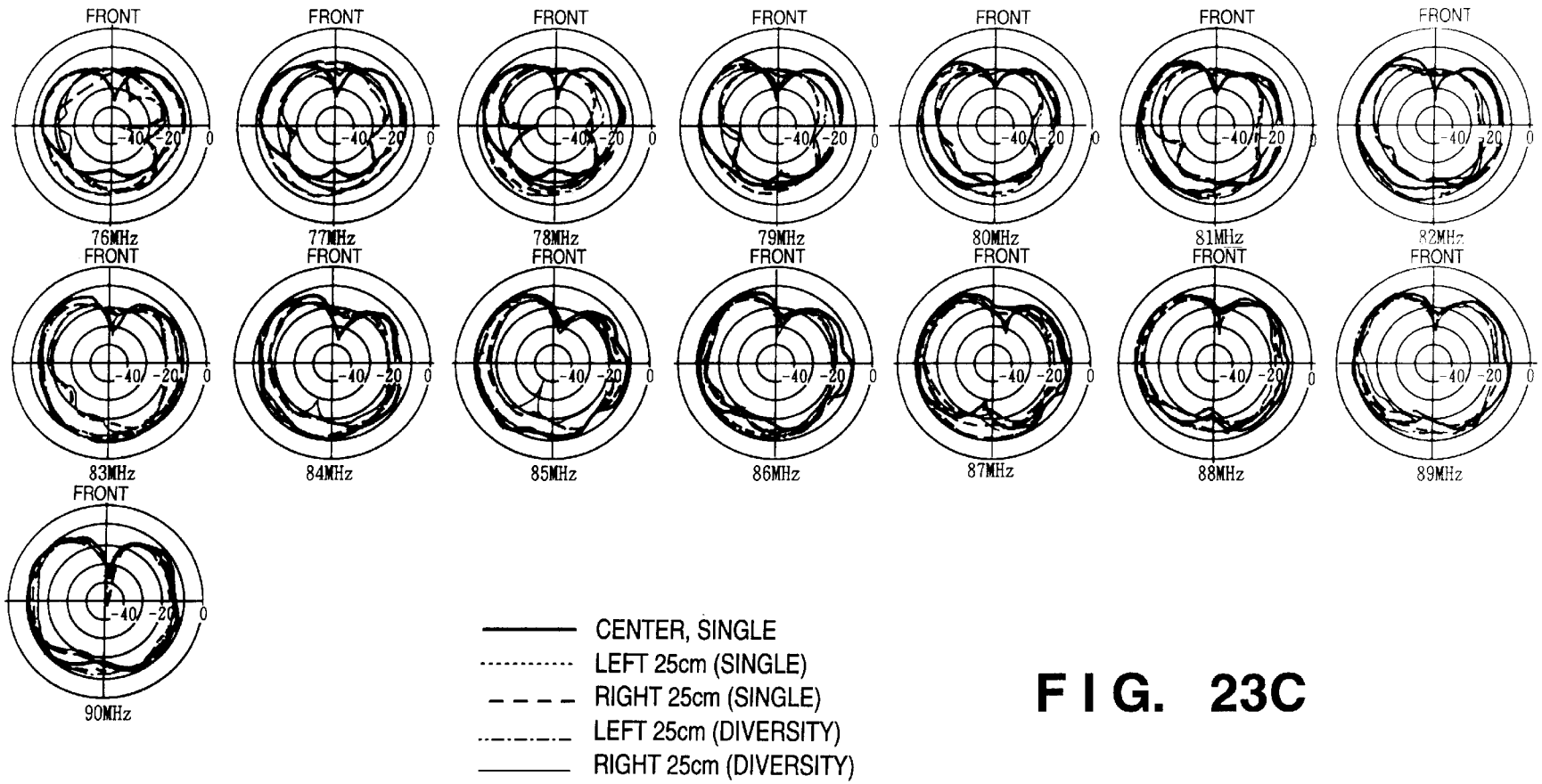
FIG. 23C shows charts of the directivity characteristics obtained when the position of the first antenna element 100 of the glass antenna of the first embodiment is changed variously.

FIGS. 23A to 23C show changes in reception performance when the position of the first antenna element is moved to various positions in the glass antenna of the first embodiment (sticker type capacitively coupled antenna).

Bold solid curve I in FIG. 23A represents the reception performance within the frequency range from 76 MHz to 90 MHz when a single first antenna element 100 is arranged at the central position as in FIG. 11A. The average reception sensitivity of the glass antenna represented by bold solid curve I is −13.3 dB, as shown in FIG. 23B. Solid curves in FIG. 23C represent the directivity characteristics of the antenna within the frequency range from 76 MHz to 90 MHz.

Broken curve II in FIG. 23A represents the reception performance within the frequency range from 76 MHz to 90 MHz when a single first antenna element 100 is arranged by offsetting it to the left by 25 cm, as shown in FIG. 22. The average reception sensitivity of the glass antenna represented by broken curve II is −14.5 dB, as shown in FIG. 23B. Broken curves II in FIG. 23C represent the directivity characteristics of the antenna within the frequency range from 76 MHz to 90 MHz.

Broken curve III in FIG. 23A represents the reception performance within the frequency range from 76 MHz to 90 MHz when a single first antenna element 100 is arranged by offsetting it to the right by 25 cm, as shown in FIG. 22. The average reception sensitivity of the glass antenna represented by broken curve III is −15.9 dB, as shown in FIG. 23B. Broken curves III in FIG. 23C represent the directivity characteristics of the antenna within the frequency range from 76 MHz to 90 MHz.

Chain curve IV in FIG. 23A represents the reception performance within the frequency range from 76 MHz to 90 MHz in a diversity antenna system arranged by offsetting the two first antenna elements 100 from the center to the right and left by 25 cm, as shown in FIG. 22. The average reception sensitivity of the glass antenna represented by chain curve IV is −14.5 dB, as shown in FIG. 23B. Chain curves IV in FIG. 23C represent the directivity characteristics of the antenna within the frequency range from 76 MHz to 90 MHz.

Thin solid curve V in FIG. 23A represents the reception characteristics of the right first antenna element 100 within the frequency range from 76 MHz to 90 MHz in a diversity antenna system arranged by offsetting the two first antenna elements 100 from the center to the right and left by 25 cm, as shown in FIG. 22. The average reception sensitivity of the glass antenna represented by thin solid curve V is −15.5 dB, as show in FIG. 23B. Thin solid curves V in FIG. 23C represent the directivity characteristics of the antenna within the frequency range from 76 MHz to 90 MHz.

Figures 24A, 24B:
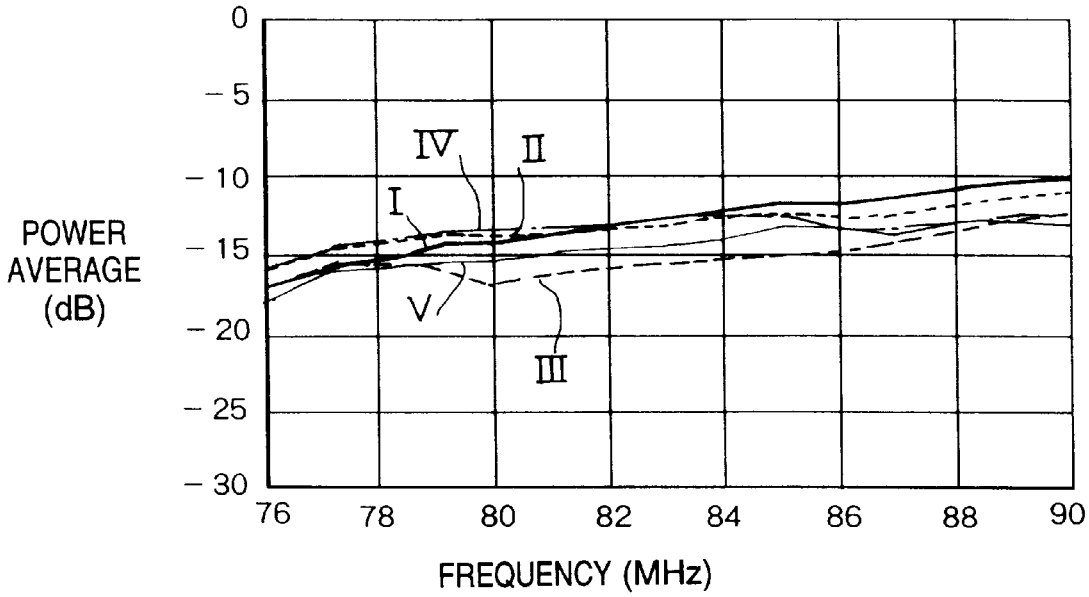
FIG. 24A is a graph showing the reception characteristics obtained when the position of the first antenna element of the glass antenna (directly-connected capacitive connection type antenna) shown in FIG. 20A is changed variously.
FIG. 24B is a table showing the reception characteristics obtained when the position of the first antenna element 100 of the glass antenna (directly-connected capacitive connection type antenna) shown in FIG. 20A is changed variously.
Figure 24C:
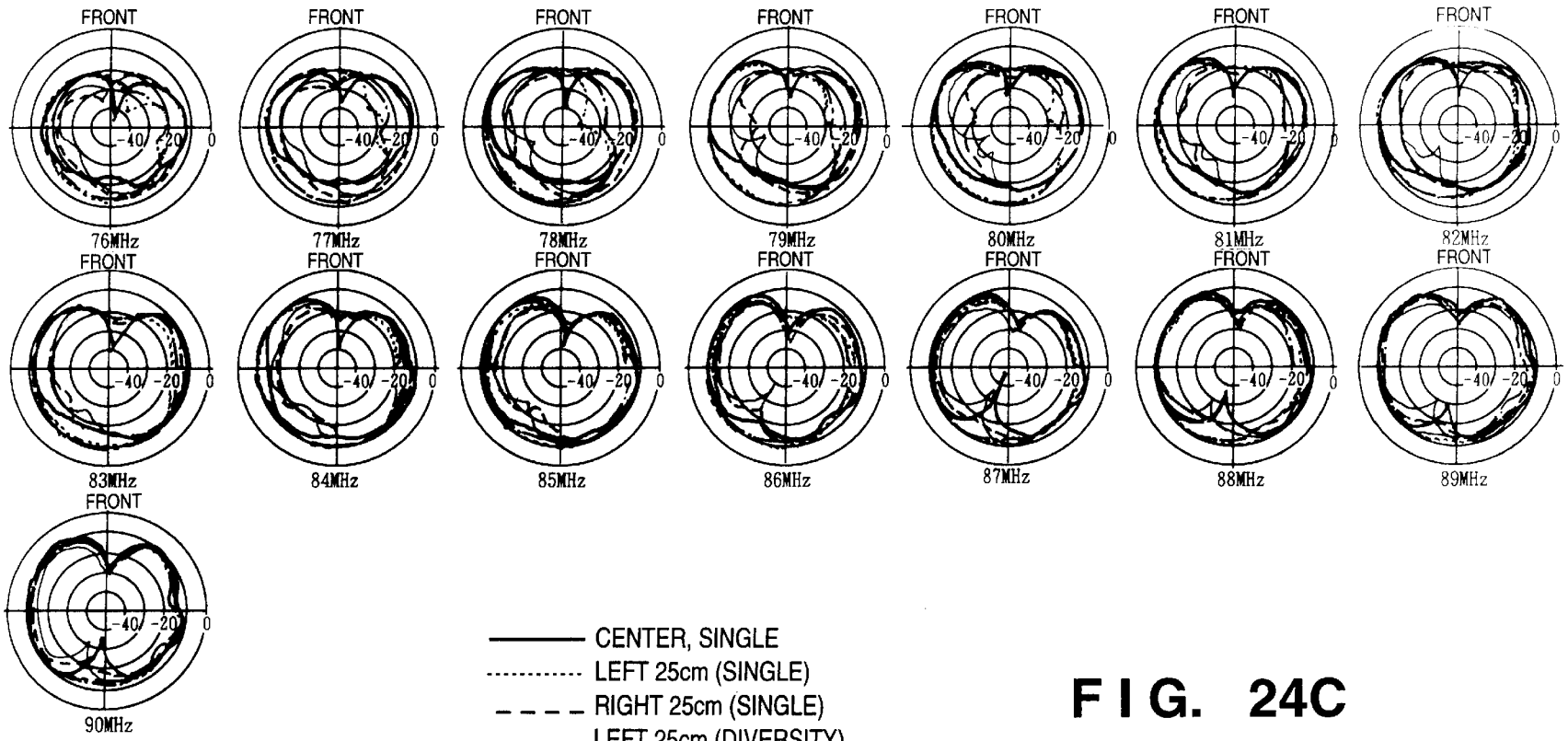
FIG. 24C shows charts of directivity characteristics obtained when the position of the first antenna element 100 of the glass antenna (directly-connected capacitive connection type antenna) shown in FIG. 20A is changed variously.

FIGS. 24A to 24C show changes in reception characteristics of the directly-connected capacitive connection type antenna (FIG. 20A) obtained when the first antenna element 100 is moved to various positions, as in FIGS. 23A to 23C.

Figures 25A, 25B:
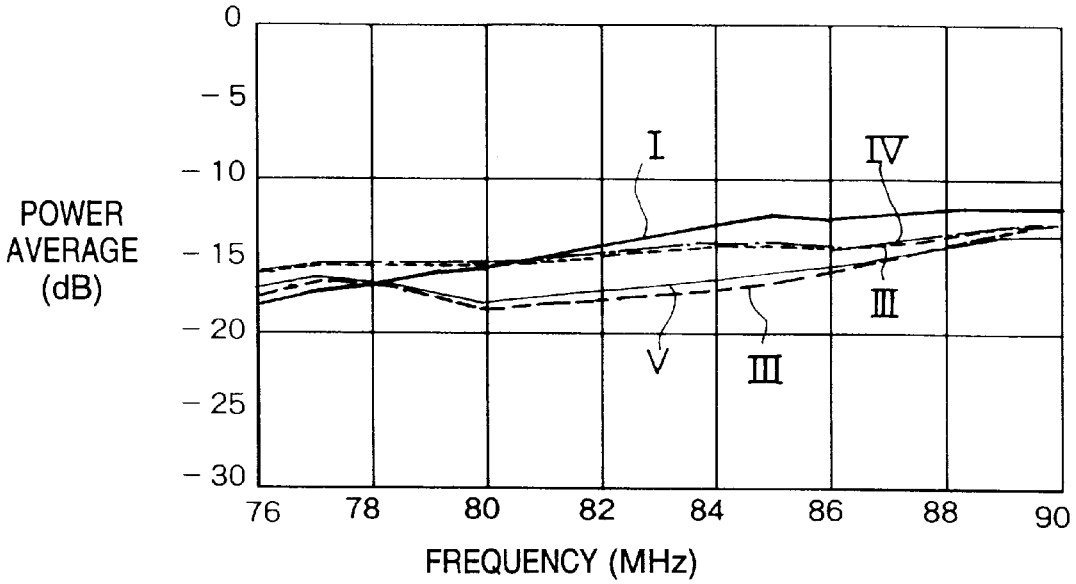
FIG. 25A is a graph showing the reception characteristics obtained when the position of the first antenna element of the glass antenna (directly-connected capacitive connection type antenna) shown in FIG. 20B is changed variously.
FIG. 25B is a table showing the reception characteristics obtained when the position of the first antenna element 100 of the glass antenna (directly-connected capacitive connection type antenna) shown in FIG. 20B is changed variously.
Figure 25C:
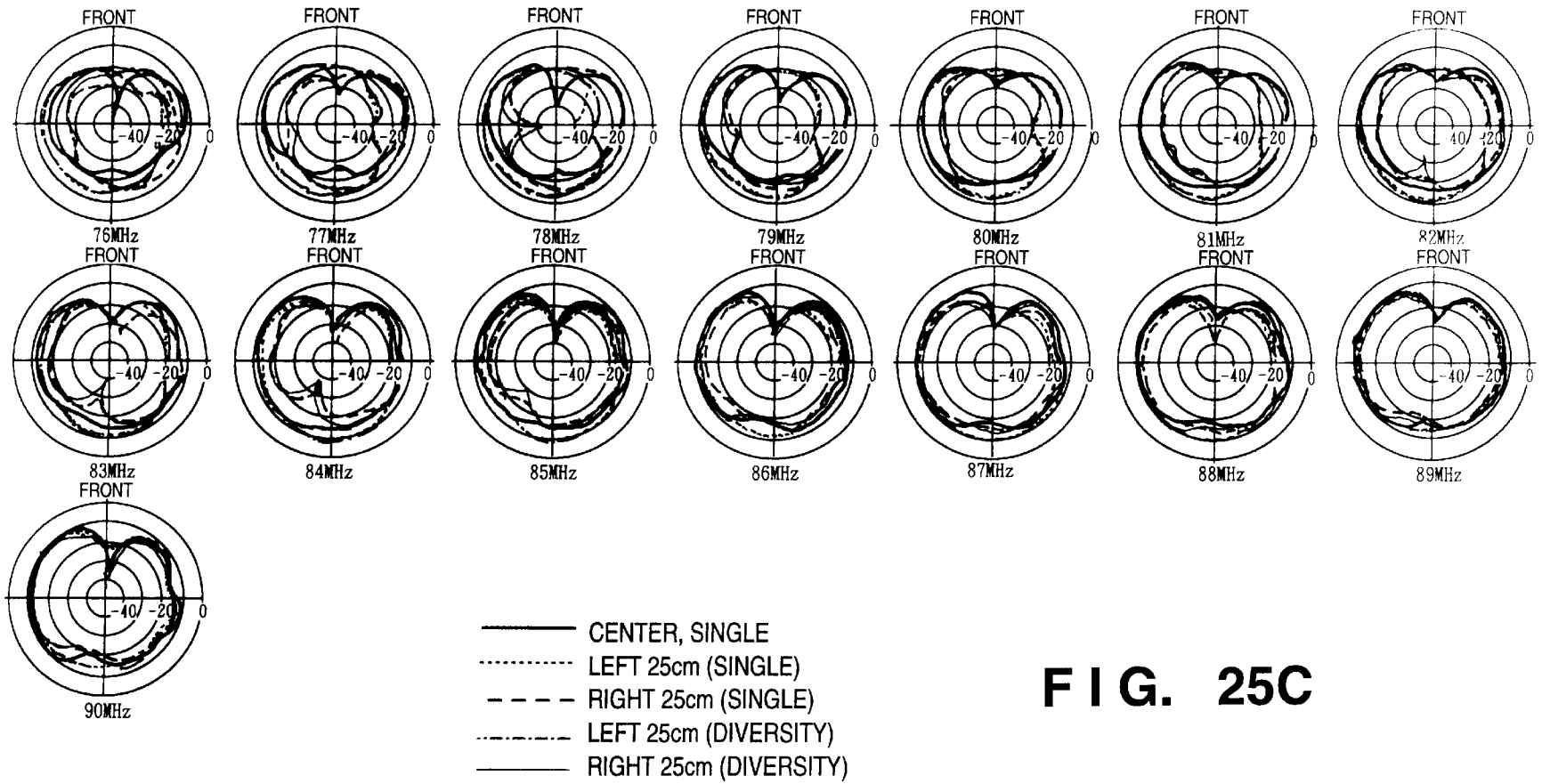
FIG. 25C shows charts of directivity characteristics obtained when the position of the first antenna element 100 of the glass antenna (directly-connected capacitive connection type antenna) shown in FIG. 20B is changed variously.

FIGS. 25A to 25C show changes in reception characteristics of the directly-connected capacitive connection type antenna (FIG. 20B), which is directly connected to one heating wire of the defogger, obtained when the first antenna element 100 is moved to various positions, as in FIGS. 23A to 24C.

When the characteristics of the glass antenna of the first embodiment shown in FIGS. 23A to 23C are compared with those of the directly-connected capacitive connection type antenna shown in FIGS. 24A to 24C, and those of the capacitor (20 pF)-coupled glass antenna shown in FIGS. 25A to 25C, these glass antennas have similar characteristics. That is, the characteristics of the sticker type capacitively coupled antenna are nearly equivalent to those of the directly-connected capacitive connection type antenna.

Influence of Changes in Length of Second Antenna Element

Figure 26:
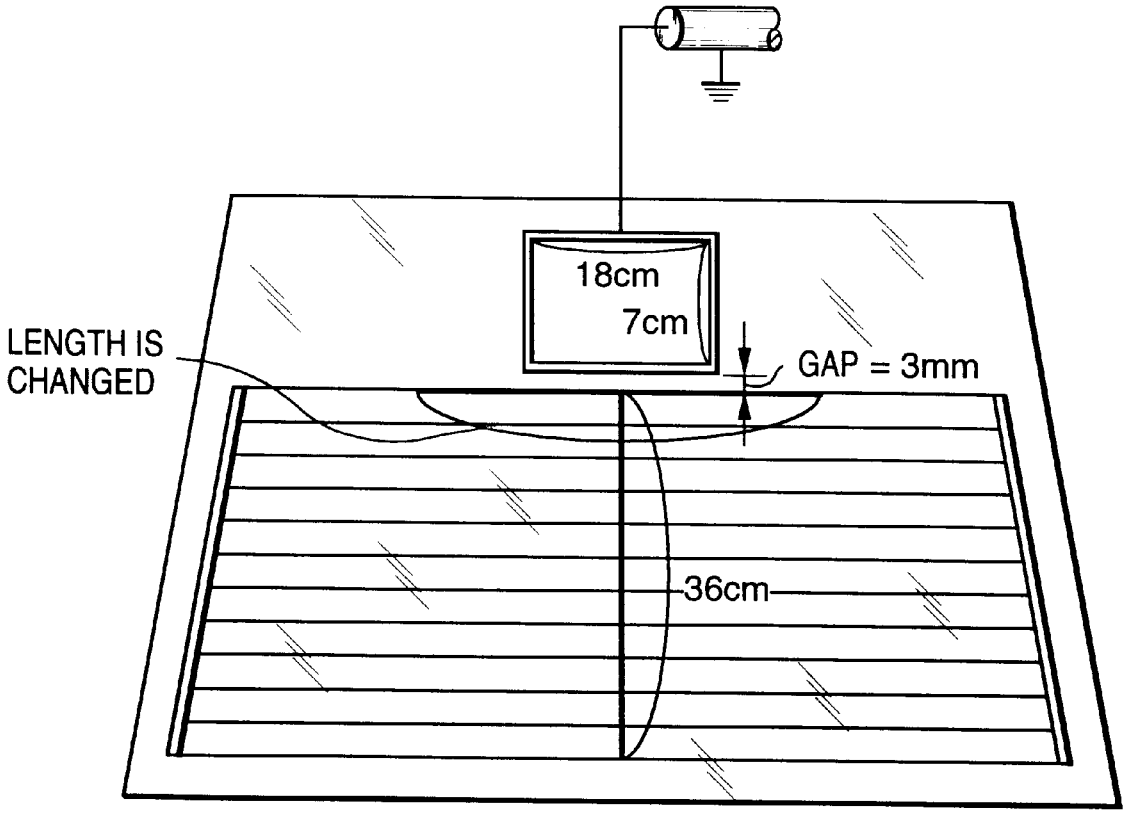
FIG. 26 is a view showing the state wherein the horizontal wire of the first antenna element in the glass antenna of the first embodiment (FIGS. 11A and 14A) is variously changed.

Changes in characteristics upon changing the length of the horizontal wire (conductor piece) 200*h* of the second antenna element 200 in the glass antenna of the first embodiment will be discussed below. FIGS. 27A to 30C show the results upon changing the length of the horizontal wire 200*h* variously, while the first antenna element 100 has a size of 18 cm×7 cm, and the length of the vertical wire (conductor piece) 200*v* of the second antenna element 200 is fixed at 36 cm, as shown in FIG. 26.

In particular, FIGS. 27A to 28C show changes in reception sensitivity obtained when the length of the horizontal wire 200*h* is variously changed upon receiving horizontally polarized waves within the frequency range from 76 MHz to 90 MHz.

Figures 27A, 27B:
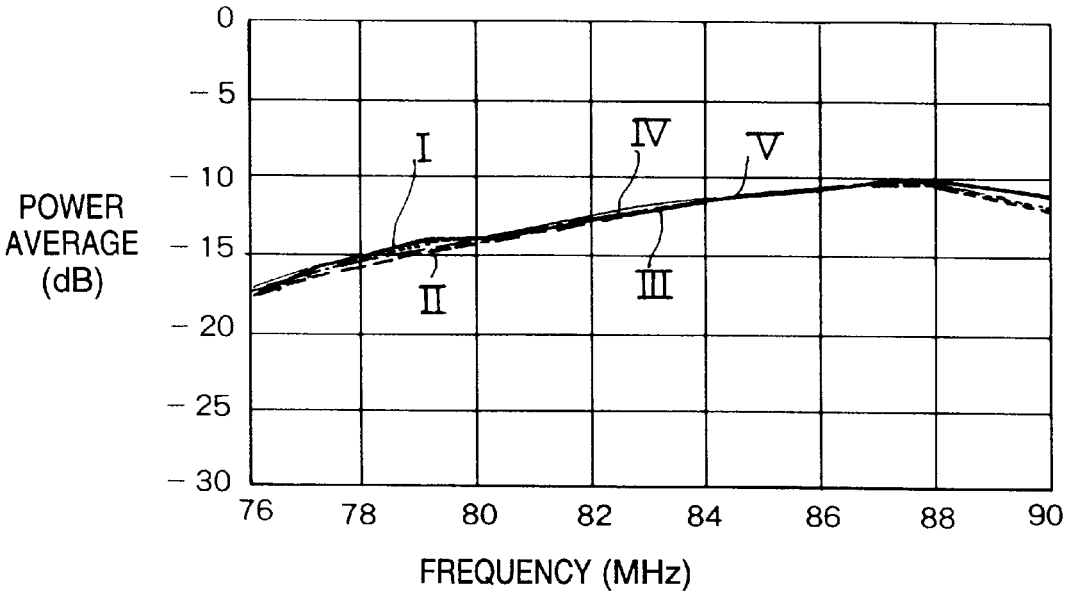
FIG. 27A is a graph showing changes in reception characteristics within the reception radio wave range from 76 MHz to 90 MHz when the length of the horizontal wire of the second antenna element is variously changed (80 cm, 70 cm, 60 cm, 50 cm, 40 cm) in the glass antenna of the first embodiment.
FIG. 27B is a table showing the average reception sensitivities within the reception radio wave range from 76 MHz to 90 MHz when the length of the horizontal wire of the second antenna element is variously changed (80 cm, 70 cm, 60 cm, 50 cm, 40 cm) in the glass antenna of the first embodiment.
Figure 27C:
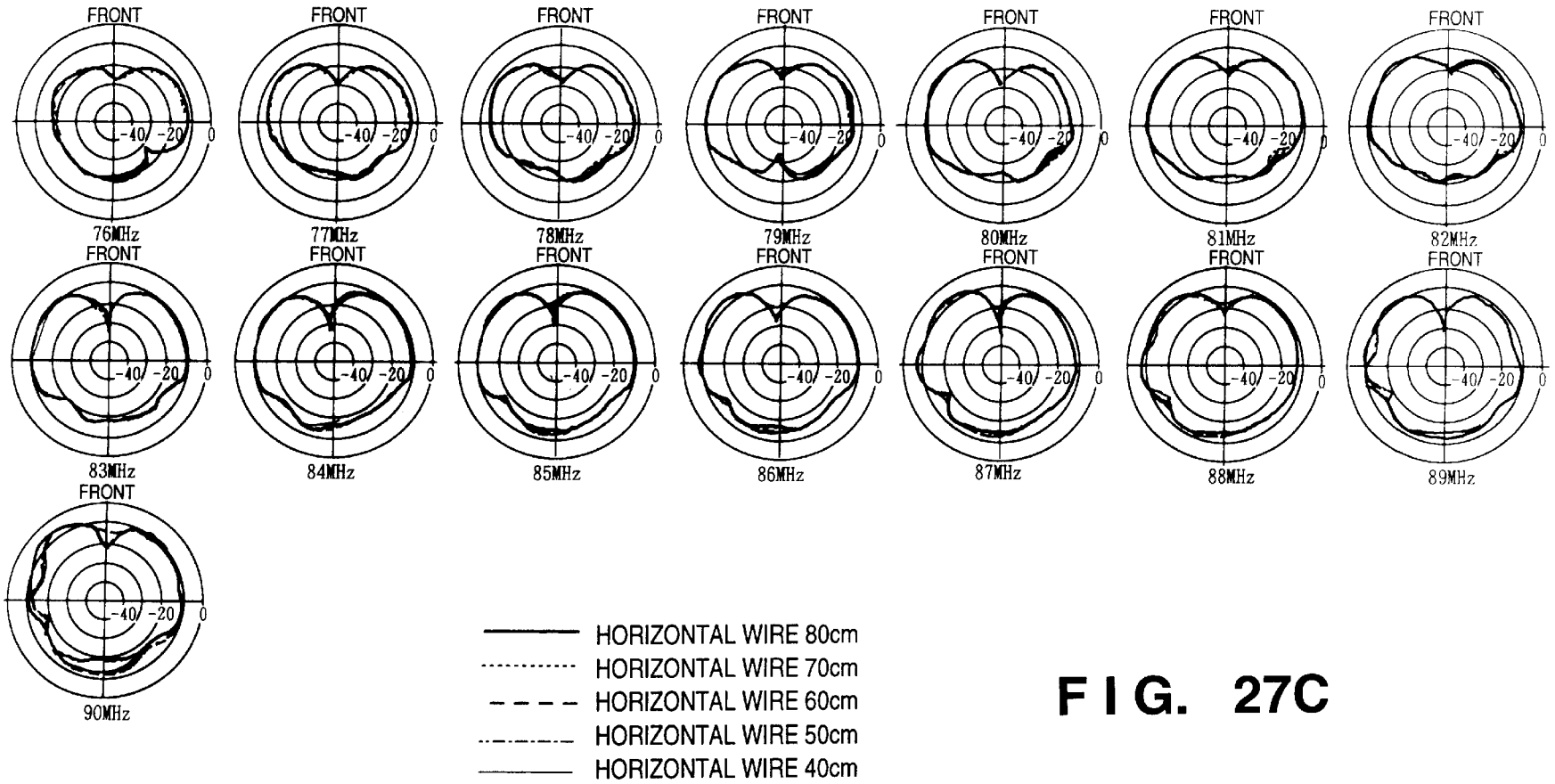
FIG. 27C shows changes in directivity characteristics within the reception radio wave range from 76 MHz to 90 MHz when the length of the horizontal wire of the second antenna element is variously changed (80 cm, 70 cm, 60 cm, 50 cm, 40 cm) in the glass antenna of the first embodiment.

In FIGS. 27A to 27C, bold solid curve I represents the reception sensitivity and directivity characteristics when the horizontal wire 200*h*=80 cm;

broken curve II represents the reception sensitivity and directivity characteristics when the horizontal wire 200*h*=70 cm;

broken curve III represents the reception sensitivity and directivity characteristics when the horizontal wire 200*h*=60 cm;

chain curve IV represents the reception sensitivity and directivity characteristics when the horizontal wire 200*h*=50 cm; and thin solid curve V represents the reception sensitivity and directivity characteristics when the horizontal wire 200*h*=40 cm. When radio waves within the frequency range from 76 MHz to 90 MHz are to be received, practically sufficient reception sensitivity and directivity characteristics are obtained when the length of the horizontal wire 200*h* falls within the range from 80 cm to 40 cm.

Figures 28A, 28B:
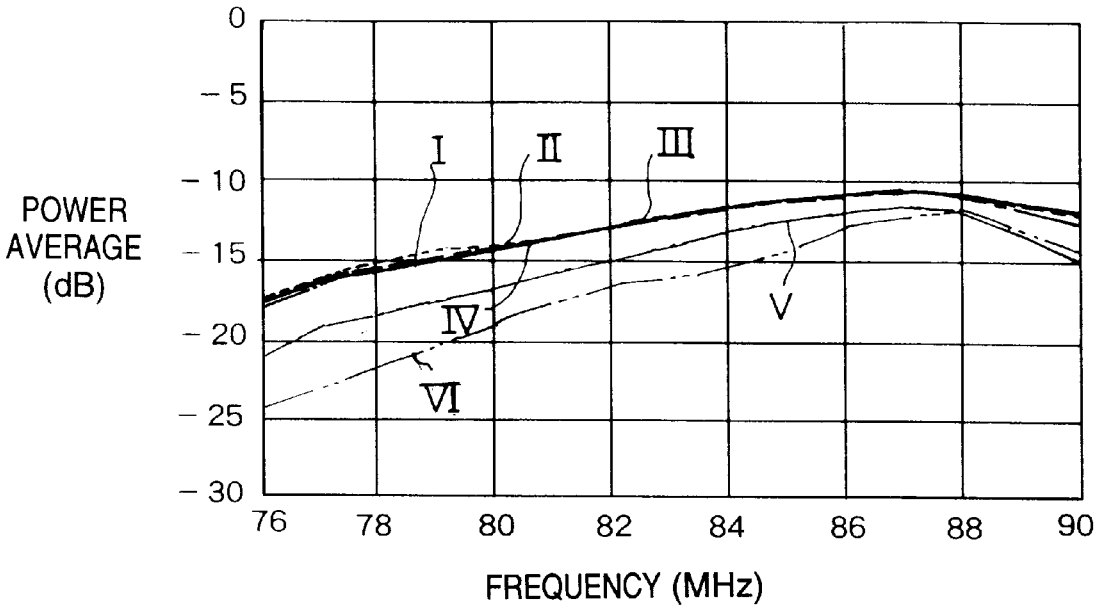
FIG. 28A is a graph showing changes in reception characteristics within the reception radio wave range from 76 MHz to 90 MHz when the length of the horizontal wire of the second antenna element is variously changed (30 cm, 20 cm, 10 cm, 5 cm, 2 cm, 0 cm) in the glass antenna of the first embodiment.
FIG. 28B is a table showing the average reception sensitivities within the reception radio wave range from 76 MHz to 90 MHz when the length of the horizontal wire of the second antenna element is variously changed (30 cm, 20 cm, 10 cm, 5 cm, 2 cm, 0 cm) in the glass antenna of the first embodiment.
Figure 28C:
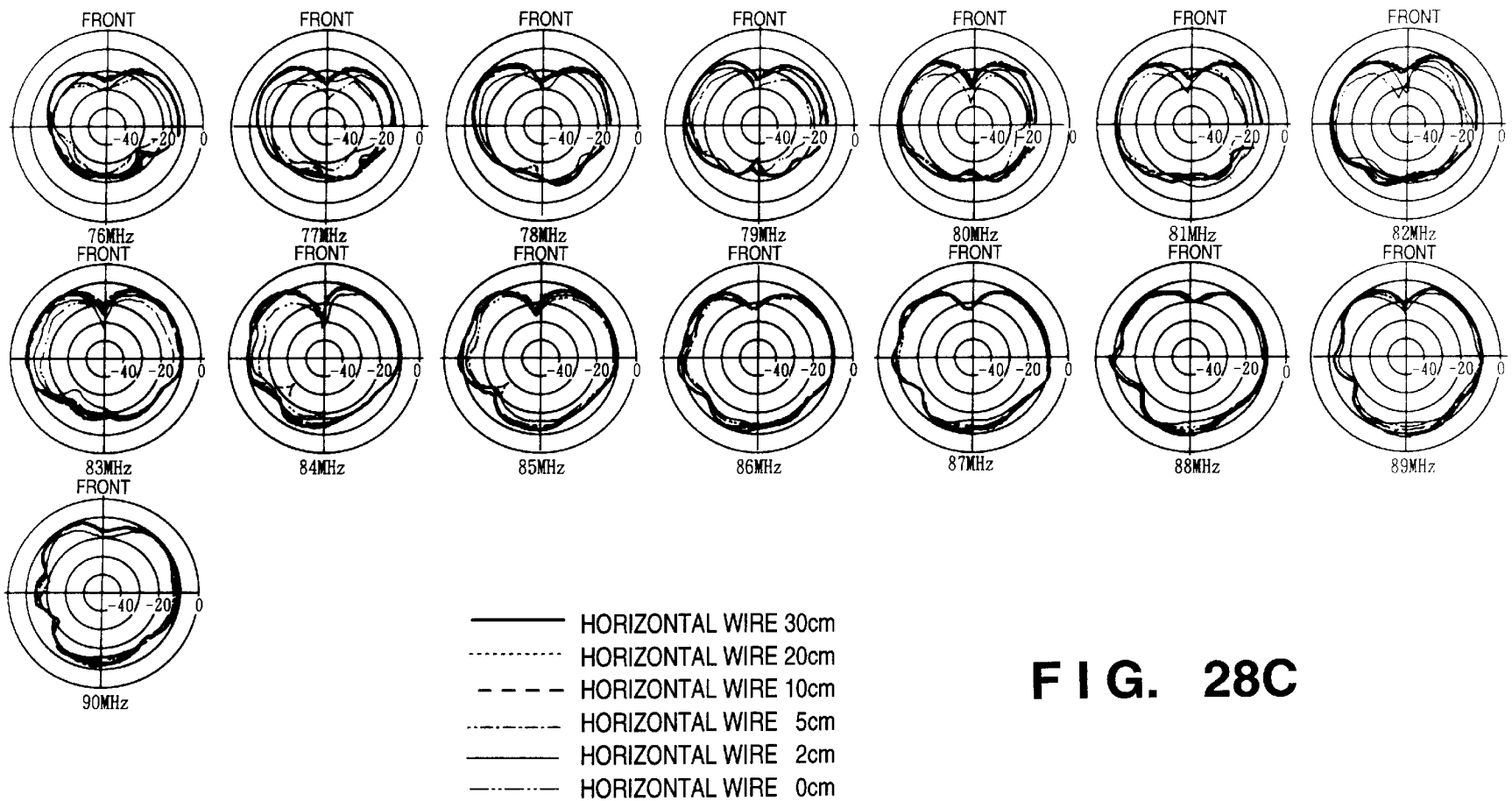
FIG. 28C shows changes in directivity characteristics within the reception radio wave range from 76 MHz to 90 MHz when the length of the horizontal wire of the second antenna element is variously changed (30 cm, 20 cm, 10 cm, 5 cm, 2 cm, 0 cm) in the glass antenna of the first embodiment.

In FIGS. 28A to 28C, bold solid curve I represents the reception sensitivity and directivity characteristics when the horizontal wire 200*h*=30 cm;

broken curve II represents the reception sensitivity and directivity characteristics when the horizontal wire 200*h*=20 cm;

broken curve III represents the reception sensitivity and directivity characteristics when the horizontal wire 200*h*=10 cm;

chain curve IV represents the reception sensitivity and directivity characteristics when the horizontal wire 200*h*=5 cm;

thin solid curve V represents the reception sensitivity and directivity characteristics when the horizontal wire 200*h*=2 cm; and chain double-dashed curve VI represents the reception sensitivity and directivity characteristics when the horizontal wire 200*h*=0 cm. When radio waves within the frequency range from 76 MHz to 90 MHz are to be received, practically sufficient reception sensitivity and directivity characteristics are obtained when the length of the horizontal wire 200*h* falls within the range from 30 cm to 5 cm.

FIGS. 29A to 30C show changes in reception sensitivity obtained when the length of the horizontal wire 200*h* is variously changed upon receiving horizontally polarized waves within the frequency range from 88 MHz to 110 MHz.

Figures 29A, 29B:
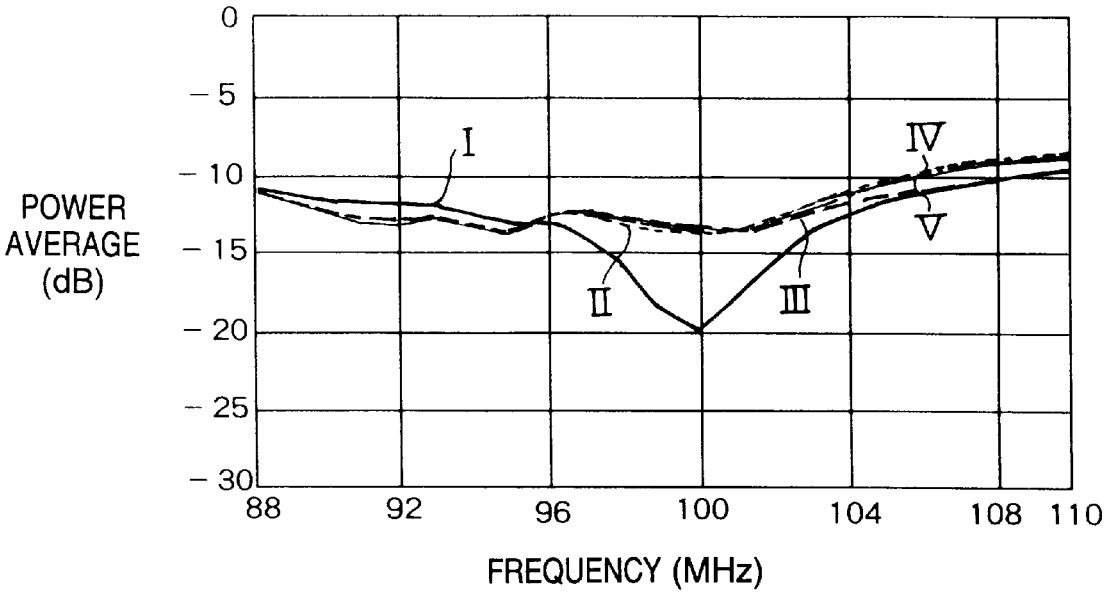
FIG. 29A is a graph showing changes in reception characteristics within the reception radio wave range from 88 MHz to 110 MHz when the length of the horizontal wire of the second antenna element is variously changed (80 cm, 70 cm, 60 cm, 50 cm, 40 cm) in the glass antenna of the first embodiment.
FIG. 29B is a table showing the average reception sensitivities within the reception radio wave range from 88 MHz to 110 MHz when the length of the horizontal wire of the second antenna element is variously changed (80 cm, 70 cm, 60 cm, 50 cm, 40 cm) in the glass antenna of the first embodiment.
Figure 29C:
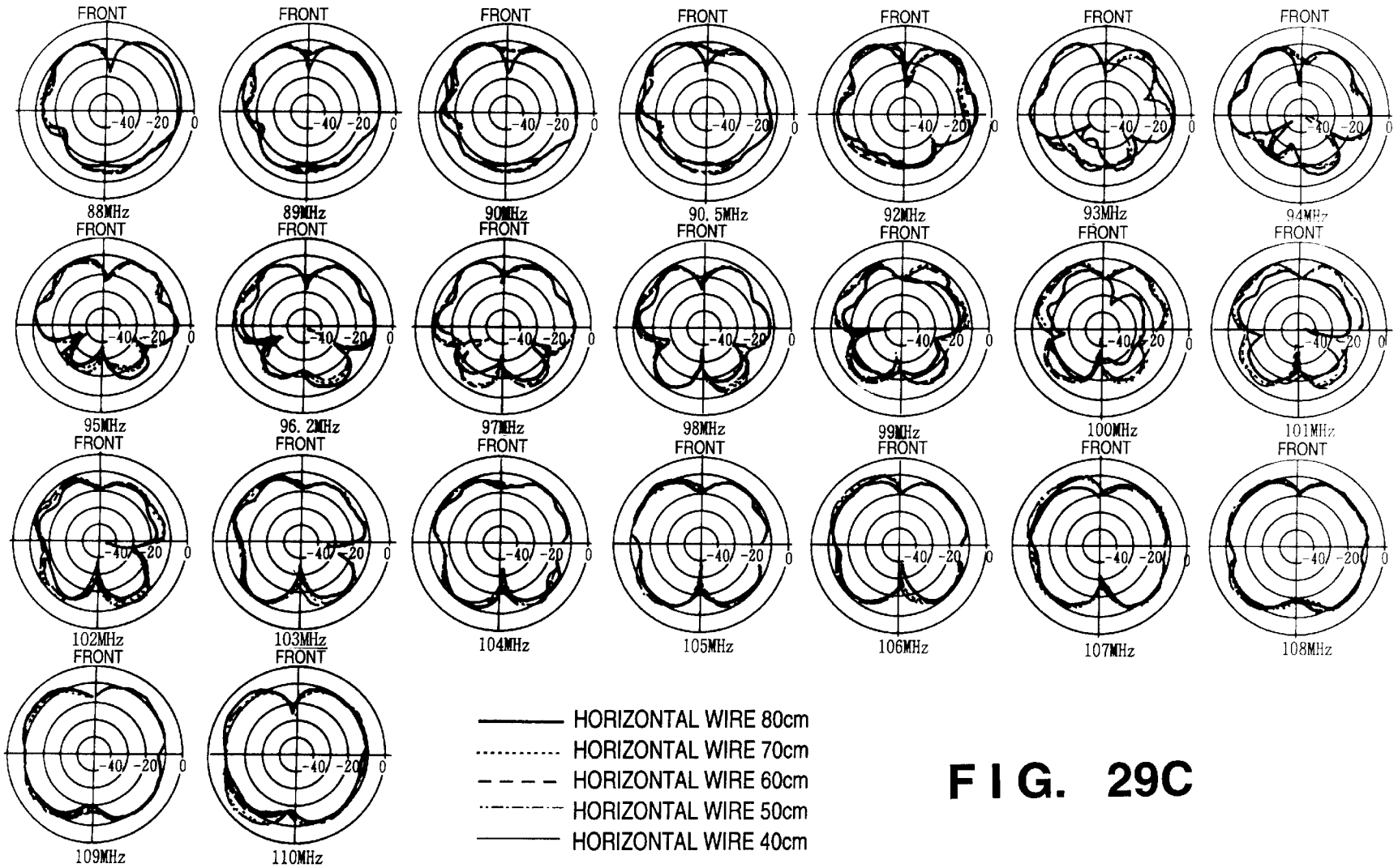
FIG. 29C shows changes in directivity characteristics within the reception radio wave range from 88 MHz to 110 MHz when the length of the horizontal wire of the second antenna element is variously changed (80 cm, 70 cm, 60 cm, 50 cm, 40 cm) in the glass antenna of the first embodiment.

In FIGS. 29A to 29C, bold solid curve I represents the reception sensitivity and directivity characteristics when the horizontal wire 200*h*=80 cm;

broken curve II represents the reception sensitivity and directivity characteristics when the horizontal wire 200*h*=70 cm;

broken curve III represents the reception sensitivity and directivity characteristics when the horizontal wire 200*h*=60 cm;

chain curve IV represents the reception sensitivity and directivity characteristics when the horizontal wire 200*h*=50 cm; and thin solid curve V represents the reception sensitivity and directivity characteristics when the horizontal wire 200*h*=40 cm. When radio waves within the frequency range from 88 MHz to 110 MHz are to be received, practically sufficient reception sensitivity and directivity characteristics are obtained when the length of the horizontal wire 200*h* falls within the range from 80 cm to 40 cm.

Figures 30A, 30B:
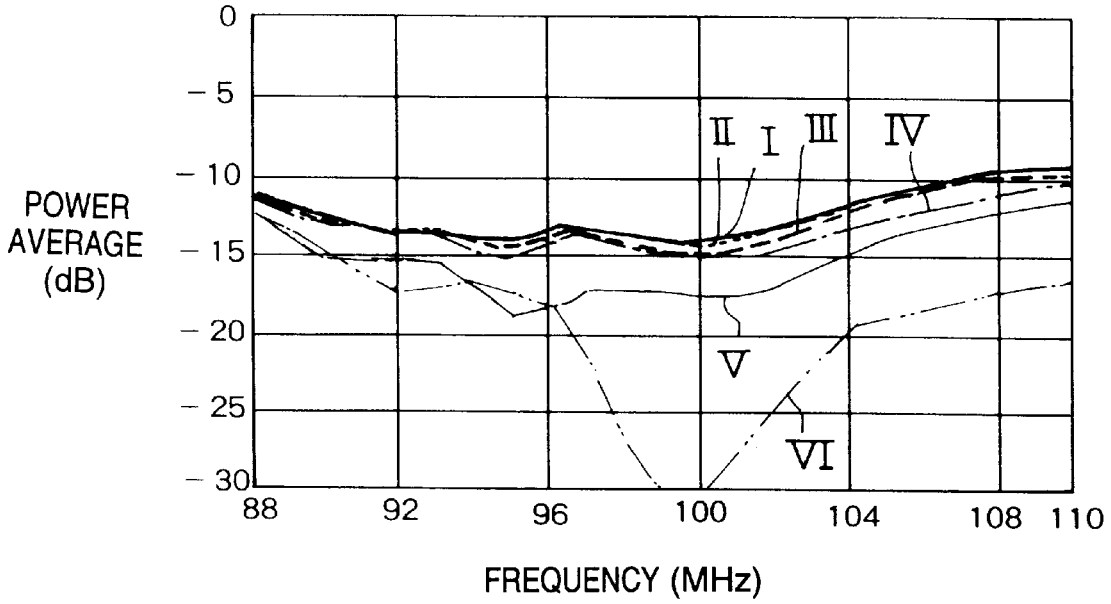
FIG. 30A is a graph showing changes in reception characteristics within the reception radio wave range from 88 MHz to 110 MHz when the length of the horizontal wire of the second antenna element is variously changed (30 cm, 20 cm, 10 cm, 5 cm, 2 cm, 0 cm) in the glass antenna of the first embodiment.
FIG. 30B is a table showing the average reception sensitivities within the reception radio wave range from 88 MHz to 110 MHz when the length of the horizontal wire of the second antenna element is variously changed (30 cm, 20 cm, 10 cm, 5 cm, 2 cm, 0 cm) in the glass antenna of the first embodiment.
Figure 30C:
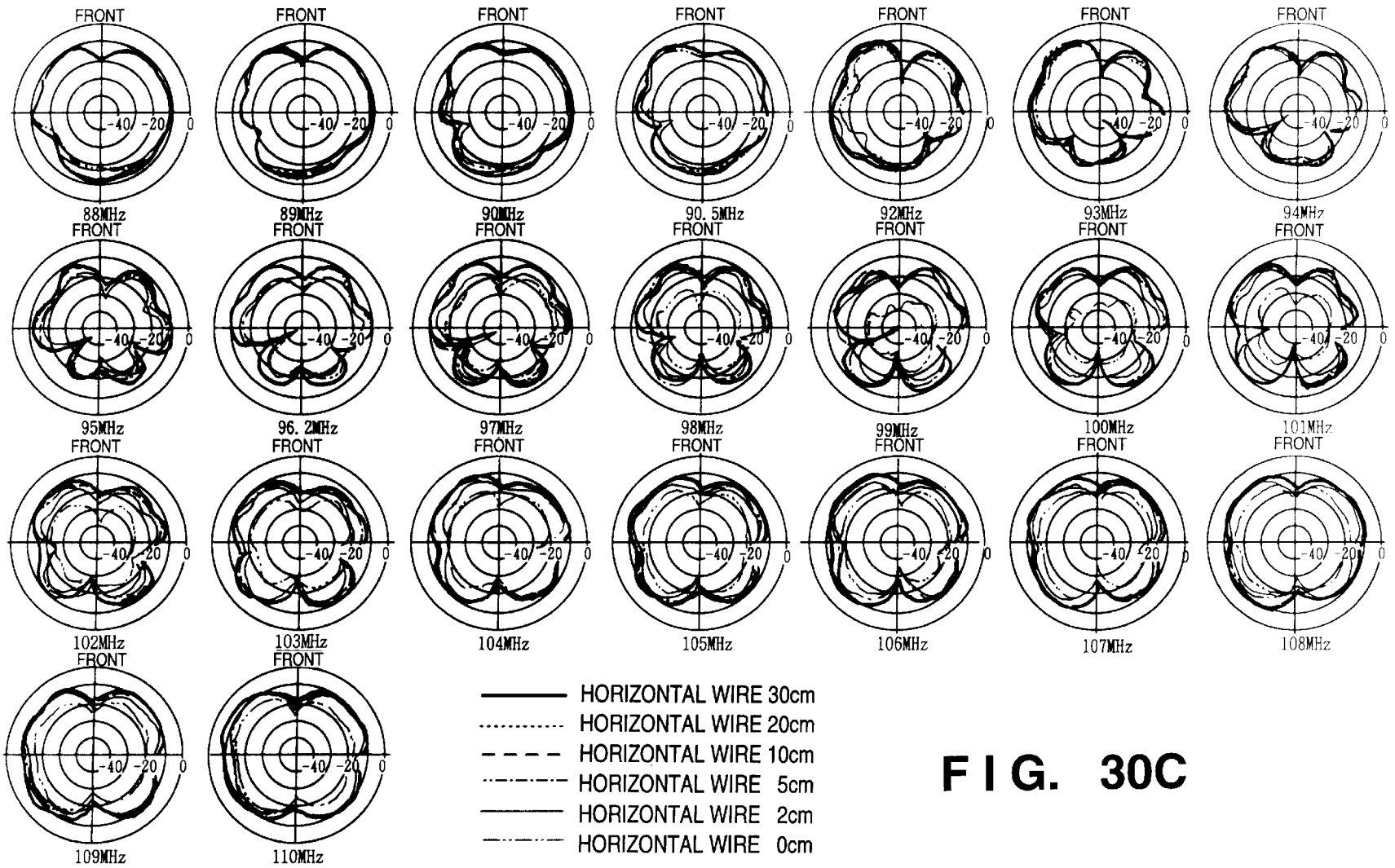
FIG. 30C shows changes in directivity characteristics within the reception radio wave range from 88 MHz to 110 MHz when the length of the horizontal wire of the second antenna element is variously changed (30 cm, 20 cm, 10 cm, 5 cm, 2 cm, 0 cm) in the glass antenna of the first embodiment.

In FIGS. 30A to 30C, bold solid curve I represents the reception sensitivity and directivity characteristics when the horizontal wire 200*h*=30 cm;

broken curve II represents the reception sensitivity and directivity characteristics when the horizontal wire 200*h*=20 cm;

broken curve III represents the reception sensitivity and directivity characteristics when the horizontal wire 200*h*=10 cm;

chain curve IV represents the reception sensitivity and directivity characteristics when the horizontal wire 200*h*=5 cm;

thin solid curve V represents the reception sensitivity and directivity characteristics when the horizontal wire 200*h*=2 cm; and chain double-dashed curve VI represents the reception sensitivity and directivity characteristics when the horizontal wire 200*h*=0 cm. When radio waves within the frequency range from 88 MHz to 110 MHz are to be received, practically sufficient reception sensitivity and directivity characteristics are obtained when the length of the horizontal wire 200*h* falls within the range from 30 cm to 5 cm.

In other words, the glass antenna of the first embodiment exhibits the same functions as those of the vertical wire (41 in FIG. 1) of the directly-connected capacitive connection type antenna if the horizontal wire 200*h* has a length of 5 cm or more.

Second Embodiment

Figure 31A:
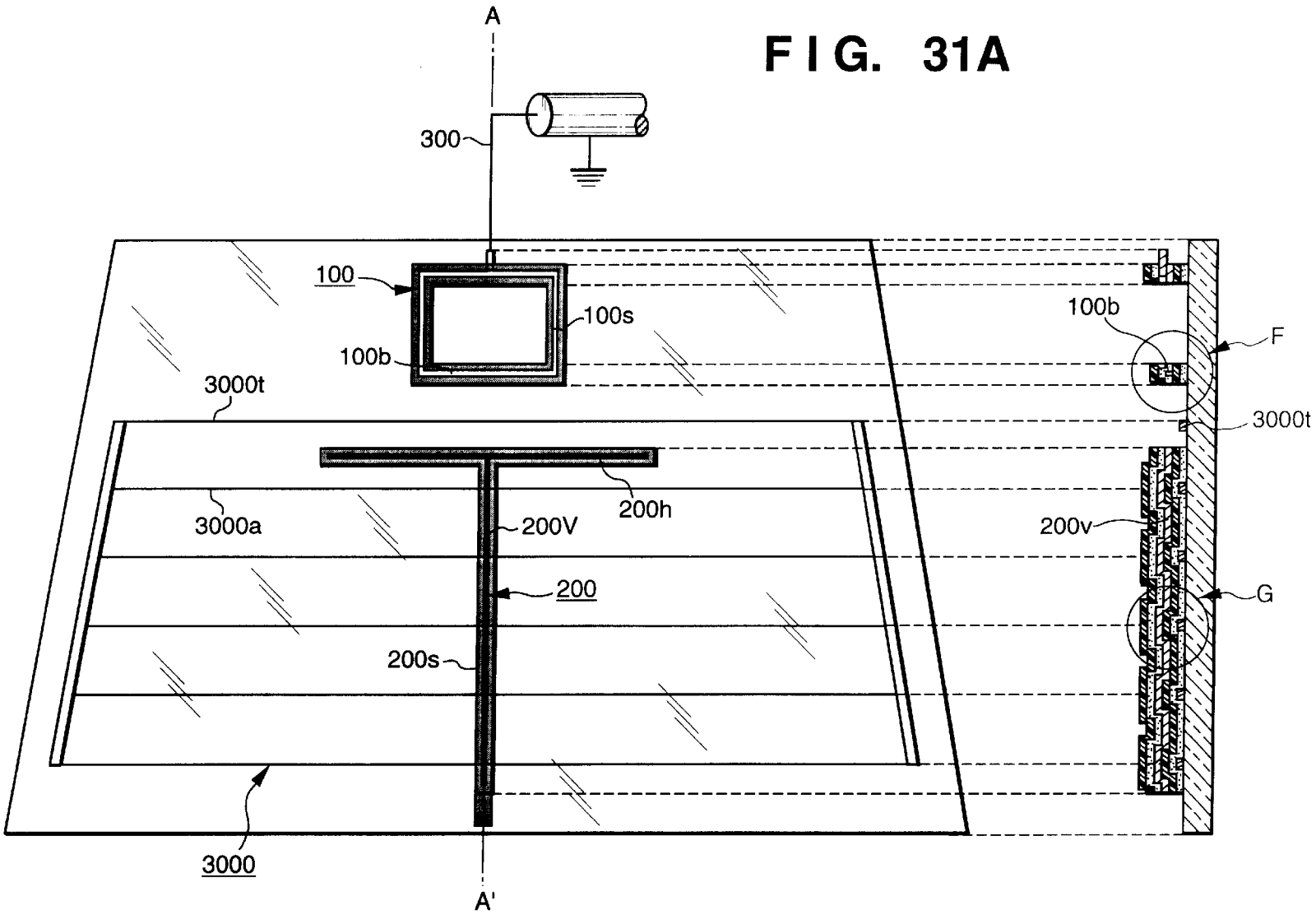
FIG. 31A is a view showing the arrangement of a glass antenna according to the second embodiment of the present invention.
Figure 31B:
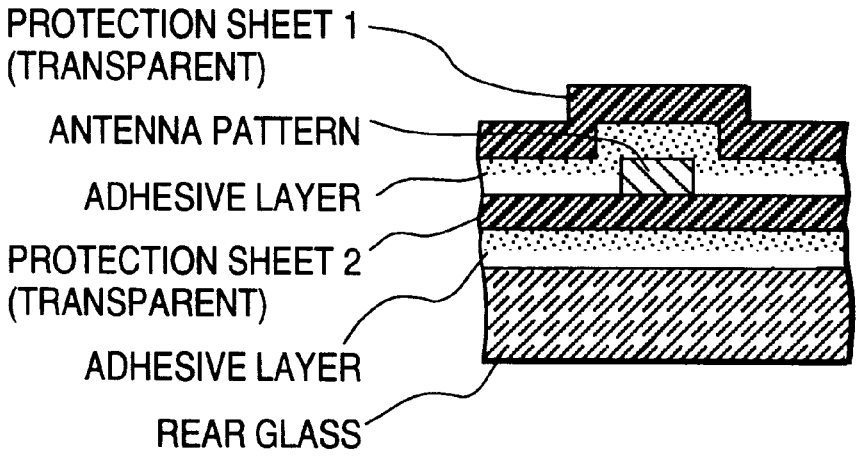
FIG. 31B is an enlarged view of a portion F of the glass antenna shown in FIG. 31A.
Figure 31C:
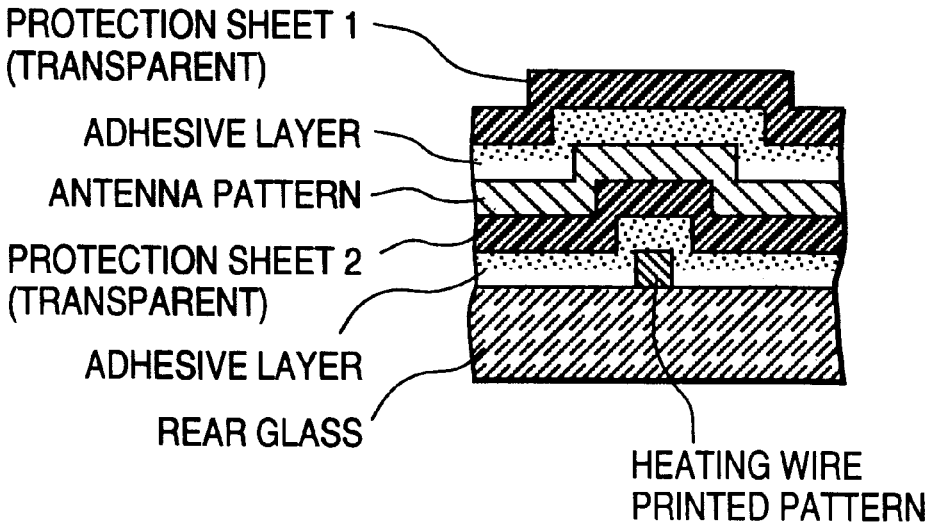
FIG. 31C is an enlarged view of a portion G of the glass antenna shown in FIG. 31A.

In the glass antenna of the first embodiment, the antenna conductor wire 200*h* of the second antenna element 200 is arranged to overlap the heating wire 3000*t* of the defogger. In the glass antenna of the second embodiment, the position of the horizontal wire 200*h* of the second antenna element 200 is set between the uppermost heating wire 3000*t* and a second uppermost heating wire 3000*a,* as shown in FIG. 31A. FIGS. 31B and 31C are enlarged sectional views of portions F and G in FIG. 31A taken along a line A–A' in FIG. 31A.

Figure 32:
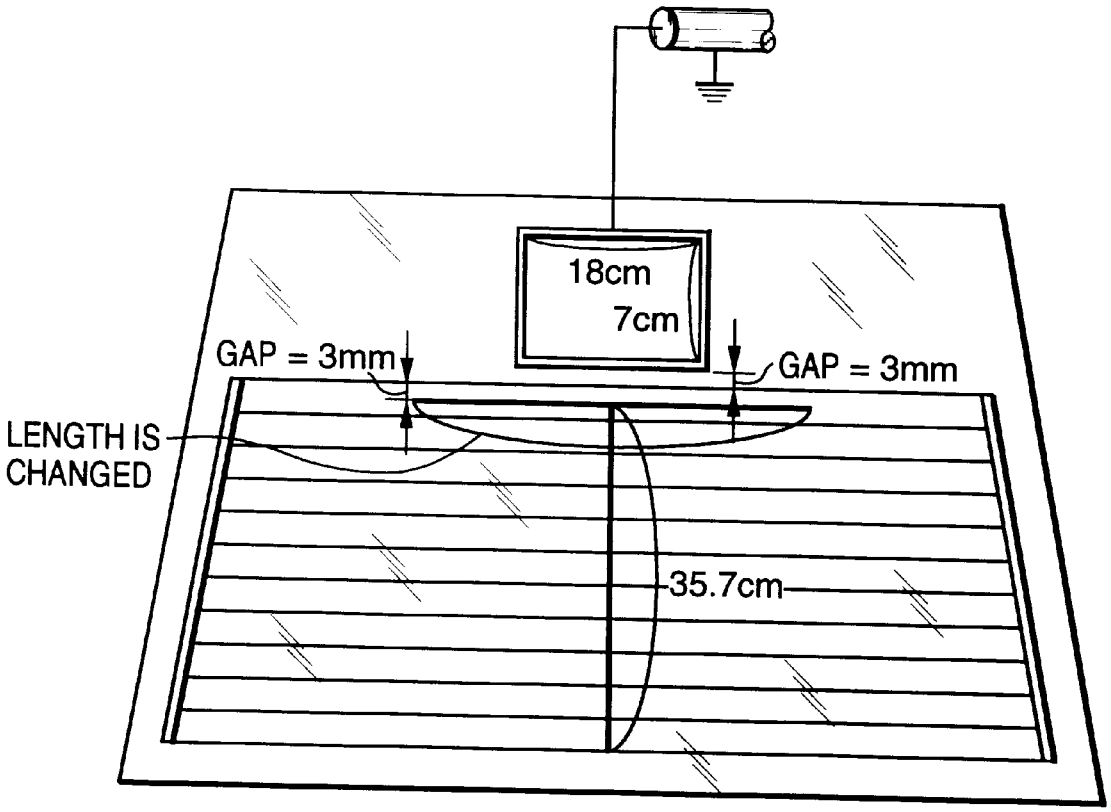
FIG. 32 is a view showing the state wherein the length of the horizontal wire of the second antenna element in the glass antenna of the second embodiment (FIG. 31A) is changed variously.

FIGS. 33A to 38C show changes in reception characteristics of the glass antenna of the second embodiment obtained when the horizontal wire 200*h* is set at a position about 3 mm beneath the heating wire 3000*t,* as shown in FIG. 32, and its length is changed variously.

Figures 33A, 33B:
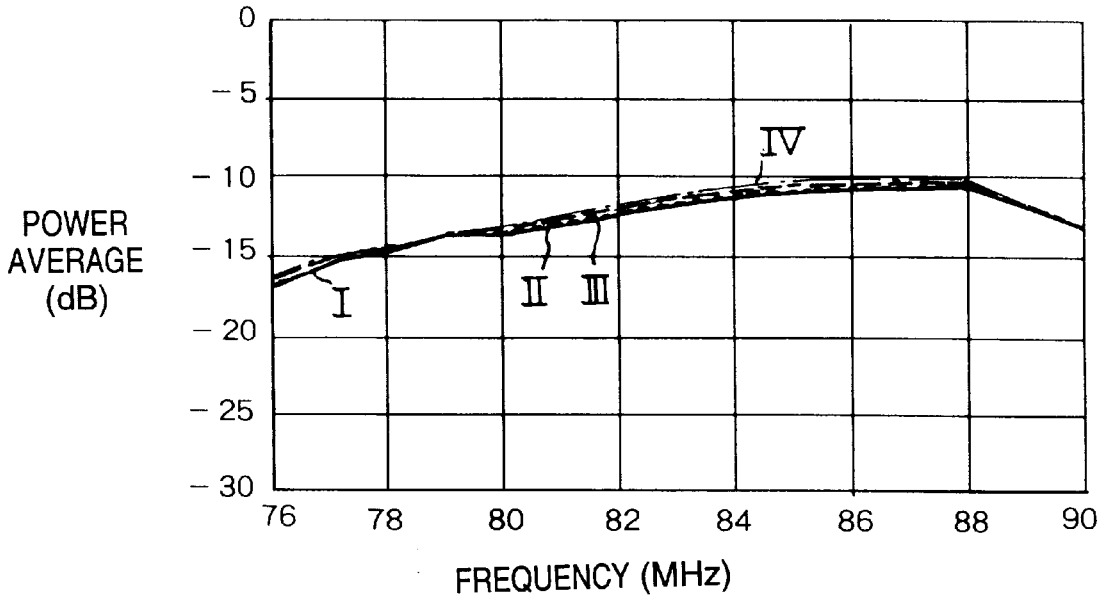
FIG. 33A is a graph showing changes in reception characteristics within the reception radio wave range from 76 MHz to 90 MHz when the length of the horizontal wire of the second antenna element is variously changed (80 cm, 60 cm, 40 cm, 30 cm) in the glass antenna of the second embodiment.
FIG. 33B is a table showing the average reception sensitivities within the reception radio wave range from 76 MHz to 90 MHz when the length of the horizontal wire of the second antenna element is variously changed (80 cm, 60 cm, 40 cm, 30 cm) in the glass antenna of the second embodiment.
Figure 33C:
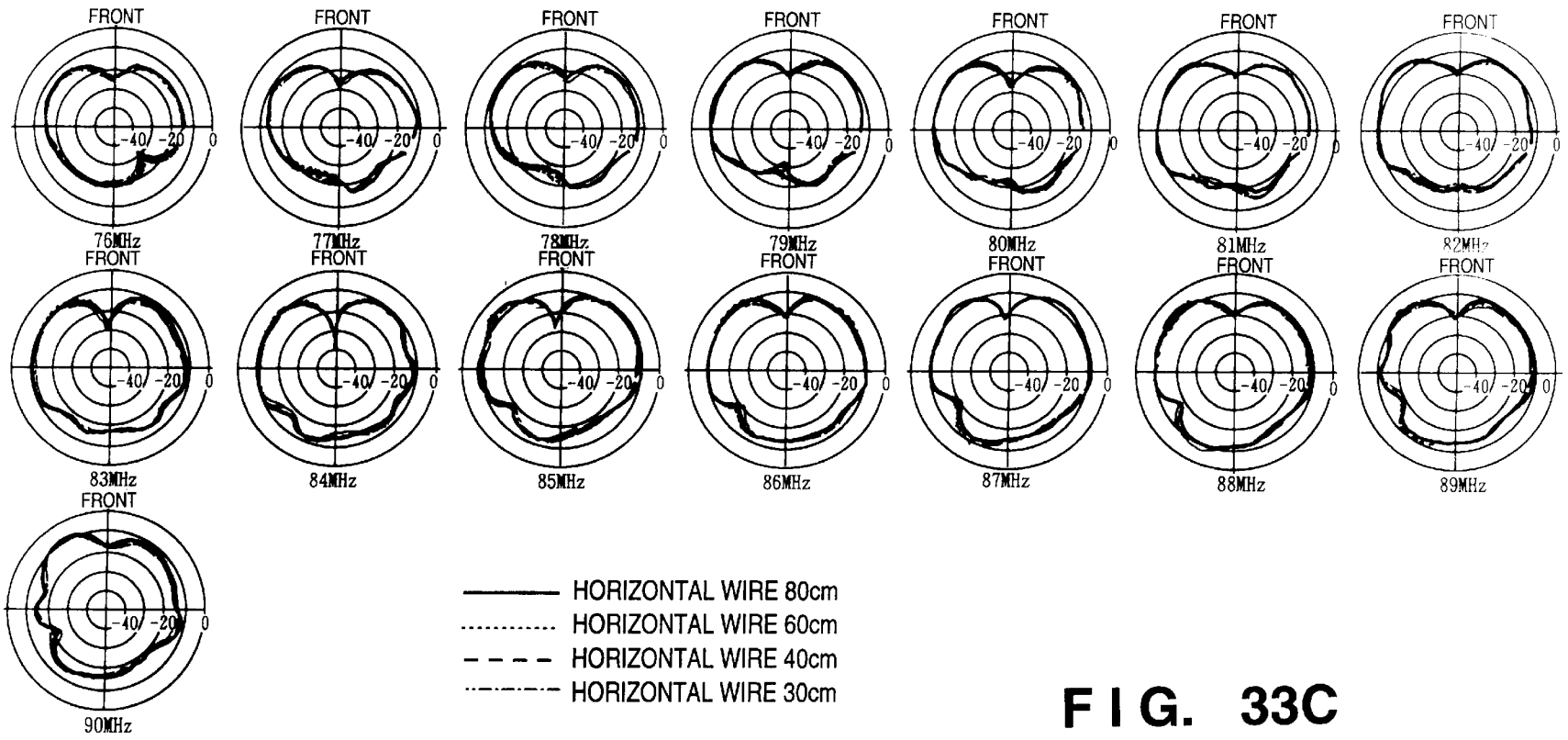
FIG. 33C shows changes in directivity characteristics within the reception radio wave range from 76 MHz to 90 MHz when the length of the horizontal wire of the second antenna element is variously changed (80 cm, 60 cm, 40 cm, 30 cm) in the glass antenna of the second embodiment.

In FIGS. 33A to 33C, bold solid curve I represents the reception sensitivity and directivity characteristics when the horizontal wire 200*h*=80 cm;

broken curve II represents the reception sensitivity and directivity characteristics when the horizontal wire 200*h*=60 cm;

broken curve III represents the reception sensitivity and directivity characteristics when the horizontal wire 200*h*=40 cm; and chain curve IV represents the reception sensitivity and directivity characteristics when the horizontal wire 200*h*=30 cm. When radio waves within the frequency range from 76 MHz to 90 MHz are to be received, practically sufficient reception sensitivity and directivity characteristics are obtained when the length of the horizontal wire 200*h* falls within the range from 80 cm to 30 cm.

Figures 34A, 34B:
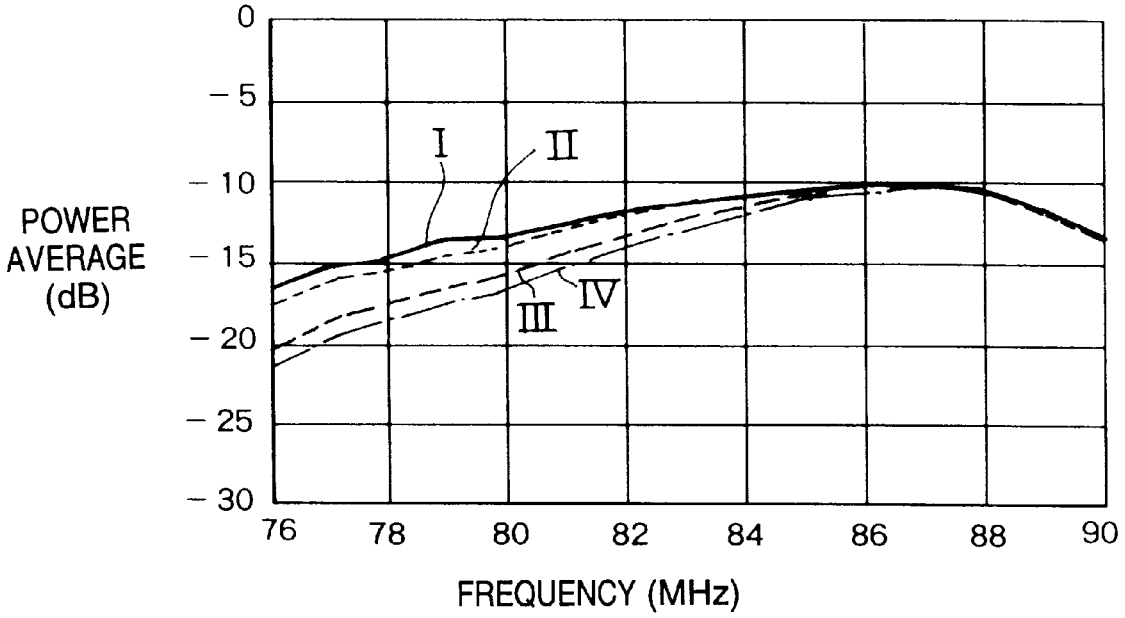
FIG. 34A is a graph showing changes in reception characteristics within the reception radio wave range from 76 MHz to 90 MHz when the length of the horizontal wire of the second antenna element is variously changed (20 cm, 15 cm, 10 cm, 8 cm) in the glass antenna of the second embodiment.
FIG. 34B is a table showing the average reception sensitivities within the reception radio wave range from 76 MHz to 90 MHz when the length of the horizontal wire of the second antenna element is variously changed (20 cm, 15 cm, 10 cm, 8 cm) in the glass antenna of the second embodiment.
Figure 34C:
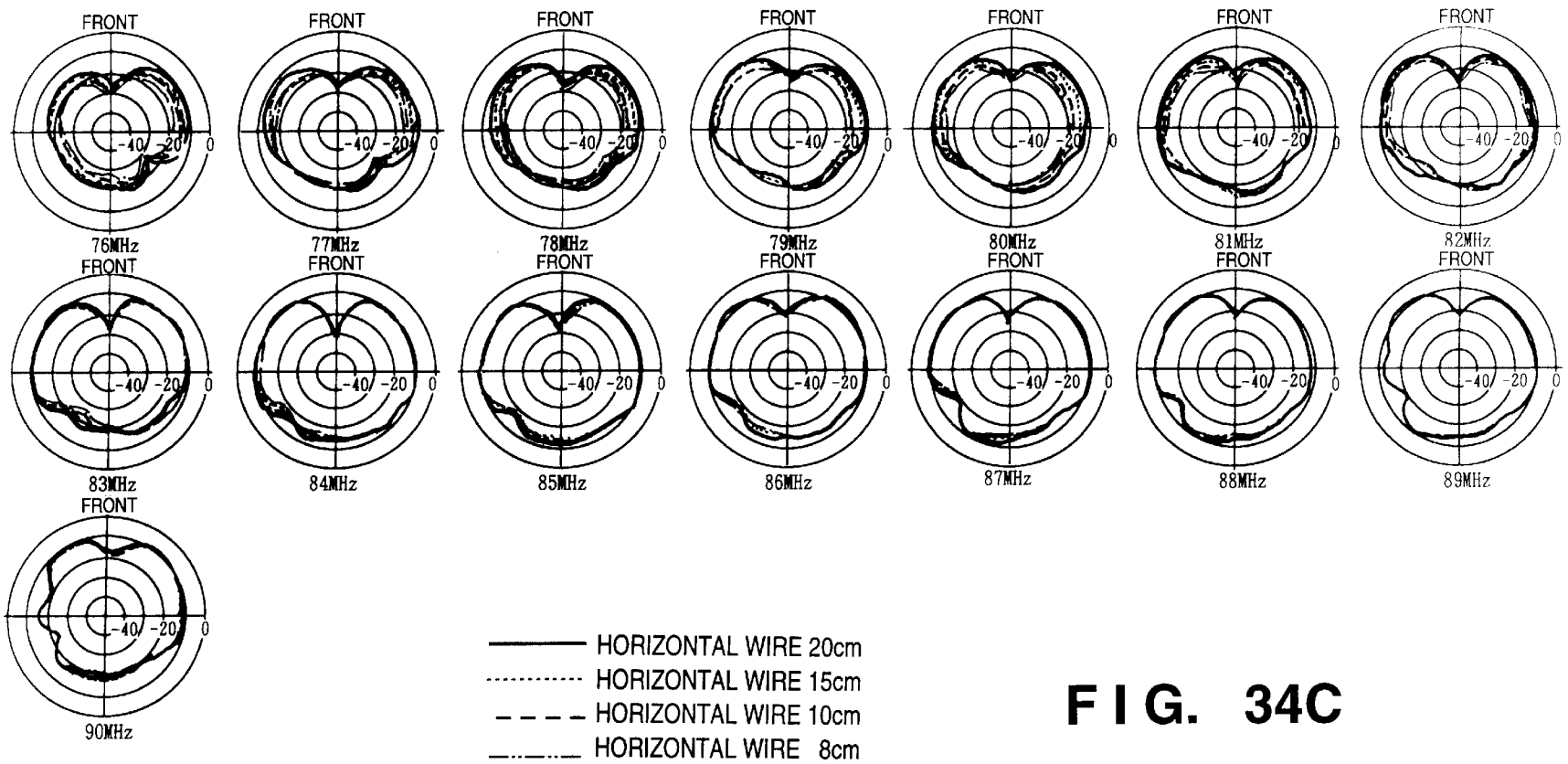
FIG. 34C shows changes in directivity characteristics within the reception radio wave range from 76 MHz to 90 MHz when the length of the horizontal wire of the second antenna element is variously changed (20 cm, 15 cm, 10 cm, 8 cm) in the glass antenna of the second embodiment.

In FIGS. 34A to 34C, bold solid curve I represents the reception sensitivity and directivity characteristics when the horizontal wire 200*h*=20 cm;

broken curve II represents the reception sensitivity and directivity characteristics when the horizontal wire 200*h*=15 cm;

broken curve III represents the reception sensitivity and directivity characteristics when the horizontal wire 200*h*=10 cm; and chain curve IV represents the reception sensitivity and directivity characteristics when the horizontal wire 200*h*=8 cm. When radio waves within the frequency range from 76 MHz to 90 MHz are to be received, practically sufficient reception sensitivity and directivity characteristics are obtained when the length of the horizontal wire 200*h* falls within the range from 20 cm to 8 cm.

Figures 35A, 35B:
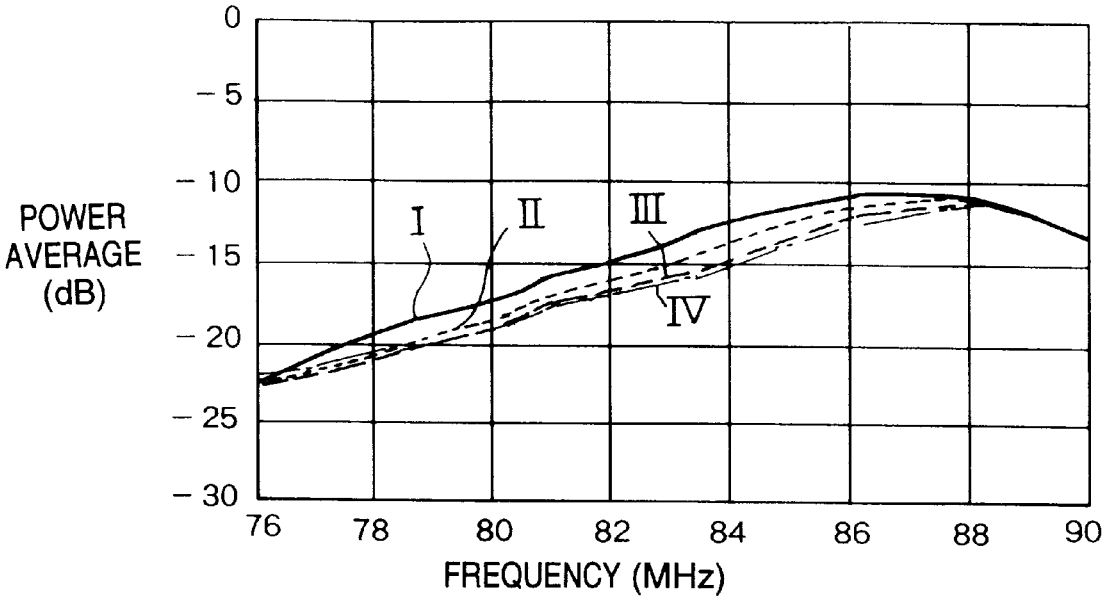
FIG. 35A is a graph showing changes in reception characteristics within the reception radio wave range from 76 MHz to 90 MHz when the length of the horizontal wire of the second antenna element is variously changed (6 cm, 4 cm, 2 cm, 0 cm) in the glass antenna of the second embodiment.
FIG. 35B is a table showing the average reception sensitivities within the reception radio wave range from 76 MHz to 90 MHz when the length of the horizontal wire of the second antenna element is variously changed (6 cm, 4 cm, 2 cm, 0 cm) in the glass antenna of the second embodiment.
Figure 35C:
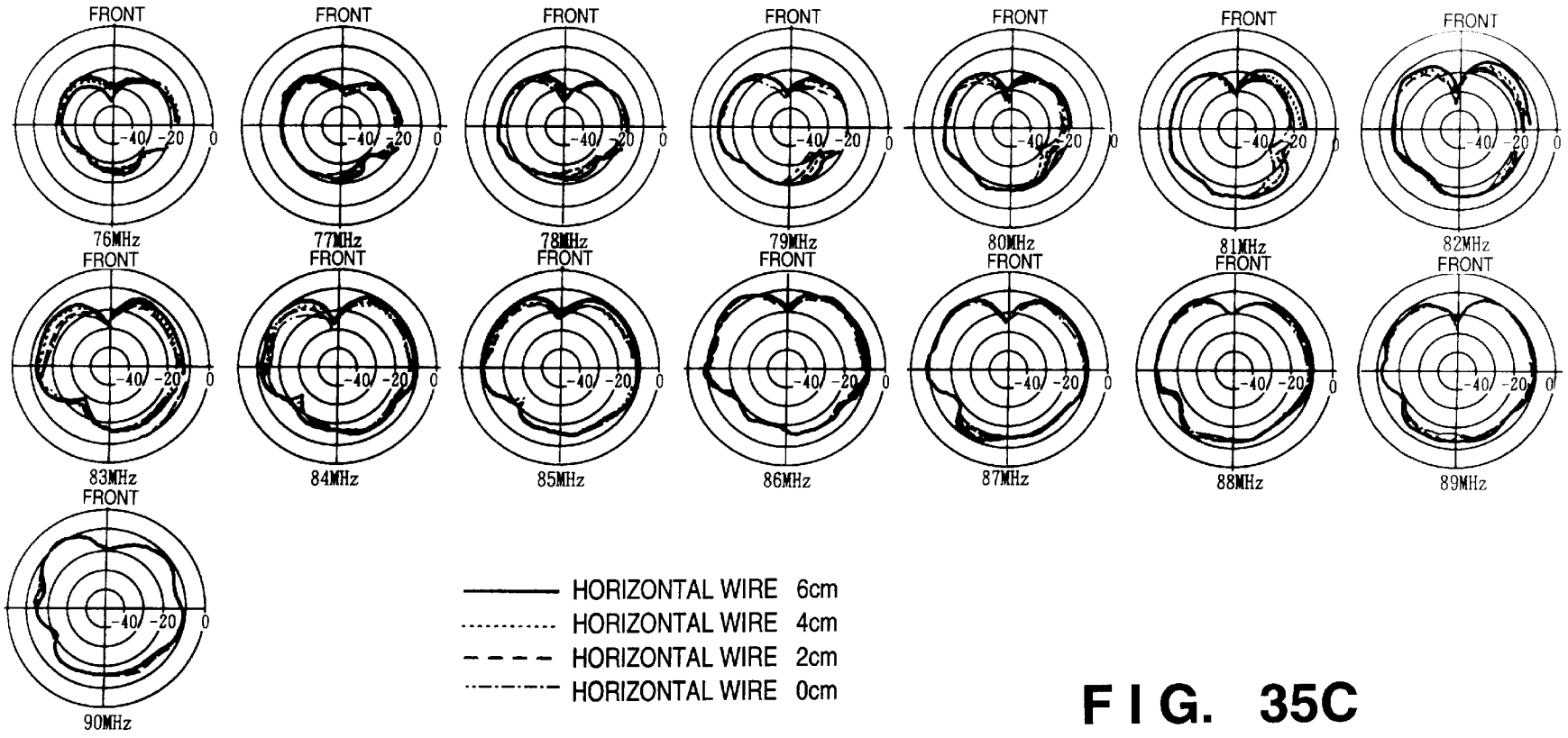
FIG. 35C shows changes in directivity characteristics within the reception radio wave range from 76 MHz to 90 MHz when the length of the horizontal wire of the second antenna element is variously changed (6 cm, 4 cm, 2 cm, 0 cm) in the glass antenna of the second embodiment.

In FIGS. 35A to 35C, bold solid curve I represents the reception sensitivity and directivity characteristics when the horizontal wire 200*h*=6 cm;

broken curve II represents the reception sensitivity and directivity characteristics when the horizontal wire 200*h*=4 cm;

broken curve III represents the reception sensitivity and directivity characteristics when the horizontal wire 200*h*=2 cm; and chain curve IV represents the reception sensitivity and directivity characteristics when the horizontal wire 200*h*=0 cm. When radio waves within the frequency range from 76 MHz to 90 MHz are to be received, practically sufficient reception sensitivity and directivity characteristics are obtained when the length of the horizontal wire 200*h* falls within the range of 5 cm or more.

FIGS. 36A to 38C show changes in reception sensitivity obtained when the length of the horizontal wire 200*h* is variously changed upon receiving horizontally polarized waves within the frequency range from 88 MHz to 110 MHz.

Figures 36A, 36B:
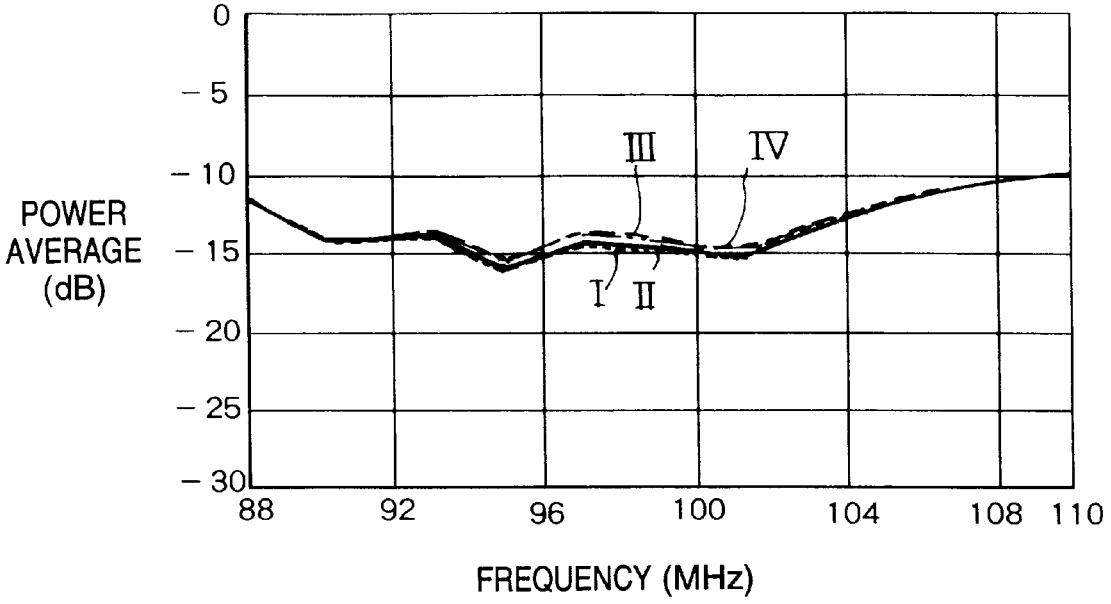
FIG. 36A is a graph showing changes in reception characteristics within the reception radio wave range from 88 MHz to 110 MHz when the length of the horizontal wire of the second antenna element is variously changed (80 cm, 60 cm, 40 cm, 30 cm) in the glass antenna of the second embodiment.
FIG. 36B is a table showing the average reception sensitivities within the reception radio wave range from 88 MHz to 110 MHz when the length of the horizontal wire of the second antenna element is variously changed (80 cm, 60 cm, 40 cm, 30 cm) in the glass antenna of the second embodiment.
Figure 36C:
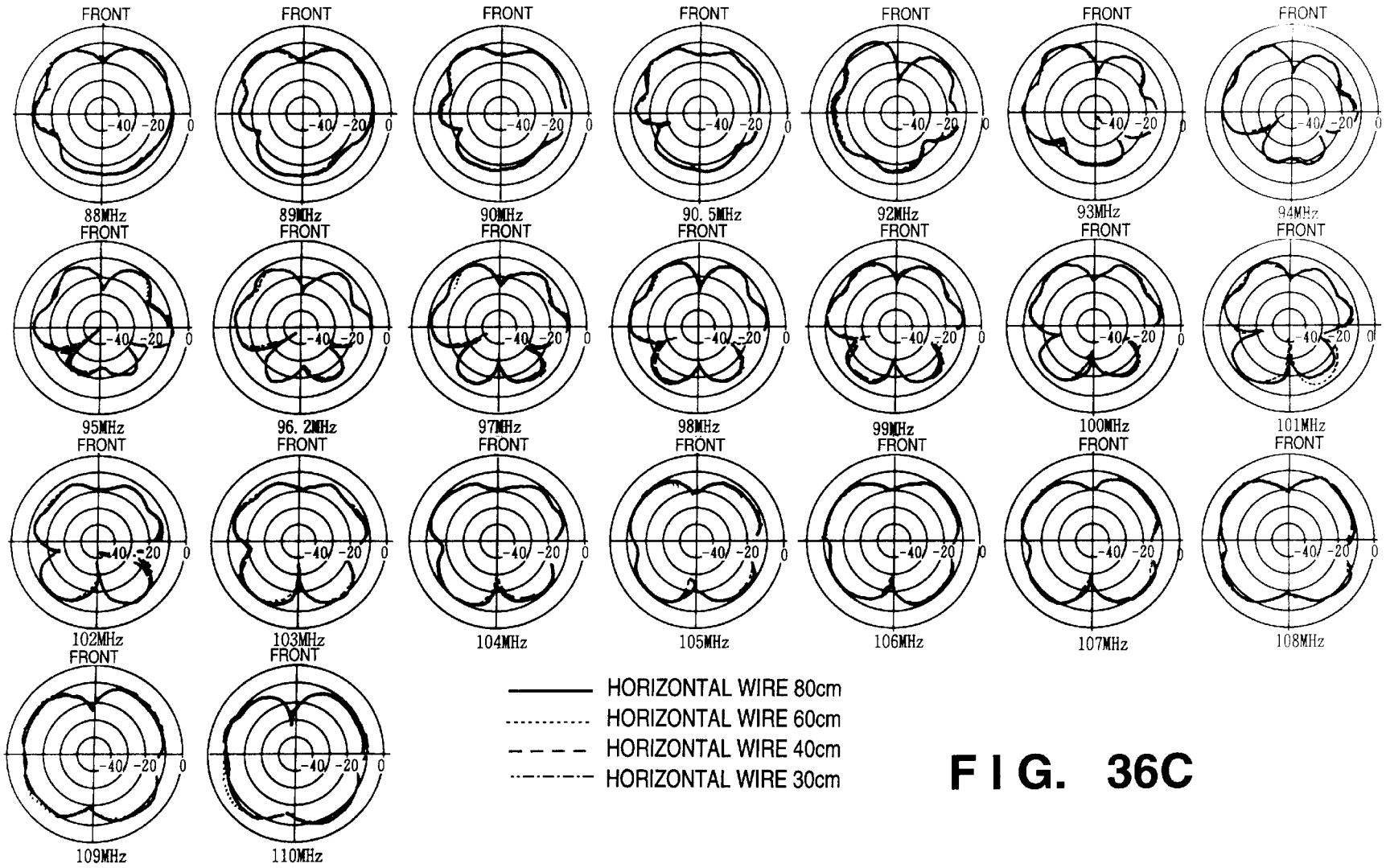
FIG. 36C shows changes in directivity characteristics within the reception radio wave range from 88 MHz to 110 MHz when the length of the horizontal wire of the second antenna element is variously changed (80 cm, 60 cm, 40 cm, 30 cm) in the glass antenna of the second embodiment.

In FIGS. 36A to 36C, bold solid curve I represents the reception sensitivity and directivity characteristics when the horizontal wire 200*h*=80 cm;

broken curve II represents the reception sensitivity and directivity characteristics when the horizontal wire 200*h*=60 cm;

broken curve III represents the reception sensitivity and directivity characteristics when the horizontal wire 200*h*=40 cm; and chain curve IV represents the reception sensitivity and directivity characteristics when the horizontal wire 200*h*=30 cm. When radio waves within the frequency range from 88 MHz to 110 MHz are to be received, practically sufficient reception sensitivity and directivity characteristics are obtained when the length of the horizontal wire 200*h* falls within the range from 80 cm to 30 cm.

Figures 37A, 37B:
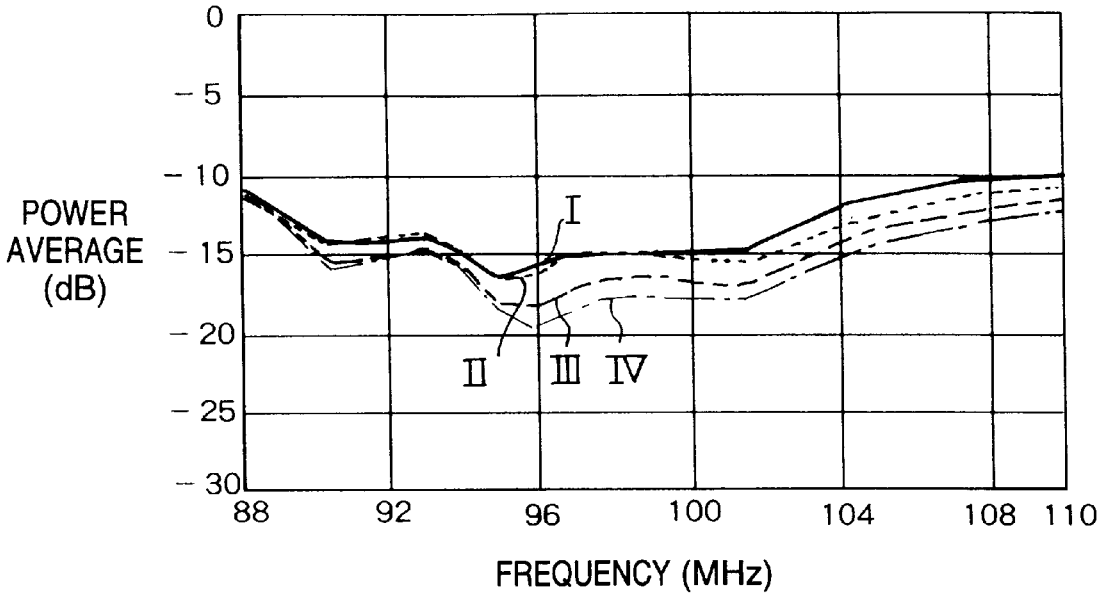
FIG. 37A is a graph showing changes in reception characteristics within the reception radio wave range from 88 MHz to 110 MHz when the length of the horizontal wire of the second antenna element is variously changed (20 cm, 15 cm, 10 cm, 8 cm) in the glass antenna of the second embodiment.
FIG. 37B is a table showing the average reception sensitivities within the reception radio wave range from 88 MHz to 110 MHz when the length of the horizontal wire of the second antenna element is variously changed (20 cm, 15 cm, 10 cm, 8 cm) in the glass antenna of the second embodiment.
Figure 37C:
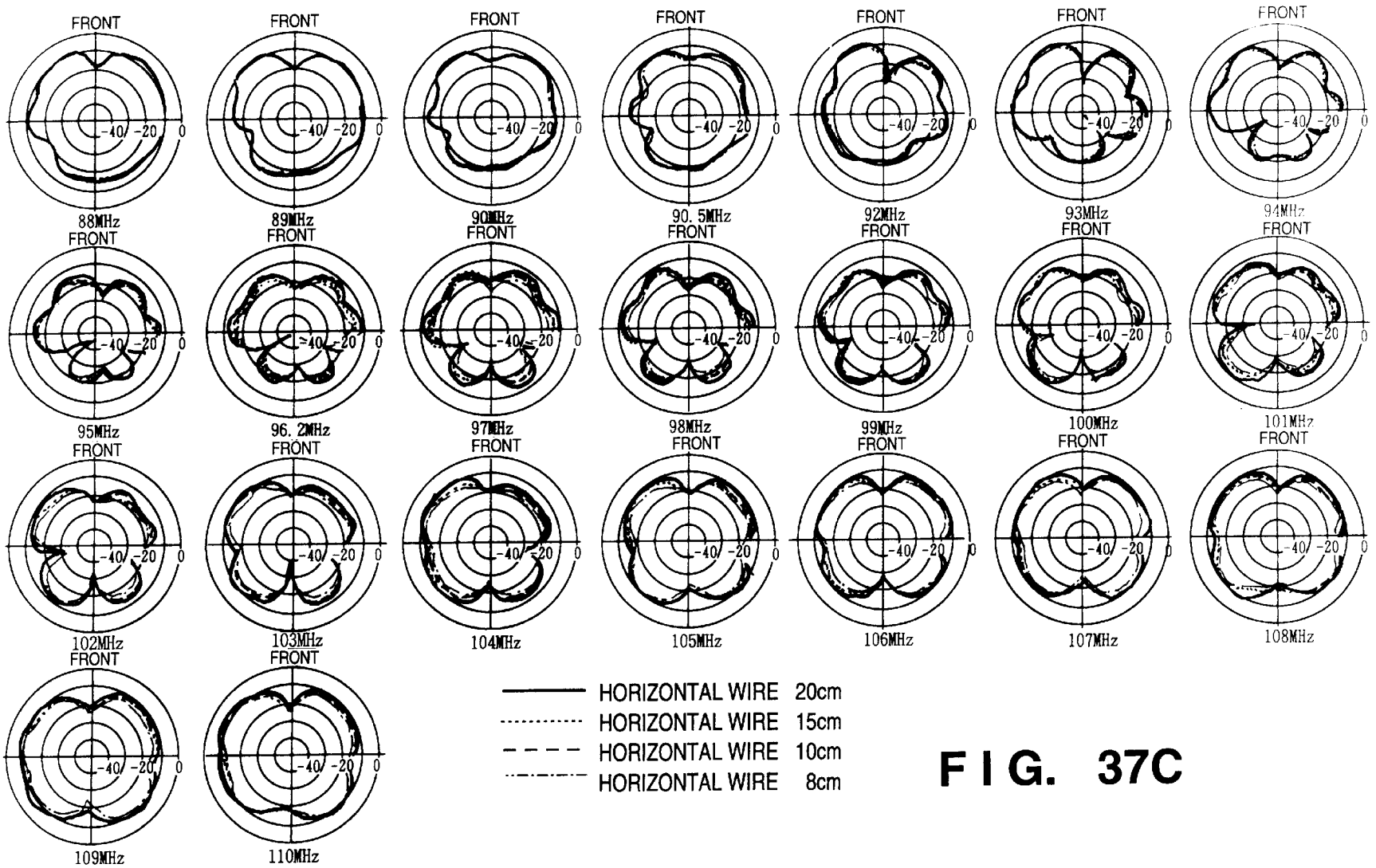
FIG. 37C shows changes in directivity characteristics within the reception radio wave range from 88 MHz to 110 MHz when the length of the horizontal wire of the second antenna element is variously changed (20 cm, 15 cm, 10 cm, 8 cm) in the glass antenna of the second embodiment.

In FIGS. 37A to 37C, bold solid curve I represents the reception sensitivity and directivity characteristics when the horizontal wire 200*h*=25 cm;

broken curve II represents the reception sensitivity and directivity characteristics when the horizontal wire 200*h*=15 cm;

broken curve III represents the reception sensitivity and directivity characteristics when the horizontal wire 200*h*=10 cm; and chain curve IV represents the reception sensitivity and directivity characteristics when the horizontal wire 200*h*=8 cm.

Figures 38A, 38B:
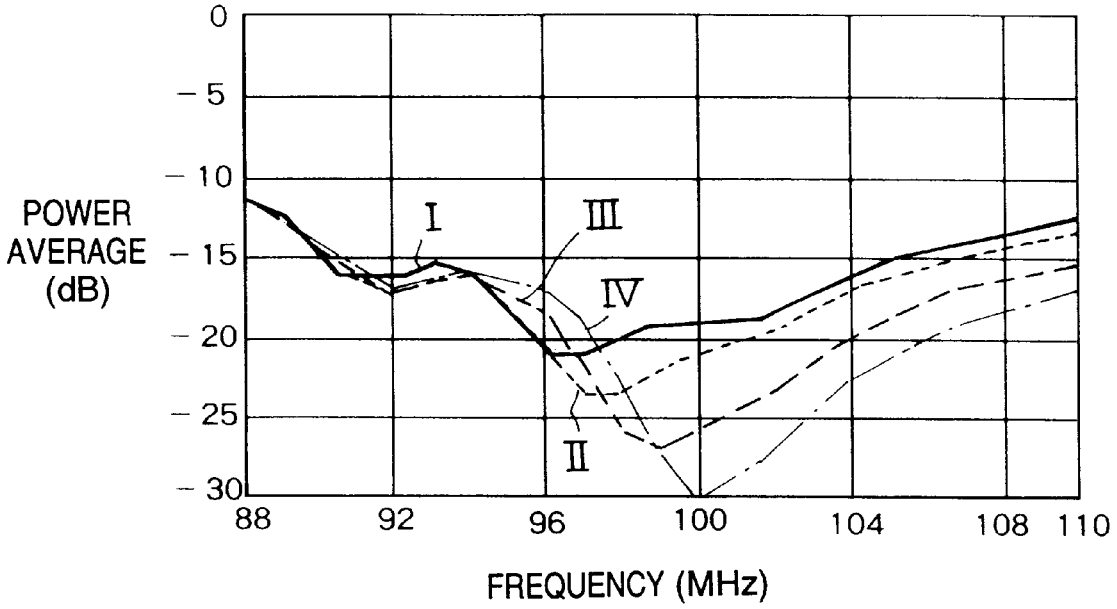
FIG. 38A is a graph showing changes in reception characteristics within the reception radio wave range from 88 MHz to 110 MHz when the length of the horizontal wire of the second antenna element is variously changed (6 cm, 4 cm, 2 cm, 0 cm) in the glass antenna of the second embodiment.
FIG. 38B is a table showing the average reception sensitivities within the reception radio wave range from 88 MHz to 110 MHz when the length of the horizontal wire of the second antenna element is variously changed (6 cm, 4 cm, 2 cm, 0 cm) in the glass antenna of the second embodiment.
Figure 38C:
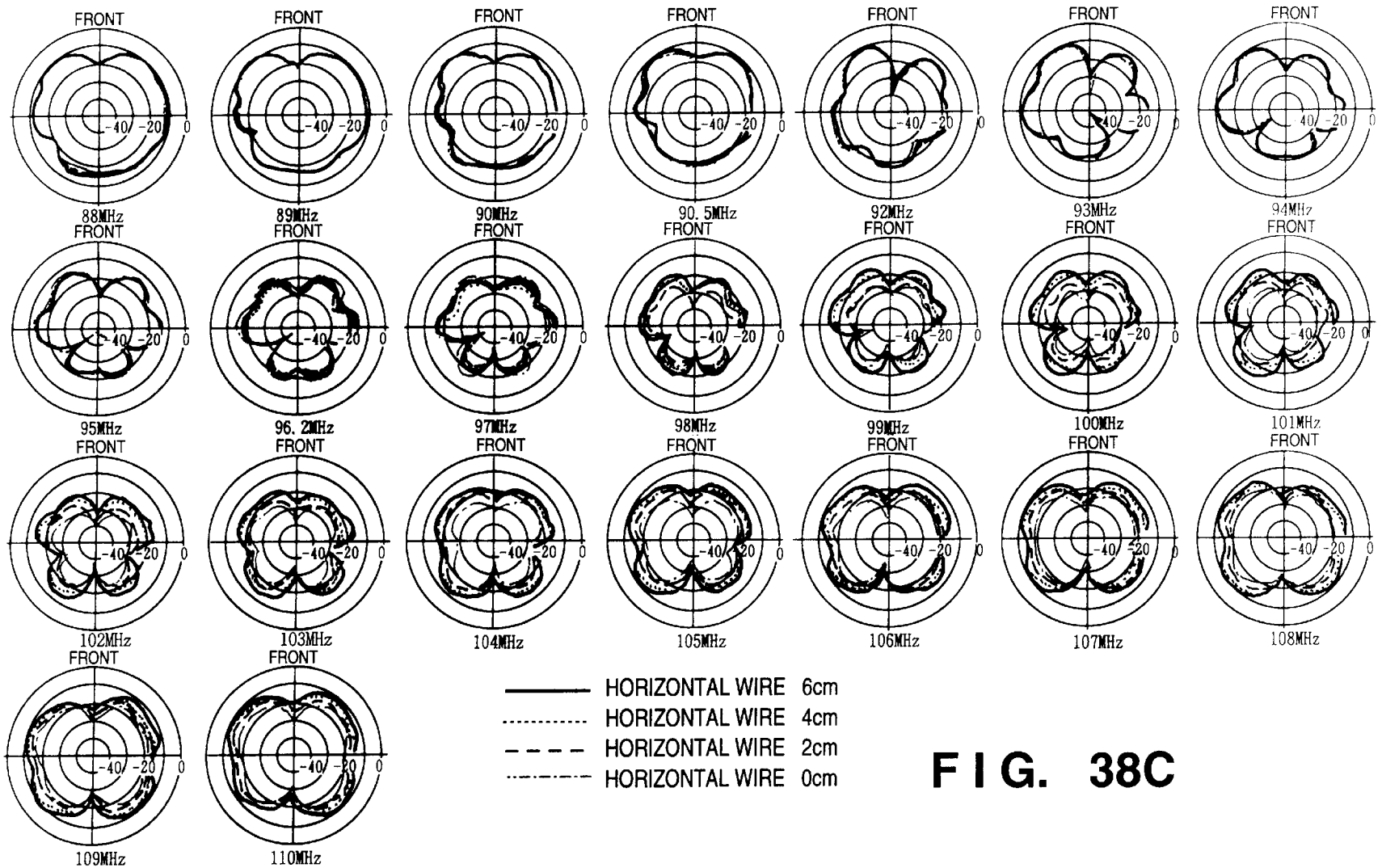
FIG. 38C shows changes in directivity characteristics within the reception radio wave range from 88 MHz to 110 MHz when the length of the horizontal wire of the second antenna element is variously changed (6 cm, 4 cm, 2 cm, 0 cm) in the glass antenna of the second embodiment.

In FIGS. 38A to 38C, bold solid curve I represents the reception sensitivity and directivity characteristics when the horizontal wire 200*h*=6 cm;

broken curve II represents the reception sensitivity and directivity characteristics when the horizontal wire 200*h*=4 cm;

broken curve III represents the reception sensitivity and directivity characteristics when the horizontal wire 200*h*=2 cm; and chain curve IV represents the reception sensitivity and directivity characteristics when the horizontal wire 200*h*=0 cm. When radio waves within the frequency range from 88 MHz to 110 MHz are to be received, practically sufficient reception sensitivity and directivity characteristics are obtained when the length of the horizontal wire 200*h* falls within the range from 80 cm to 5 cm.

Third Embodiment

Figure 39A:
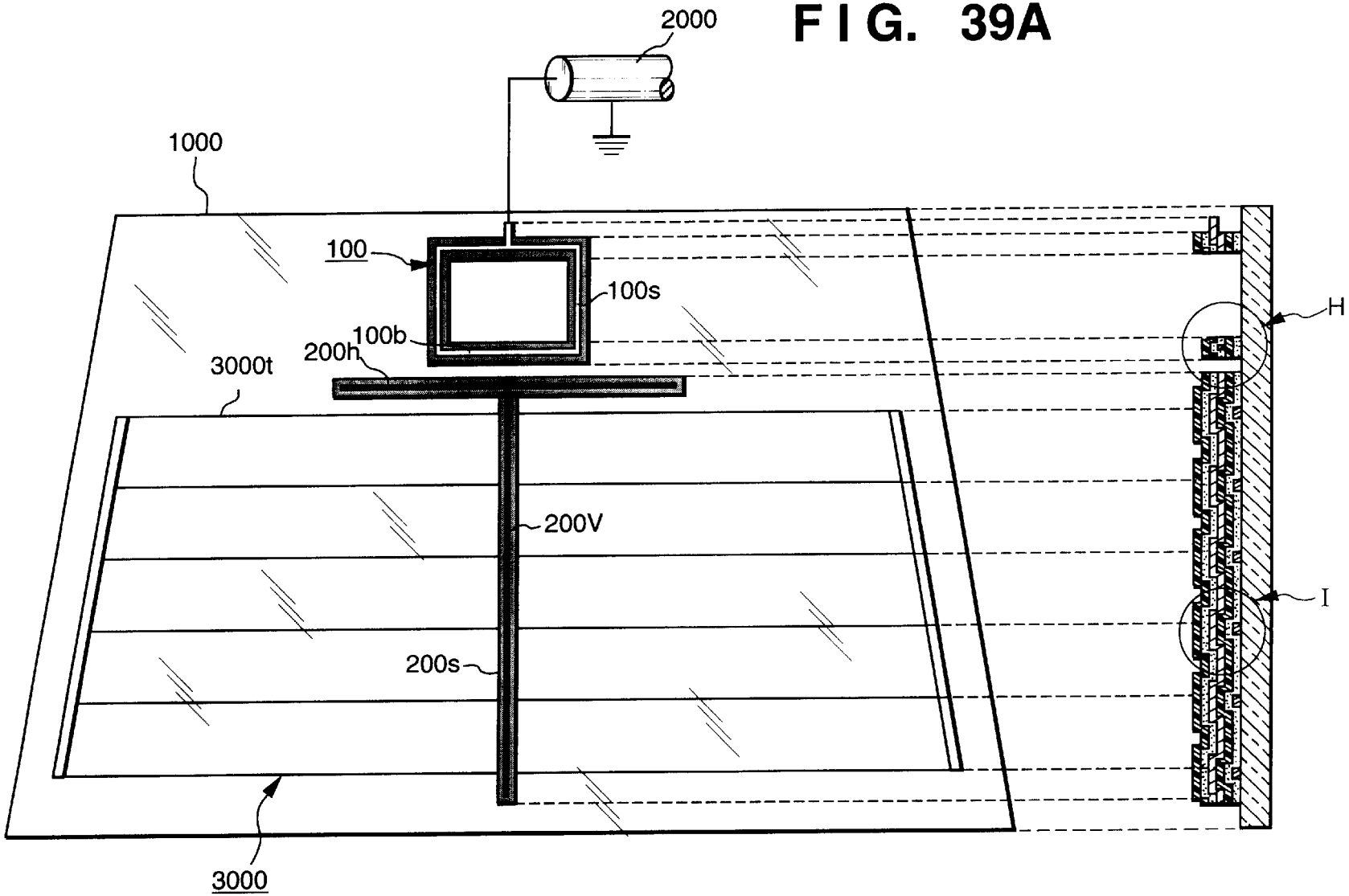
FIG. 39A is a view showing the arrangement of a glass antenna according to the third embodiment of the present invention.
Figure 39B:
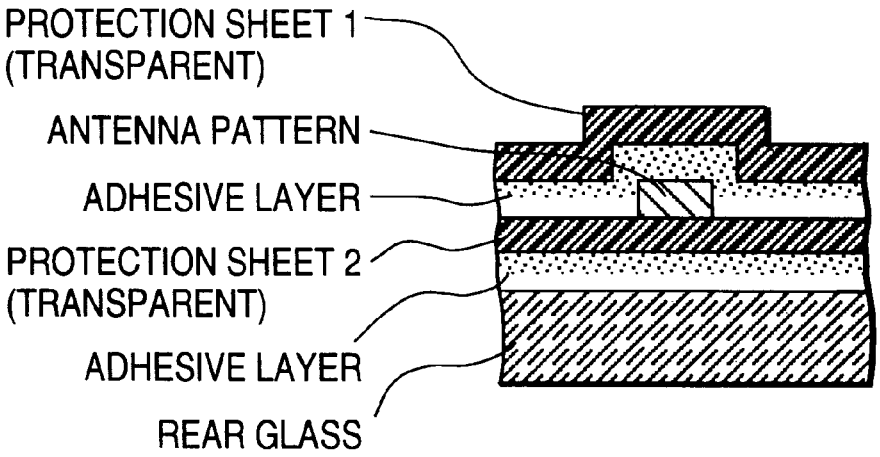
FIG. 39B is an enlarged view of a portion H of the glass antenna shown in FIG. 39A.
Figure 39C:
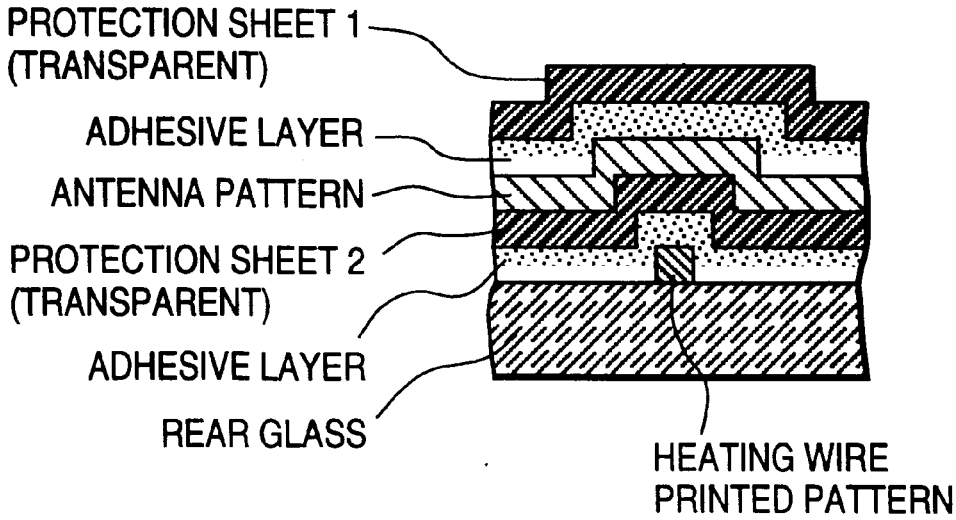
FIG. 39C is an enlarged view of a portion I of the glass antenna shown in FIG. 39A.

FIG. 39A shows the arrangement of a glass antenna according to the third embodiment of the present invention. In FIG. 39A, the horizontal wire 200*h* of the second antenna element is arranged between the conductor wire 100*b* of the first antenna element 100 and the uppermost heating wire 3000*t*. FIGS. 39B and 39C are enlarged sectional views of portions H and I in FIG. 39A taken along a line A–A' in FIG. 39A.

Figure 40:
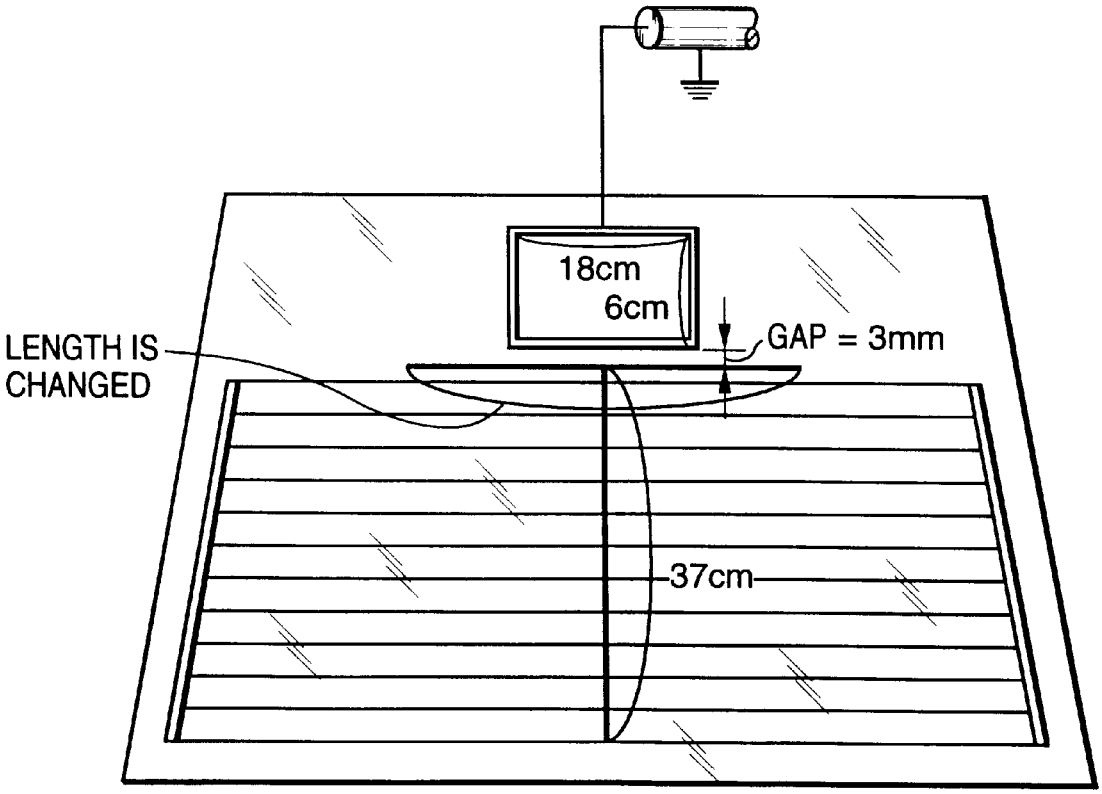
FIG. 40 is a view showing the state wherein the length of the horizontal wire of the second antenna element in the glass antenna of the third embodiment (FIG. 39A) is changed variously.

FIGS. 41A to 44C show changes in reception characteristics of the glass antenna of the third embodiment obtained when the horizontal wire 200*h* is set at a position about 3 mm above the heating wire 3000*t*, as shown in FIG. 40, and its length is changed variously.

Figures 41A, 41B:
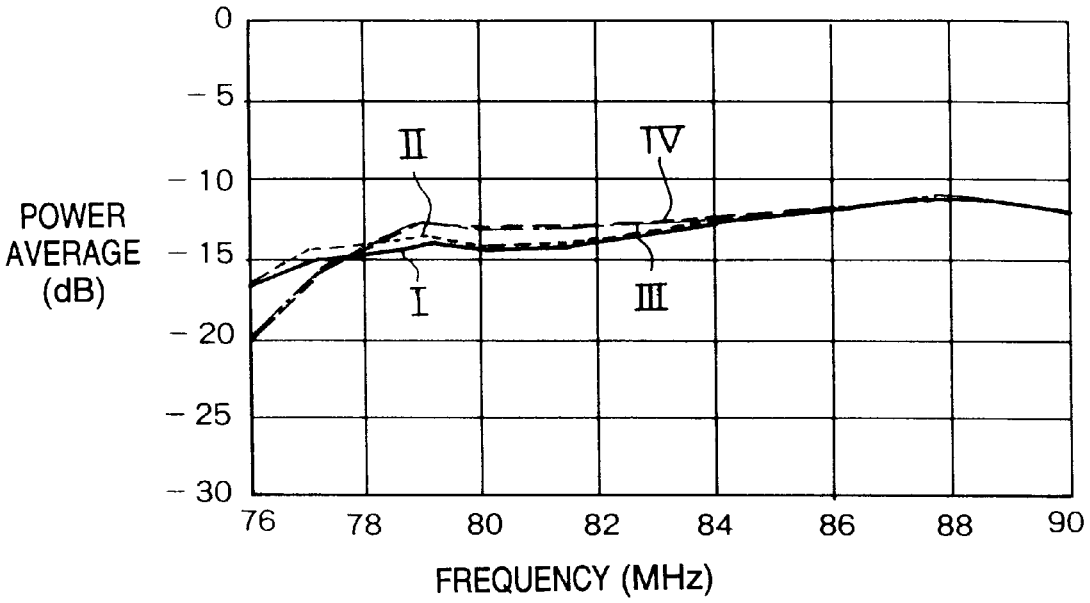
FIG. 41A is a graph showing changes in reception characteristics within the reception radio wave range from 76 MHz to 90 MHz when the length of the horizontal wire of the second antenna element is variously changed (40 cm, 30 cm, 20 cm, 18 cm) in the glass antenna of the third embodiment.
FIG. 41B is a table showing the average reception sensitivities within the reception radio wave range from 76 MHz to 90 MHz when the length of the horizontal wire of the second antenna element is variously changed (40 cm, 30 cm, 20 cm, 18 cm) in the glass antenna of the third embodiment.
Figure 41C:
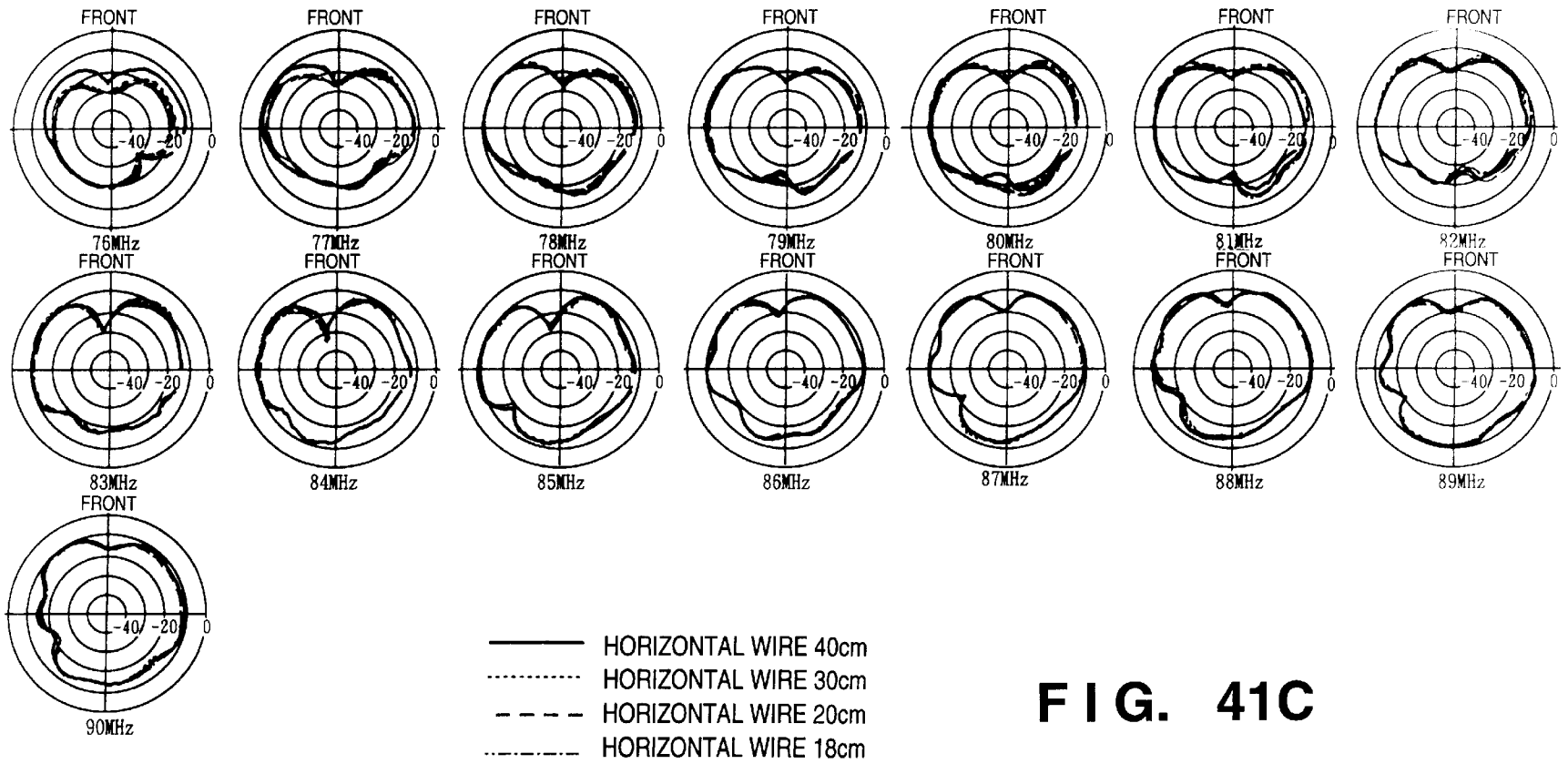
FIG. 41C shows changes in directivity characteristics within the reception radio wave range from 76 MHz to 90 MHz when the length of the horizontal wire of the second antenna element is variously changed (40 cm, 30 cm, 20 cm, 18 cm) in the glass antenna of the third embodiment.

In FIGS. 41A to 41C, bold solid curve I represents the reception sensitivity and directivity characteristics when the horizontal wire 200*h*=40 cm;

broken curve II represents the reception sensitivity and directivity characteristics when the horizontal wire 200*h*=30 cm;

broken curve III represents the reception sensitivity and directivity characteristics when the horizontal wire 200*h*=20 cm; and chain curve IV represents the reception sensitivity and directivity characteristics when the horizontal wire 200*h*=18 cm. When radio waves within the frequency range from 76 MHz to 90 MHz are to be received, practically sufficient reception sensitivity and directivity characteristics are obtained when the length of the horizontal wire 200*h* falls within the range of 18 cm or more.

Figures 42A, 42B:
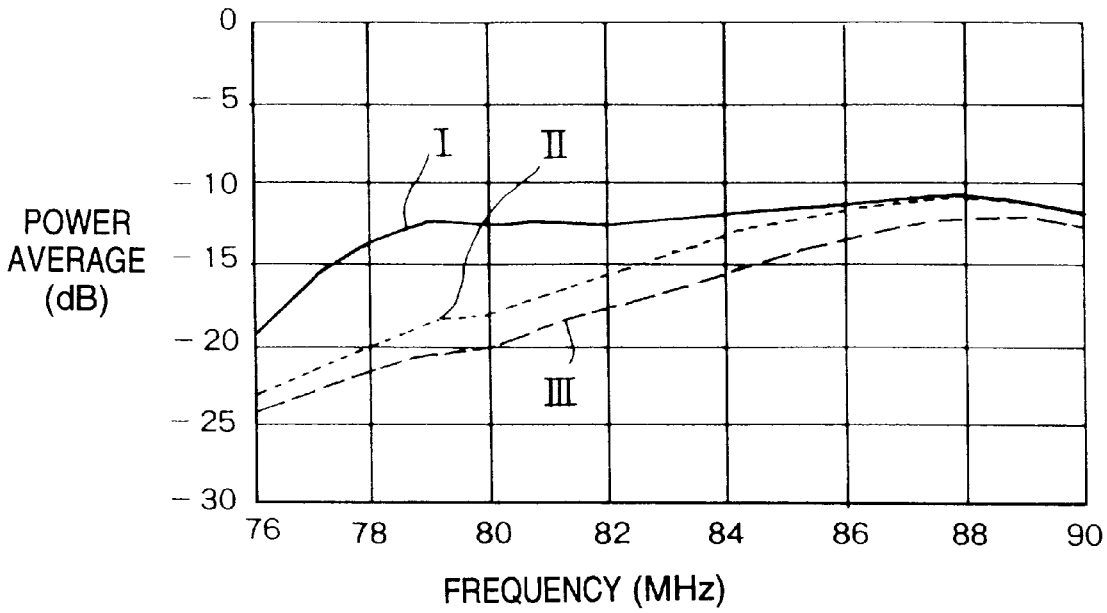
FIG. 42A is a graph showing changes in reception characteristics within the reception radio wave range from 76 MHz to 90 MHz when the length of the horizontal wire of the second antenna element is variously changed (18 cm, 5 cm, 0 cm) in the glass antenna of the third embodiment.
FIG. 42B is a table showing the average reception sensitivities within the reception radio wave range from 76 MHz to 90 MHz when the length of the horizontal wire of the second antenna element is variously changed (18 cm, 5 cm, 0 cm) in the glass antenna of the third embodiment.
Figure 42C:
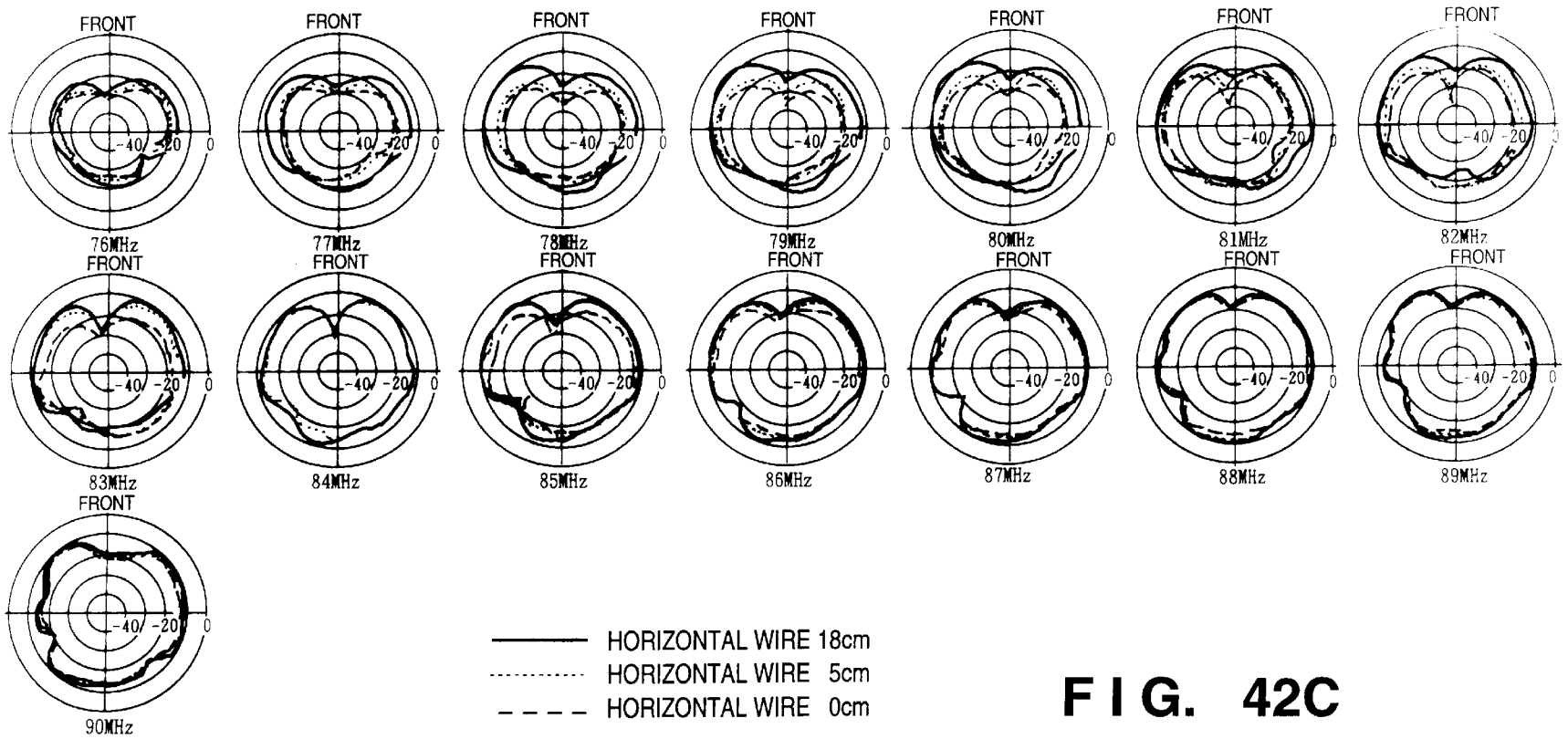
FIG. 42C shows changes in directivity characteristics within the reception radio wave range from 76 MHz to 90 MHz when the length of the horizontal wire of the second antenna element is variously changed (18 cm, 5 cm, 0 cm) in the glass antenna of the third embodiment.

In FIGS. 42A to 42C, bold solid curve I represents the reception sensitivity and directivity characteristics when the horizontal wire 200*h*=18 cm;

broken curve II represents the reception sensitivity and directivity characteristics when the horizontal wire 200*h*=5 cm; and broken curve III represents the reception sensitivity and directivity characteristics when the horizontal wire 200*h*=0 cm. When radio waves within the frequency range from 76 MHz to 90 MHz are to be received, practically sufficient reception sensitivity and directivity characteristics are obtained when the length of the horizontal wire 200*h* falls within the range from 40 cm to 5 cm.

Figures 43A, 43B:
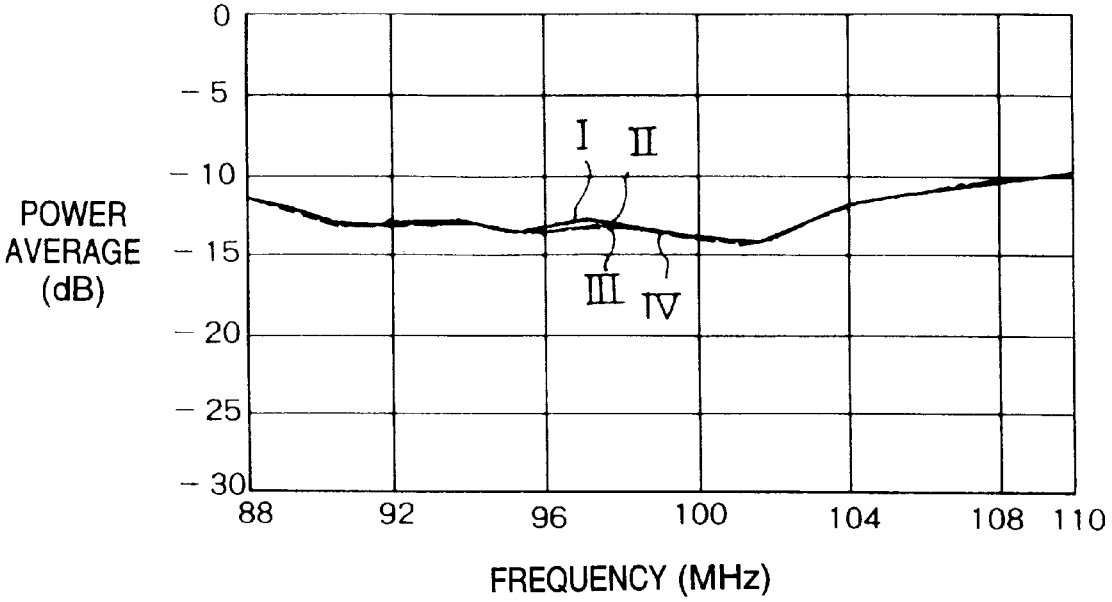
FIG. 43A is a graph showing changes in reception characteristics within the reception radio wave range from 88 MHz to 110 MHz when the length of the horizontal wire of the second antenna element is variously changed (40 cm, 30 cm, 20 cm, 18 cm) in the glass antenna of the third embodiment.
FIG. 43B is a table showing the average reception sensitivities within the reception radio wave range from 88 MHz to 110 MHz when the length of the horizontal wire of the second antenna element is variously changed (40 cm, 30 cm, 20 cm, 18 cm) in the glass antenna of the third embodiment.
Figure 43C:
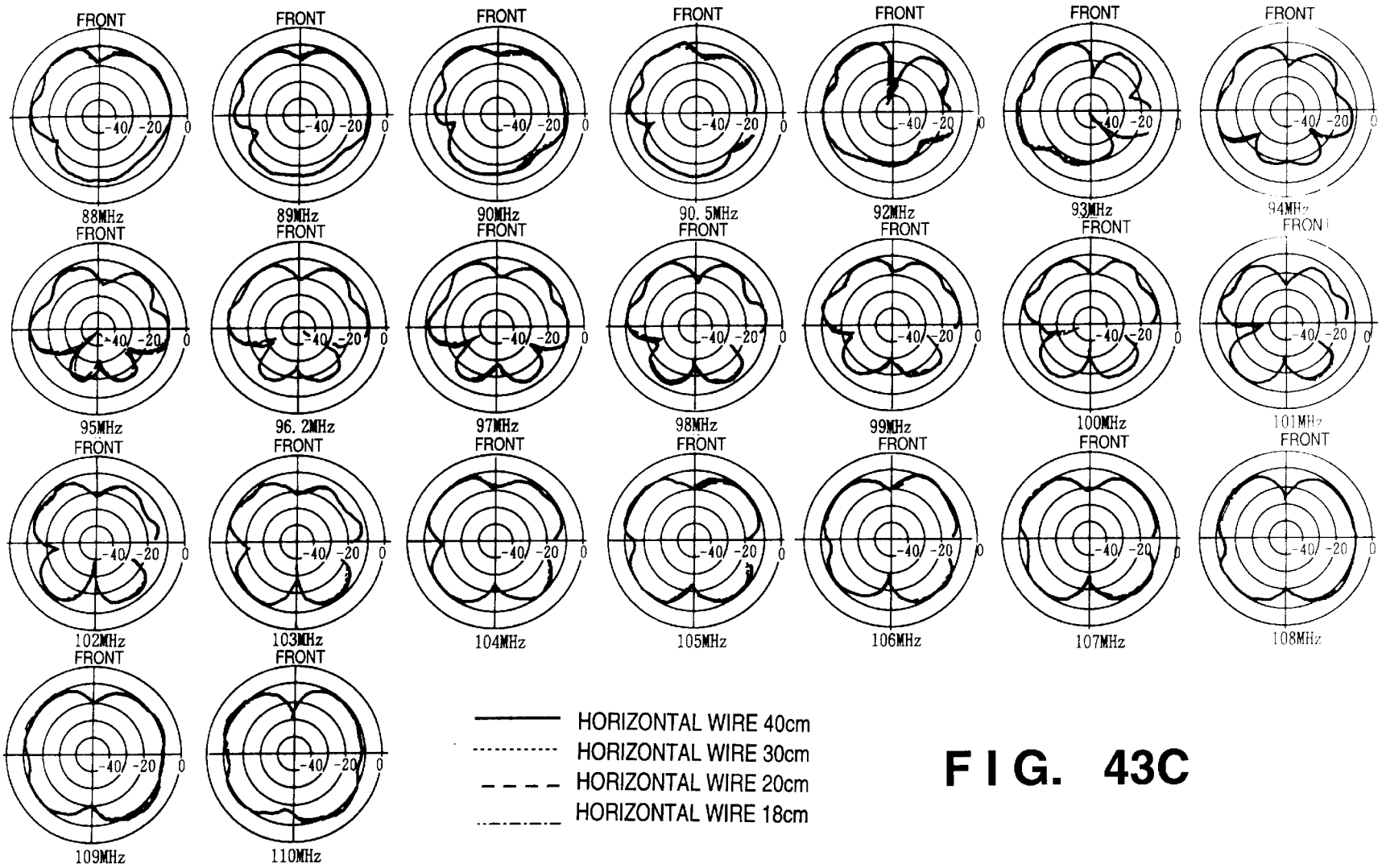
FIG. 43C shows changes in directivity characteristics within the reception radio wave range from 88 MHz to 110 MHz when the length of the horizontal wire of the second antenna element is variously changed (40 cm, 30 cm, 20 cm, 18 cm) in the glass antenna of the third embodiment.

In FIGS. 43A to 43C, bold solid curve I represents the reception sensitivity and directivity characteristics when the horizontal wire 200*h*=40 cm;

broken curve II represents the reception sensitivity and directivity characteristics when the horizontal wire 200*h*=30 cm;

broken curve III represents the reception sensitivity and directivity characteristics when the horizontal wire 200*h*=20 cm; and chain curve IV represents the reception sensitivity and directivity characteristics when the horizontal wire 200*h*=18 cm. When radio waves within the frequency range from 88 MHz to 110 MHz are to be received, practically sufficient reception sensitivity and directivity characteristics are obtained when the length of the horizontal wire 200*h* falls within the range from 40 cm to 18 cm.

Figures 44A, 44B:
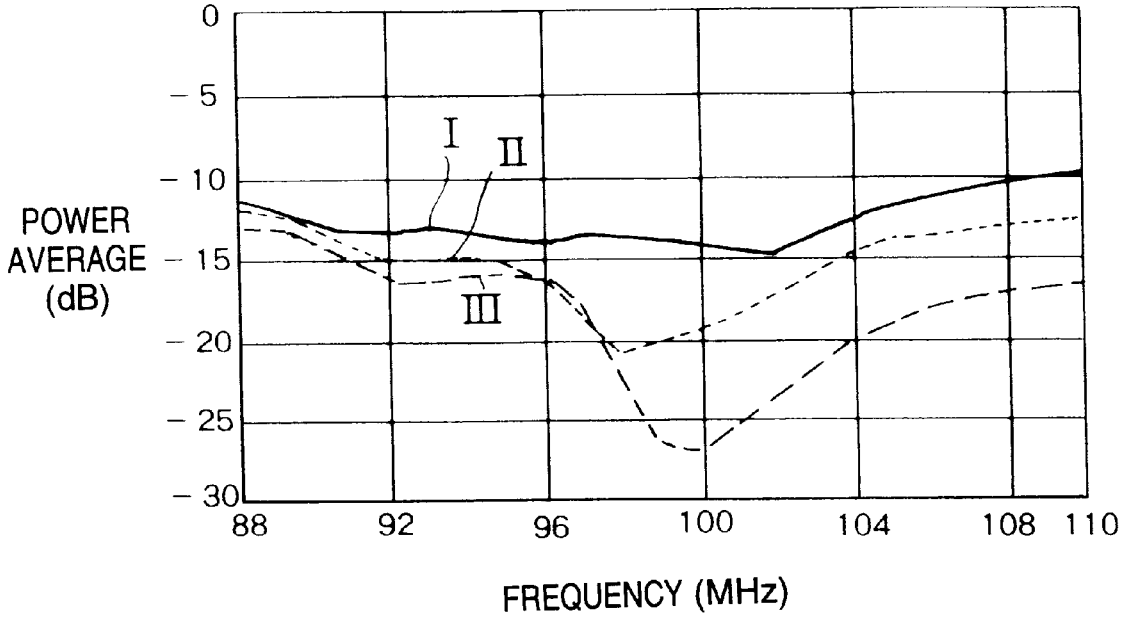
FIG. 44A is a graph showing changes in reception characteristics within the reception radio wave range from 88 MHz to 110 MHz when the length of the horizontal wire of the second antenna element is variously changed (18 cm, 5 cm, 0 cm) in the glass antenna of the third embodiment.
FIG. 44B is a table showing the average reception sensitivities within the reception radio wave range from 88 MHz to 110 MHz when the length of the horizontal wire of the second antenna element is variously changed (18 cm, 5 cm, 0 cm) in the glass antenna of the third embodiment.
Figure 44C:
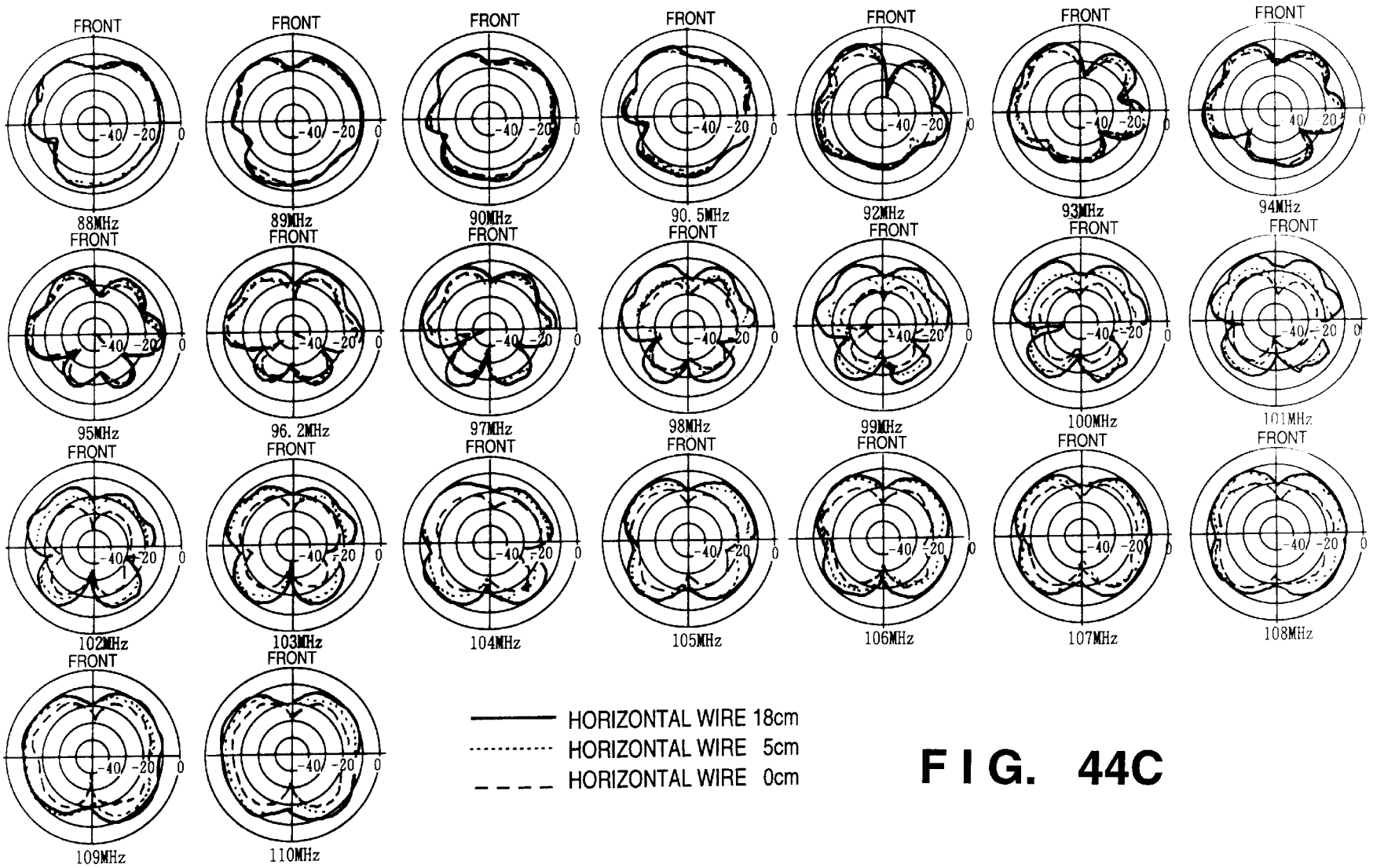
FIG. 44C shows changes in directivity characteristics within the reception radio wave range from 88 MHz to 110 MHz when the length of the horizontal wire of the second antenna element is variously changed (18 cm, 5 cm, 0 cm) in the glass antenna of the third embodiment.

In FIGS. 44A to 44C, bold solid curve I represents the reception sensitivity and directivity characteristics when the horizontal wire 200*h*=18 cm;

broken curve II represents the reception sensitivity and directivity characteristics when the horizontal wire 200*h*=5 cm; and broken curve III represents the reception sensitivity and directivity characteristics when the horizontal wire 200*h*=0 cm. When radio waves within the frequency range from 88 MHz to 110 MHz are to be received, practically sufficient reception sensitivity and directivity characteristics are obtained when the length of the horizontal wire 200*h* falls within the range from 40 cm to 5 cm.

Fourth Embodiment

The second antenna elements of all the three embodiments described above are capacitively coupled to the uppermost heating wire 3000*t* of the defogger 3000. In the fourth embodiment, a second antenna element 200' having a plurality of branch wires is used, as shown in FIG. 45.

Figure 45:
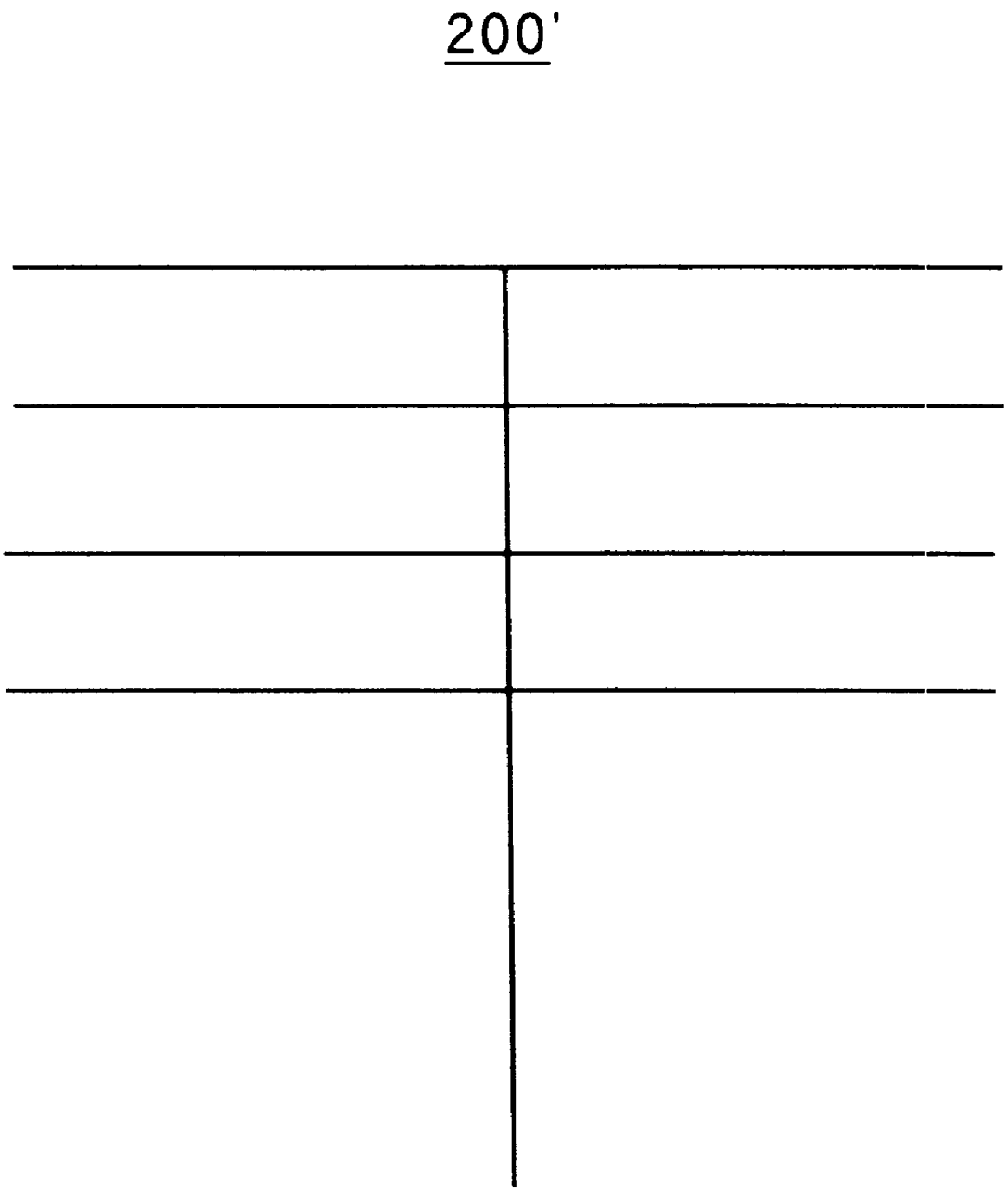
FIG. 45 is a view showing the arrangement of a second antenna element 200' according to the fourth embodiment of the present invention.

When the antenna element 200' shown in FIG. 45 is adhered to overlap the defogger heating wires, the individual branch wires are capacitively coupled to the corresponding heating wires.

Fifth Embodiment

Figure 46:
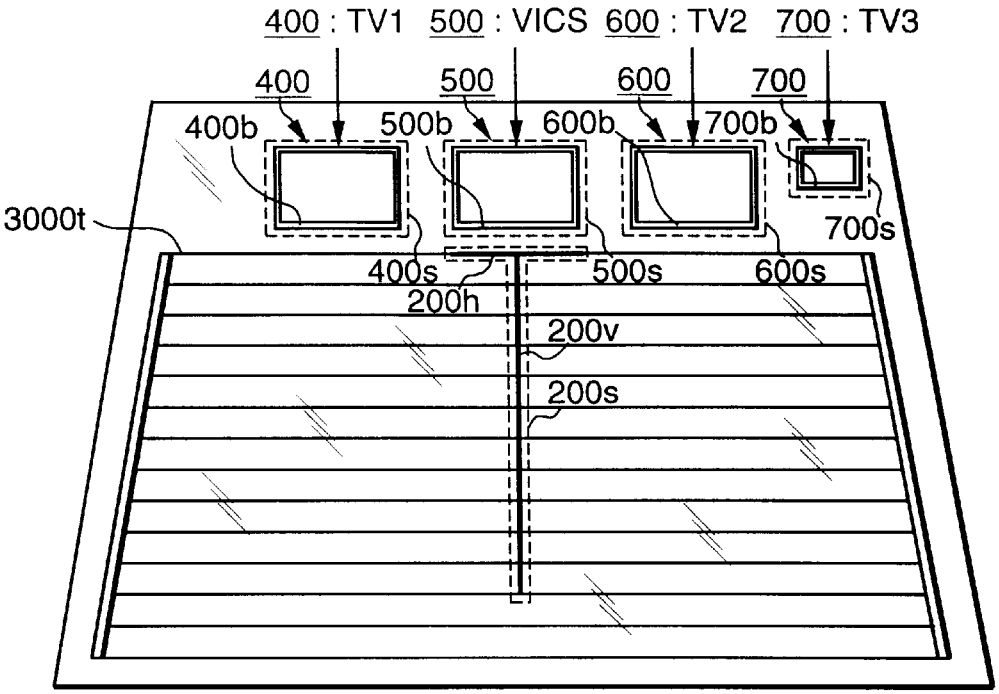
FIG. 46 is a view showing the arrangement of an antenna system according to the fifth embodiment of the present invention.

FIG. 46 shows the arrangement according to the fifth embodiment of the present invention. An antenna system of the fifth embodiment is designed to be able to receive VICS (Vehicle Information Control System) radio waves as well as radio waves in the TV frequency band.

More specifically, the antenna system of the fifth embodiment has an antenna element 500 for receiving VICS radio waves, and a T-shaped antenna element 200 as in the above embodiment in addition to antenna elements 400, 600, and 700 for receiving TV radio waves. These antenna elements are adhered onto the glass by seals 400*s*, 600*s*, 700*s*, 500*s*, and 200*s*.

Figure 47:
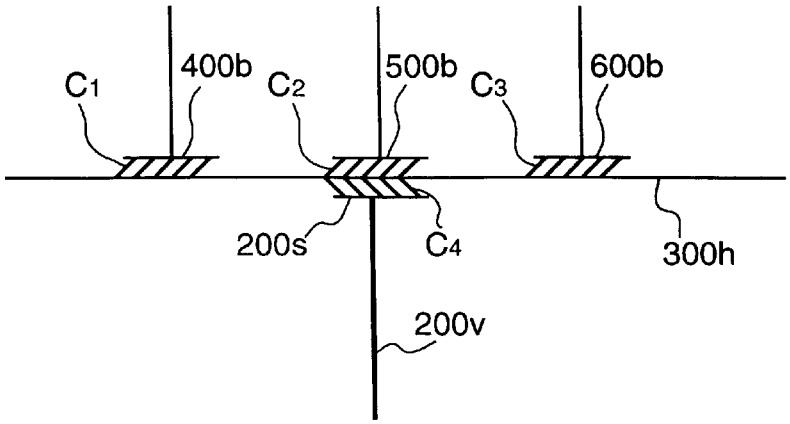
FIG. 47 is a circuit diagram when the individual antenna elements of the antenna system of the fifth embodiment are considered as coupling capacitance.

The antenna elements 400 and 600 for receiving TV radio waves and the antenna element 500 for receiving VICS radio waves are set in the vicinity of the uppermost heating wire 3000*t* of the defogger. Accordingly, as shown in FIG. 47, with the heating wire 3000*t*, a conductor 400*b* of the antenna element 400 forms a capacitor $C_1$, a conductor 500*b* of the antenna element 500 forms a capacitor $C_2$. a conductor 600*b* of the antenna element 600 forms a capacitor $C_3$, and the conductor 200*h* of the antenna element 200 forms a capacitor $C_4$. The capacitors $C_1$, $C_2$. and $C_3$ are connected in parallel with each other, and are connected in series with the capacitor $C_4$, respectively.

Note that the antenna element 700 is not capacitively coupled to the heating wire 3000*t* since its conductor 700*b* is separate from the heating wire 3000*t*.

FIGS. 48A to 51C show the reception performance of the antenna system of the fifth embodiment (FIG. 46) with respect to horizontally polarized radio waves.

Figures 49A, 49B:
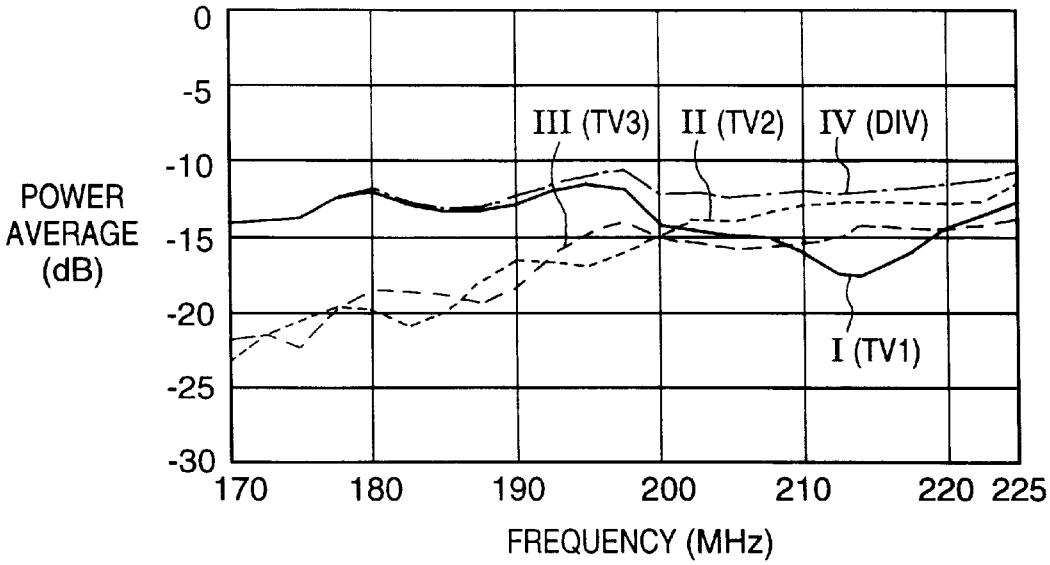
FIGS. 49A to 49C show the reception characteristics of the antenna elements (400, 600, 700) of the fifth embodiment with respect to TV radio waves within the range from 170 MHz to 225 MHz.
Figure 49C:
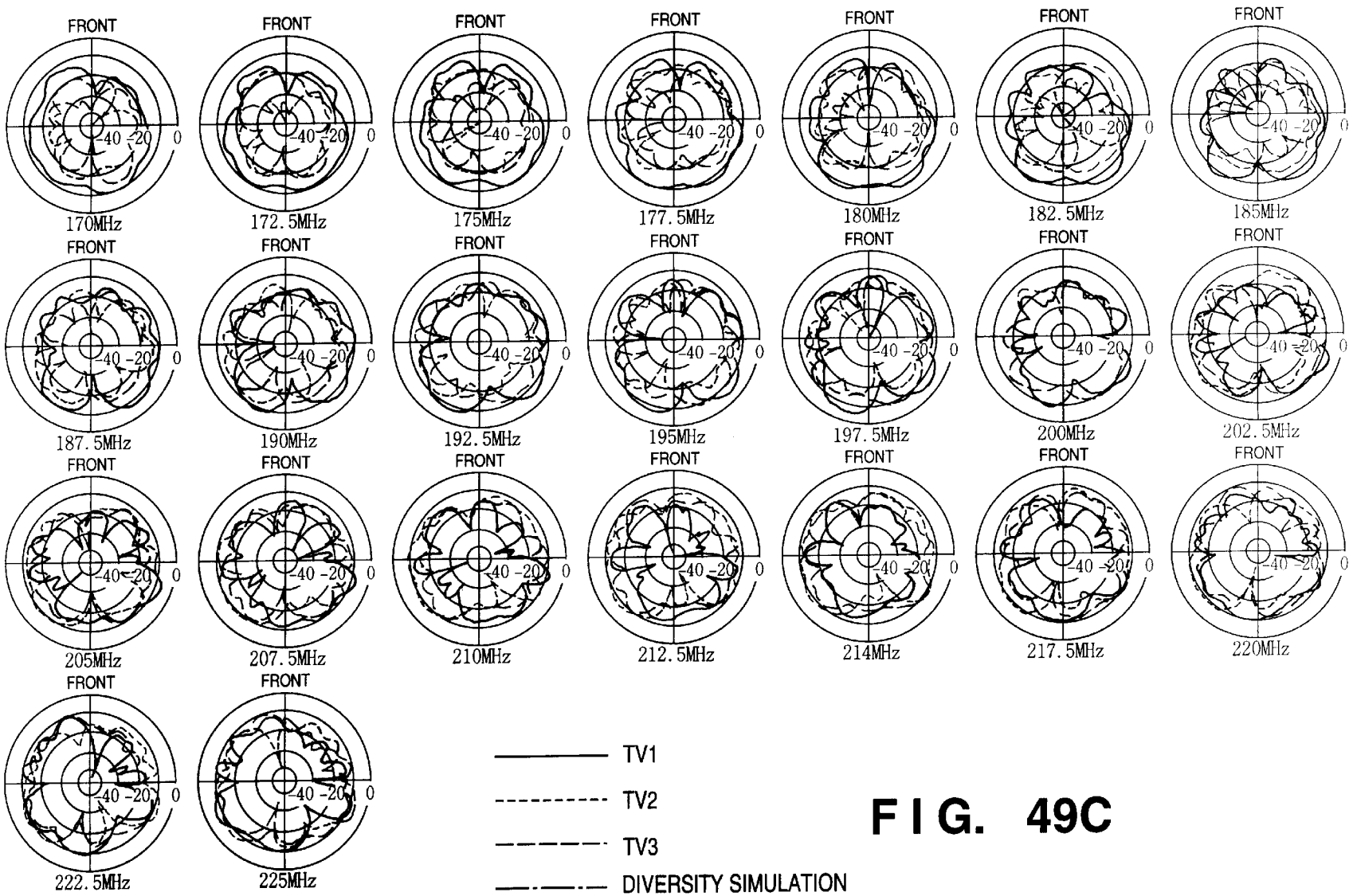
Figures 50A, 50B:
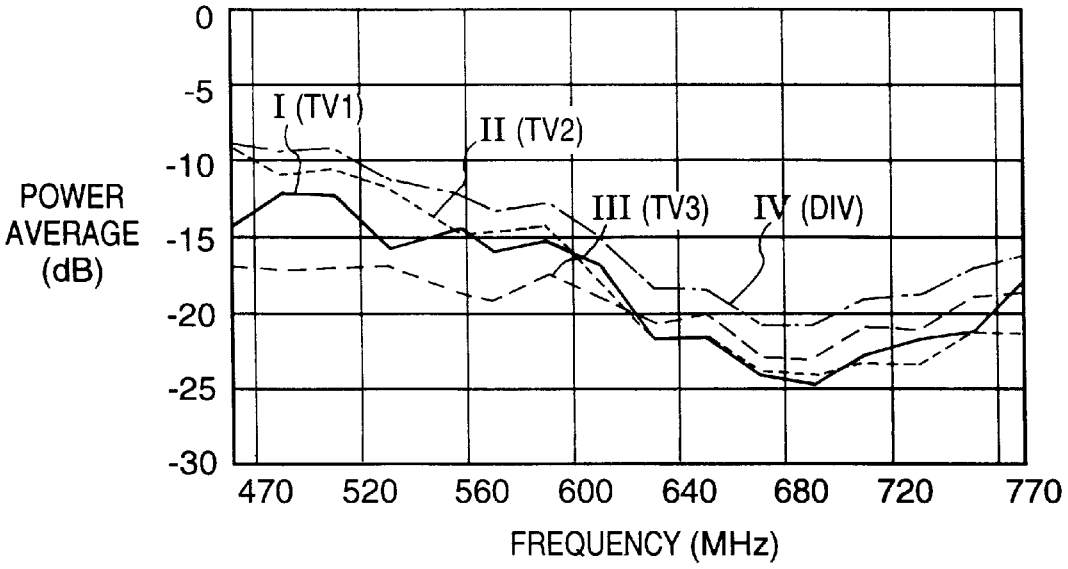
FIGS. 50A to 50C show the reception characteristics of the antenna elements (400, 600, 700) of the fifth embodiment with respect to TV radio waves within the range from 470 MHz to 770 MHz.
Figure 50C:
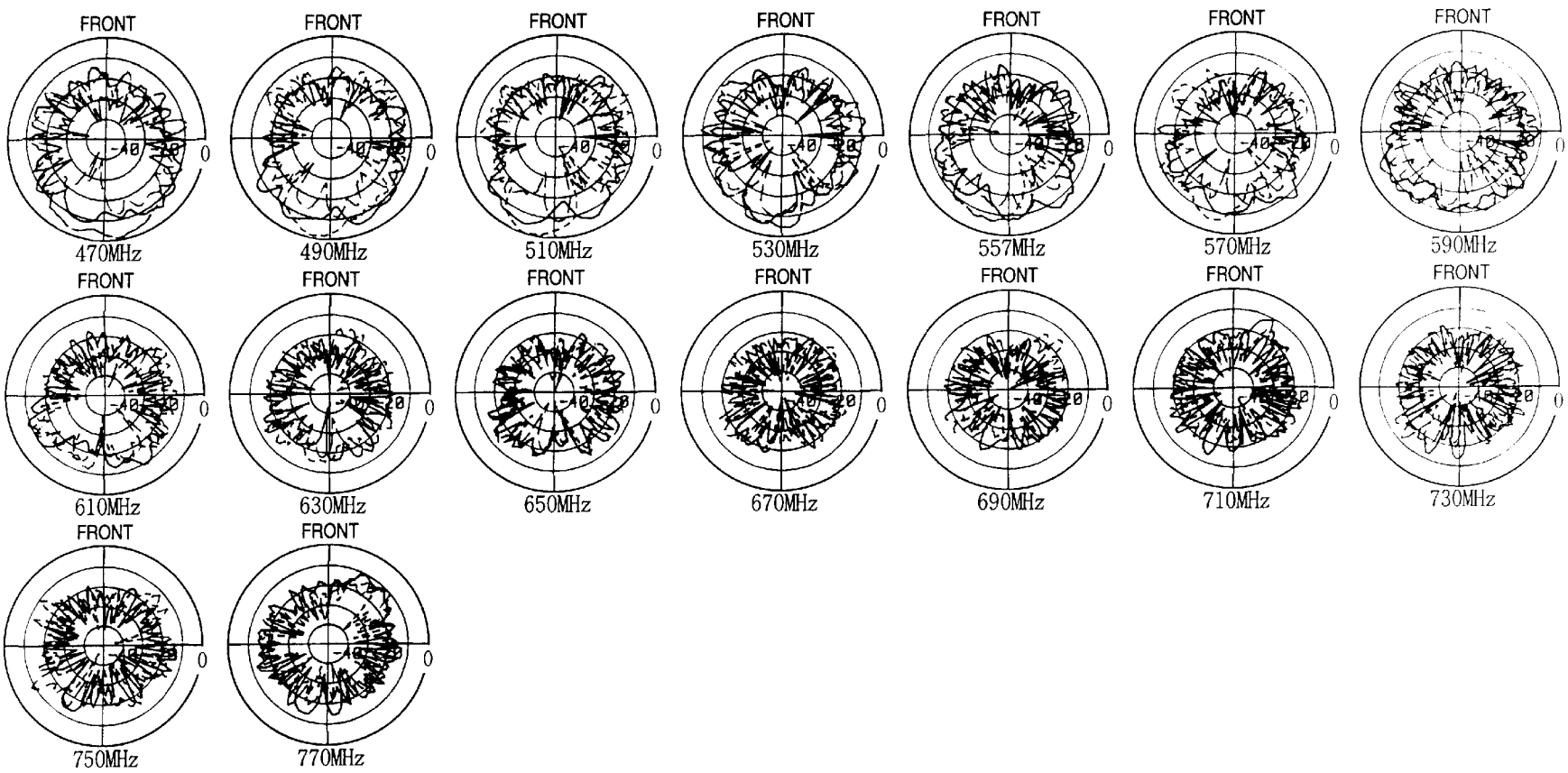
Figures 51A, 51B:
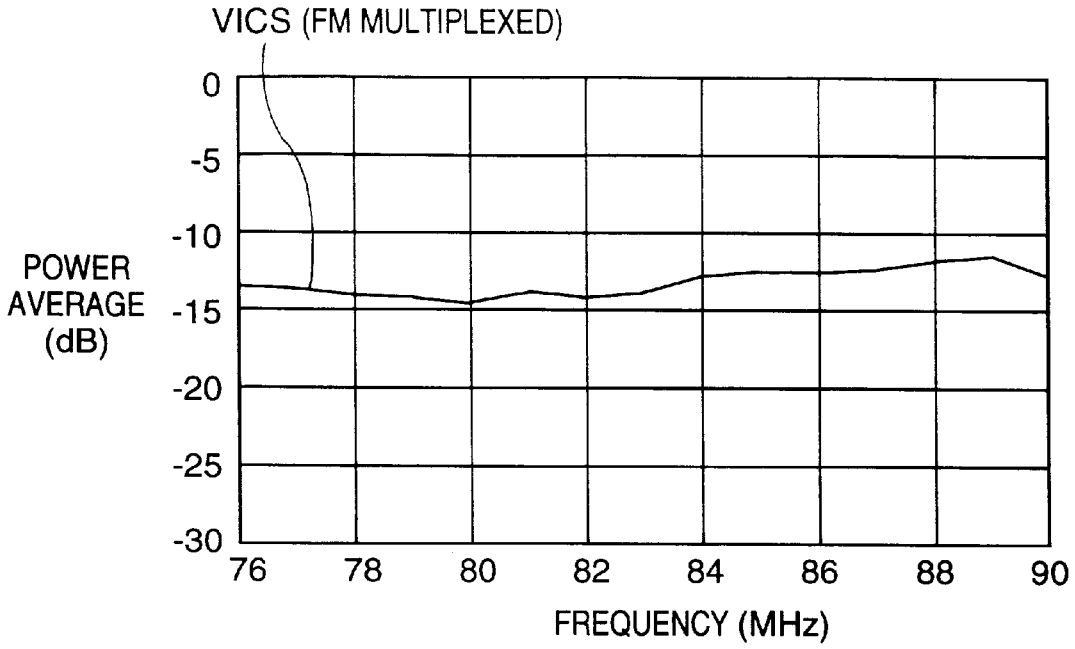
FIGS. 51A to 51C show the reception characteristics of an antenna element (500) of the fifth embodiment with respect to VIAS radio waves within the range from 76 MHz to 90 MHz.
Figure 51C:
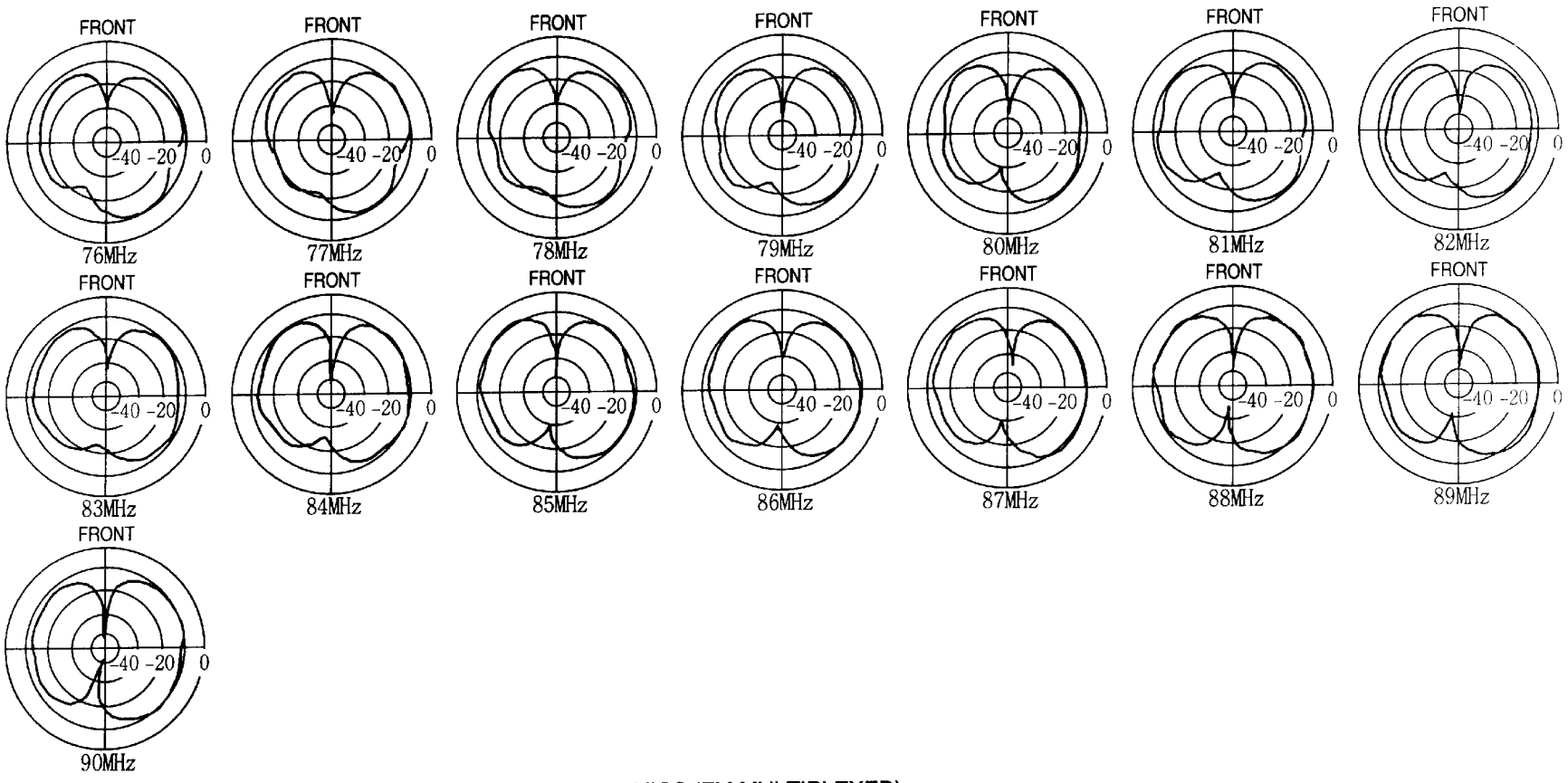

In particular, FIGS. 48A to 50C show the reception performance of the TV antenna elements 400, 600, and 700, and FIGS. 51A to 51C show the reception performance of the VICS antenna element 500.

Figures 48A, 48B:
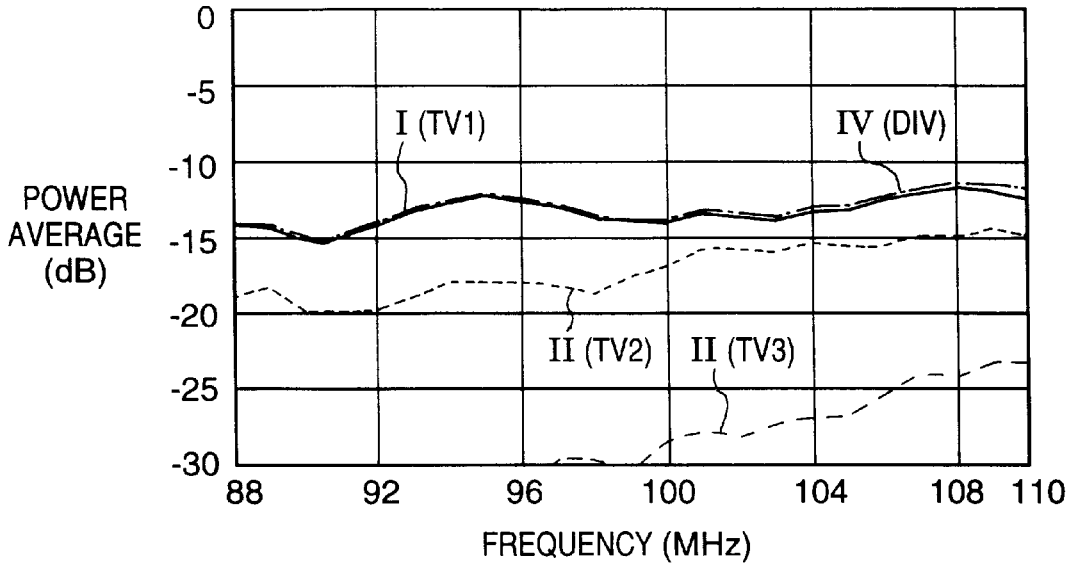
FIGS. 48A to 48C show the reception characteristics of antenna elements (400, 600, 700) of the fifth embodiment with respect to TV radio waves within the range from 88 MHz to 100 MHz.
Figure 48C:
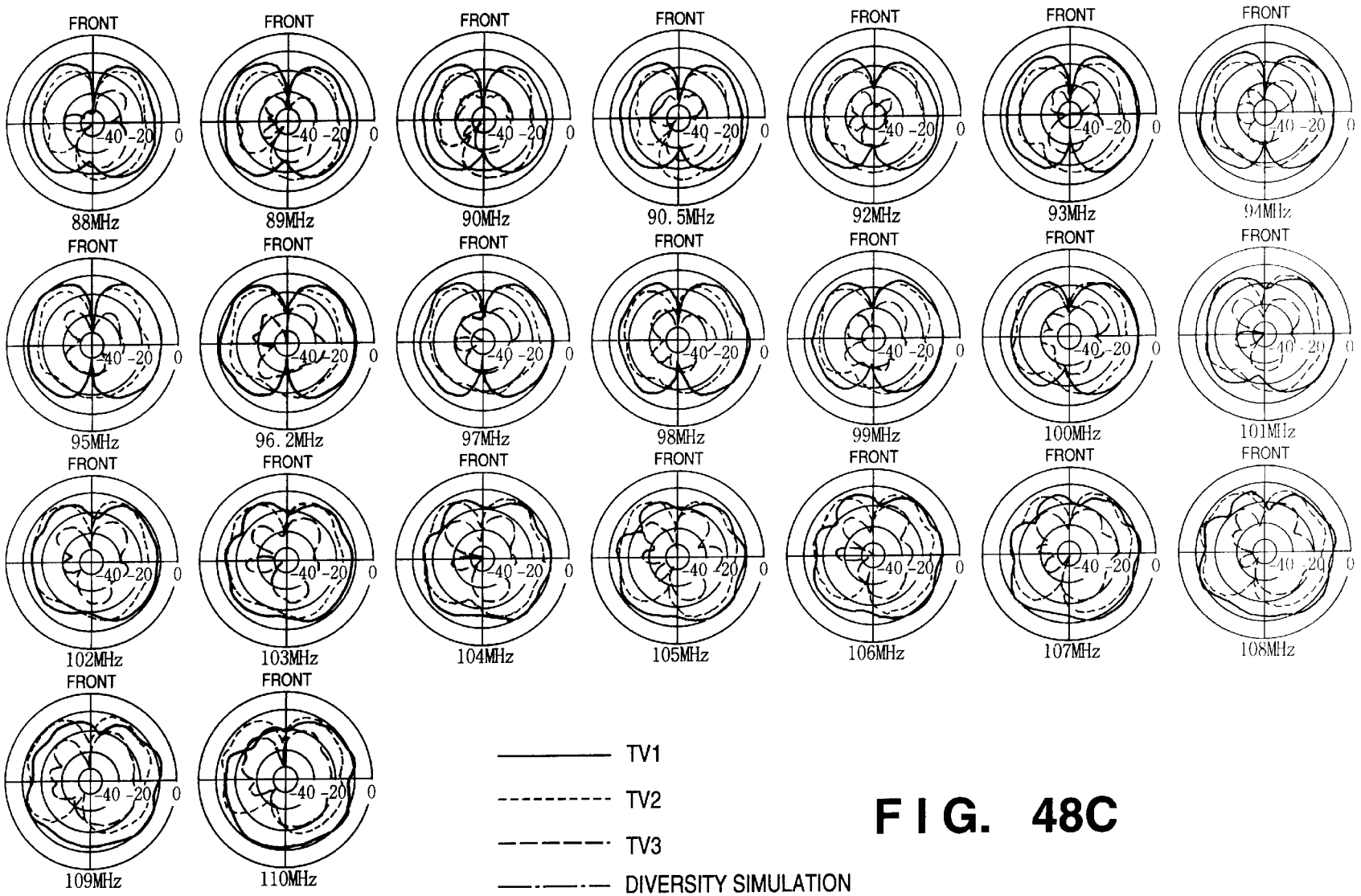

Also, especially, FIGS. 48A and 48B show the power of radio waves received by the TV antenna elements 400, 600, and 700 with respect to radio waves in the frequency band from 88 MHz to 110 MHz, and FIG. 48C shows the directivity characteristics of these antenna elements with respect to radio waves in that frequency band. Note that broken curve IV in FIG. 48A represents not the characteristics of these antenna elements but the diversity simulation result. FIGS. 49A and 49B show the power of radio waves received by the TV antenna elements 400, 600, and 700 with respect to radio waves in the frequency band from 170 MHz to 225 MHz, and FIG. 49C shows the directivity characteristics of these antenna elements with respect to radio waves in that frequency band. FIGS. 50A and 50B show the power of radio waves received by the TV antenna elements 400,

600, and 700 with respect to radio waves in the frequency band from 470 MHz to 770 MHz, and FIG. 50C shows the directivity characteristics of these antenna elements with respect to radio waves in that frequency band.

FIGS. 51A and 51B show the power of radio waves received by the VICS antenna element 500 with respect to VICS radio waves in the frequency band from 76 MHz to 90 MHz, and FIG. 51C shows the directivity characteristics of the antenna element with respect to radio waves in that frequency band.

As described above, the antenna system of the fifth embodiment not only exhibits excellent reception characteristics with respect to TV radio waves in various frequency bands and constitutes a diversity antenna system, but also can receive VICS radio waves.

Advantages of Embodiments

The glass antennas according to the above-mentioned four embodiments have been described, and according to these antennas, the following effects are expected.

I: The end user of a vehicle with the defogger can easily set a high-performance glass antenna.

II: That is, since both the first and second antenna elements 100 and 200 of each embodiment have an adhesive on their body portions contacting the glass, the antenna conductors can be easily adhered onto the glass. Furthermore, since the protection film that covers all the conductors of the antenna also has a role of fixing the conductors to the glass by an adhesive, the fixed state of the antenna conductors can be reinforced. Hence, the user can set the glass antenna of the present invention by simply adhering the antenna conductors with an adhesive to the glass.

III: Also, since the grounding method of each embodiment adopts an additional type simple grounding structure which is applied to the additional sticker type capacitively coupled antenna of the present invention, the user can ground the glass antenna of the present invention.

IV: In all of the first to third embodiments, since reception performance as high as that of the directly-connected capacitive connection type antenna as the prior application proposed by the present applicant can be obtained, an antenna which is simple but has excellent reception performance as high as a rear pole antenna can be easily set.

Modifications

Various modifications of the present invention may be made.

For example, the present invention is not limited to the position of the windshield glass as long as a defogger is set thereon.

The glass antenna of each embodiment is set by adhering the antenna elements from the inner side of the windshield glass. Alternatively, the antenna elements may be adhered to the glass from outside the vehicle. In this case, the antenna elements must have high waterproof properties.

In the present invention, it is important that the defogger heating wire and the second antenna element are capacitively coupled to each other to exhibit a low resistance state in the reception frequency band. In this sense, the horizontal wire 200*h* of the second antenna element is not indispensable, and the second antenna element may be constituted by the vertical wire 200*v* alone. In this case, in order to capacitively couple the vertical wire 200*v* and the defogger heating wire, a small capacitor may be interposed therebetween.

The heating wire of the defogger to which the second antenna element is capacitively coupled need not always be the heating wire 3000*t* to which the first antenna element is capacitively coupled. For example, the first antenna element is capacitively coupled to the heating wire 3000*t*, and the horizontal wire 200*h* of the second antenna element 200 is set at a position below the heating wire 3000*a*, thereby capacitively coupling the second antenna element to the heating wire 3000*a*.

In each of the above embodiments, the first antenna element is adhered to the glass using an insulating adhesive seal. However, since the first antenna element is arranged on a region where no defogger heating wires are present, the adhesive seal need not always have insulating properties.

As described above, according to the glass antenna and its setting method of the present invention, a glass antenna which can be easily set by the user and is expected to have characteristics as high as those of a pole antenna can be provided.

When glass antenna parts of the present invention are used, even the end user can easily set a high-performance glass antenna.

As many apparently widely different embodiments of the present invention can be made without departing from the spirit and scope thereof, it is to be understood that the invention is not limited to the specific embodiments thereof except as defined in the appended claims.

What is claimed is:

1. A glass antenna which is set on a surface of a glass on which a defogger is arranged, comprising:

a first antenna element which has a feeding point, is extended on a blank region on the glass surface where no heating wire is arranged, and is capacitively coupled to a heating wire of said defogger; and a second antenna element which is not connected to a feeding point and has a first conductor extending in a first direction perpendicular to the heating wire of said defogger on a region where said defogger is extended, and is capacitively coupled to the heating wire of said defogger which is close to said first antenna element.

2. The glass antenna according to claim 1, wherein the heating wire of said defogger has a plurality of heating wires substantially parallel to a widthwise direction of said defogger and wherein said second antenna element has a second conductor which is connected to said first conductor in DC term and extends in the widthwise direction, said second conductor being capacitively coupled to said heating wire.

3. The glass antenna according to claim 2, wherein said first conductor and said second conductor of said second antenna element form a T shape, and a length of said second conductor is set at not less than 5 cm.

4. The glass antenna according to claim 3, wherein the length of said second conductor is set at not less than 20 cm.

5. The glass antenna according to claim 2, wherein said blank region is provided in an upper area of the glass surface, and said second conductor is provided between a top uppermost heating wire of said plurality of heating wires and said first antenna element.

6. The glass antenna according to claim 2, wherein said blank region is provided in an upper area of the glass surface, and said second conductor is provided between a top uppermost heating wire of said plurality of heating wires and the heating wire next to the top uppermost heating wire.

7. The glass antenna according to claim 2, wherein said blank region is provided in an upper area of the glass surface, and said second conductor is provided to overlap a top uppermost heating wire of said plurality of heating wires.

8. The glass antenna according to claim 1, wherein the blank region is assured on an upper region of the glass surface, and said defogger has a plurality of heating wires substantially parallel to a widthwise direction of said defogger, said first antenna element is capacitively coupled to an uppermost heating wire of said defogger, and said second antenna element is capacitively coupled to the uppermost heating wire.

9. The glass antenna according to claim 8, wherein a lowermost portion of said first antenna element is capacitively coupled to the uppermost heating wire by setting the lowermost portion at a position in the vicinity of the uppermost heating wire, and an uppermost end of said second antenna element is set at a position between the uppermost heating wire and the lowermost portion of said first antenna element.

10. The glass antenna according to claim 8, wherein a lowermost portion of said first antenna element is capacitively coupled to the uppermost heating wire by setting the lowermost portion at a position in the vicinity of the uppermost heating wire, and an uppermost end of said second antenna element is set at a position between the uppermost heating wire and a second uppermost heating wire.

11. The glass antenna according to claim 8, wherein a lowermost portion of said first antenna element is capacitively coupled to the uppermost heating wire by setting the lowermost portion at a position in the vicinity of the uppermost heating wire, and said first conductor of said second antenna element extends in the longitudinal direction of said defogger, and an uppermost end of said second antenna element is set to overlap the uppermost heating wire.

12. The glass antenna according to claim 1, wherein a length of said first conductor of said second antenna element is set in correspondence with a frequency of a radio wave to be received.

13. The glass antenna according to claim 1, wherein said second antenna element is capacitively coupled to said heating wire of said defogger at not less than 10 pF.

14. The glass antenna according to claim 1, wherein the conductor of said second antenna is set on the glass surface via an insulating layer on the region where said defogger is arranged.

15. The glass antenna according to claim 1, wherein said second antenna element is adhered onto the glass surface by an adhesive.

16. The glass antenna according to claim 1, wherein said first antenna element is adhered via an adhesive layer to said window glass from interior thereof, and said second antenna element is adhered via an adhesive layer to said window glass from interior thereof so that said second antenna element is located above a glass area where said defogger is provided.

17. The glass antenna according to claim 1, wherein said first antenna element has a loop shape, and said second antenna element has a T character shape.

18. A method of setting an antenna on a surface of a glass on which a defogger is arranged having a plurality of heating wires substantially parallel to a widthwise direction of said defogger, said method comprising:

a first fixing step of fixing a first antenna element having a feeding point on the glass surface so as to capacitively couple said first antenna element to a heating wire of said defogger, on a blank region of the glass surface where no heating wire is arranged; and a second fixing step of fixing a second antenna element having an elongated first conductor on the glass surface and a second conductor which is connected to said first conductor in DC term, so as to arrange said first conductor extending in a first direction perpendicular to a heating wire of said defogger on a region where said defogger is arranged, and to capacitively couple said second antenna element to the heating wire of said defogger present on a region close to said first antenna element, wherein the second fixing step includes a step of fixing said second antenna element on the glass surface so as to arrange said second conductor extending in a widthwise direction of said defogger, to capacitively couple said second conductor to said heating wire and to set said second conductor at a position in the vicinity of said heating wire.

19. The method according to claim 18, wherein said first antenna element has a width in a vertical direction, and a lowermost portion of said first antenna element is set at a position in the vicinity of an uppermost heating wire of said defogger, and an uppermost end, in the vertical direction, of said second antenna element is set at a position between the uppermost heating wire and the lowermost portion of said first antenna element.

20. The method according to claim 18, wherein said first antenna element has a width in a vertical direction, and a lowermost portion of said first antenna element is set at a position in the vicinity of an uppermost heating wire of said defogger, and an uppermost end, in the vertical direction, of said second antenna element is set at a position between the uppermost heating wire and a second uppermost heating wire.

21. The method according to claim 18, wherein said first antenna element has a width in a vertical direction, and a lowermost portion of said first antenna element is capacitively coupled to an uppermost heating wire by setting the lowermost portion at a position in the vicinity of the uppermost heating wire, and an uppermost end of said second antenna element is set to overlap the uppermost heating wire.

22. The glass antenna according to claim 18, wherein said first antenna element is adhered via an adhesive layer to said window glass from interior thereof, and said second antenna element is adhered via an adhesive layer to said window glass from interior thereof so that said second antenna element is located above a glass area where said defogger is provided.

23. The glass antenna according to claim 18, wherein said first antenna element has a loop shape, and said second antenna element has a T character shape.

24. A method of setting an antenna on a surface of a glass on which a defogger is arranged having a plurality of heating wires substantially parallel to a widthwise direction of said defogger, said method comprising:

a first fixing step of fixing a first antenna element having a feeding point on the glass surface so as to capacitively couple said first antenna element to a heating wire of said defogger, on a blank region of the glass surface where no heating wire is arranged the blank region being assured on an upper region of the glass surface; and a second fixing step of fixing a second antenna element having an elongated first conductor on the glass surface, so as to arrange said first conductor extending in a first direction perpendicular to a heating wire of said defogger on a region where said defogger is arranged, and to capacitively couple said second antenna element to the heating wire of said defogger present on a region close to said first antenna element.

said method further comprising the steps of:

fixing said first antenna element to be capacitively coupled to an uppermost heating wire, in a vertical direction, of said defogger, and fixing said second antenna element to be capacitively coupled to the uppermost heating wire.

25. A glass antenna which is set on a surface of a glass on which a defogger is arranged, comprising:

a first antenna element having a feeding point, is extended on a blank region on the glass surface where no heating wire is arranged, and is capacitively coupled to a heating wire of said defogger; and a second antenna element having a first conductor extending in a first direction perpendicular to the heating wire of said defogger on a region where said defogger is extended, and is capacitively coupled to the heating wire of said defogger which is close to said first antenna element, wherein said second antenna element has at least one branch conductor wire extending in a widthwise direction of said defogger, and said at least one branch conductor wire is capacitively coupled to at least one heating wire of said defogger.

26. A glass antenna which is set on a surface of a glass on which a defogger is arranged having a plurality of heating wires substantially parallel to a widthwise direction of said defogger, comprising:

a first antenna element having a feeding point, extends in a longitudinal direction of said defogger, is extended on a blank region on the glass surface where no heating wire is arranged, and is capacitively coupled to a heating wire of said defogger; and a second antenna element having a first conductor extending in a first direction perpendicular to the heating wire of said defogger on a region where said defogger is extended, having a second conductor connected to said first conductor in DC term and extends in the widthwise direction, and is capacitively coupled to the heating wire of said defogger which is close to said first antenna element, said second conductor being capacitively coupled to said heating wire.

27. The glass antenna according to claim 26, wherein said first conductor and said second conductor of said second antenna element form a T shape, and a length of said second conductor is set at not less than 5 cm.

28. The glass antenna according to claim 26, wherein the length of said second conductor is set at not less than 20 cm.

29. The glass antenna according to claim 26, wherein said blank region is provided in an upper area of the glass surface, and said second conductor is provided between a top uppermost heating wire of said plurality of heating wires and said first antenna element.

30. The glass antenna according to claim 26, wherein said blank region is provided in an upper area of the glass surface, and said second conductor is provided between a top uppermost heating wire of said plurality of heating wires and the heating wire next to the top uppermost heating wire.

31. The glass antenna according to claim 26, wherein said blank region is provided in an upper area of the glass surface, and said second conductor is provided to overlap a top uppermost heating wire of said plurality of heating wires.

32. The glass antenna according to claim 26, wherein said first antenna element is adhered via an adhesive layer to said window glass from interior thereof, and said second antenna element is adhered via an adhesive layer to said window glass from interior thereof so that said second antenna element is located above a glass area where said defogger is provided.

33. The glass antenna according to claim 26, wherein said first antenna element has a loop shape, and said second antenna element has a T character shape.

34. A glass antenna which is set on a surface of a glass on which a defogger is arranged having a plurality of heating wires substantially parallel to a widthwise direction of said defogger, comprising:

a first antenna element having a feeding point, is extended on a blank region on the glass surface where no heating wire is arranged, and is capacitively coupled to an uppermost heating wire of said defogger, the blank region being assured on an upper region of the glass surface; and a second antenna element having a first conductor extending in a first longitudinal direction of said defogger perpendicular to the uppermost heating wire of said defogger on a region where said defogger is extended, and is capacitively coupled to the heating wire of said defogger which is close to said first antenna element, wherein a lowermost portion of said first antenna element is capacitively coupled to the uppermost heating wire by setting the lowermost portion at a position in the vicinity of the uppermost heating wire, and an uppermost end of said second antenna element is set at a position between the uppermost heating wire and the lowermost portion of said first antenna element.

35. The glass antenna according to claim 34, wherein the conductor of said second antenna is set on the glass surface via an insulating layer on the region where said defogger is arranged.

36. The glass antenna according to claim 34, wherein said second antenna element is adhered onto the glass surface by an adhesive.

37. The glass antenna according to claim 34, wherein said first antenna element is adhered via an adhesive layer to said window glass from interior thereof, and said second antenna element is adhered via an adhesive layer to said window glass from interior thereof so that said second antenna element is located above a glass area where said defogger is provided.

38. The glass antenna according to claim 34, wherein said first antenna element has a loop shape, and said second antenna element has a T character shape.

39. A glass antenna which is set on a surface of a glass on which a defogger is arranged having a plurality of heating wires substantially parallel to a widthwise direction of said defogger, comprising:

a first antenna element having a feeding point, is extended on a blank region on the glass surface where no heating wire is arranged, and is capacitively coupled to an uppermost heating wire of said defogger, the blank region being assured on an upper region of the glass surface; and a second antenna element having a first conductor extending in a first longitudinal direction of said defogger perpendicular to the uppermost heating wire of said defogger on a region where said defogger is extended, and is capacitively coupled to the heating wire of said defogger which is close to said first antenna element, wherein a lowermost portion of said first antenna element is capacitively coupled to the uppermost heating wire by setting the lowermost portion at a position in the vicinity of the uppermost heating wire, and an uppermost end of said second antenna element is set at a position between the uppermost heating wire and the next heating wire to the uppermost heating wire.

40. The glass antenna according to claim 39, wherein the conductor of said second antenna is set on the glass surface via an insulating layer on the region where said defogger is arranged.

41. The glass antenna according to claim 39, wherein said second antenna element is adhered onto the glass surface by an adhesive.

42. The glass antenna according to claim 39, wherein said first antenna element is adhered via an adhesive layer to said window glass from interior thereof, and said second antenna element is adhered via an adhesive layer to said window glass from interior thereof so that said second antenna element is located above a glass area where said defogger is provided.

43. The glass antenna according to claim 39, wherein said first antenna element has a loop shape, and said second antenna element has a T character shape.

44. A glass antenna which is set on a surface of a glass on which a defogger is arranged having a plurality of heating wires substantially parallel to a widthwise direction of said defogger, comprising:

a first antenna element having a feeding point, is extended on a blank region on the glass surface where no heating wire is arranged, and is capacitively coupled to an uppermost heating wire of said defogger, the blank region being assured on an upper region of the glass surface; and a second antenna element having a first conductor extending in a first longitudinal direction of said defogger perpendicular to the uppermost heating wire of said defogger on a region where said defogger is extended, and is capacitively coupled to the heating wire of said defogger which is close to said first antenna element, wherein a lowermost portion of said first antenna element is capacitively coupled to the uppermost heating wire by setting the lowermost portion at a position in the vicinity of the uppermost heating wire, and said first conductor of said second antenna element extends in the longitudinal direction of said defogger, and an uppermost end of said second antenna element is set to overlap the uppermost heating wire.

45. The glass antenna according to claim 44, wherein the conductor of said second antenna is set on the glass surface via an insulating layer on the region where said defogger is arranged.

46. The glass antenna according to claim 44, wherein said second antenna element is adhered onto the glass surface by an adhesive.

47. The glass antenna according to claim 44, wherein said first antenna element is adhered via an adhesive layer to said window glass from interior thereof, and said second antenna element is adhered via an adhesive layer to said window glass from interior thereof so that said second antenna element is located above a glass area where said defogger is provided.

48. The glass antenna according to claim 44, wherein said first antenna element has a loop shape, and said second antenna element has a T character shape.

* * * * *

UNITED STATES PATENT AND TRADEMARK OFFICE

CERTIFICATE OF CORRECTION

PATENT NO. : 6,002,373
DATED : December 14, 1999
INVENTOR(S) : Tatsuaki Taniguchi et al.

It is certified that error appears in the above-identified patent and that said Letters Patent is hereby corrected as shown below:

Title page,
Item [56], References Cited, add:

| | | | | | |
|---|---|---|---|---|---|
| -- | 3,599,214 | 8/71 | Altmayer | 343/713 | |
| | 3,810,180 | 5/74 | Kunert et al. | 343/713 | |
| | 4,873,532 | 10/89 | Sakurai et al. | 343/713 | |
| | 5,719,585 | 2/98 | Tabata et al. | 343/713 | -- |

Signed and Sealed this

Twenty-eighth Day of May, 2002

*Attest:*

*Attesting Officer*

JAMES E. ROGAN
*Director of the United States Patent and Trademark Office*